US011685573B2

(12) United States Patent
Nichols et al.

(10) Patent No.: US 11,685,573 B2
(45) Date of Patent: Jun. 27, 2023

(54) CARRY STRAP FOR CONTAINER

(71) Applicant: YETI Coolers, LLC, Austin, TX (US)

(72) Inventors: Steve Charles Nichols, Austin, TX (US); Andy Bondhus, Austin, TX (US); Liza Morris, Austin, TX (US); Ryan Nixon, Austin, TX (US); John Loudenslager, Austin, TX (US); John W. Dow, Austin, TX (US); Derek G. Sullivan, Austin, TX (US)

(73) Assignee: YETI Coolers, LLC, Austin, TX (US)

( * ) Notice: Subject to any disclaimer, the term of this patent is extended or adjusted under 35 U.S.C. 154(b) by 228 days.

(21) Appl. No.: 16/828,282

(22) Filed: Mar. 24, 2020

(65) Prior Publication Data

US 2020/0216224 A1 Jul. 9, 2020

Related U.S. Application Data

(63) Continuation-in-part of application No. 16/006,344, filed on Jun. 12, 2018, now Pat. No. 11,203,465.
(Continued)

(51) Int. Cl.
*B65D 25/28* (2006.01)
*B65D 43/16* (2006.01)
*B65D 81/38* (2006.01)

(52) U.S. Cl.
CPC ..... *B65D 25/2873* (2013.01); *B65D 25/2841* (2013.01); *B65D 43/163* (2013.01); *B65D 81/3813* (2013.01)

(58) Field of Classification Search
CPC ..... B65D 25/2873; B65D 2525/285; B65D 25/2841; B65D 43/163; B65D 81/3813; A45F 2003/142; A45F 3/14
See application file for complete search history.

(56) References Cited

U.S. PATENT DOCUMENTS 286,909 A 10/1883 Commander
749,959 A 1/1904 Curtiss
(Continued)

FOREIGN PATENT DOCUMENTS

BE 1013040 A3 8/2001
BE 1016429 A3 10/2006
(Continued)

OTHER PUBLICATIONS

Aug. 13, 2020—(WO) Partial International Search—PCT/US2020/026655.
(Continued)

*Primary Examiner* — Anthony D Stashick
*Assistant Examiner* — Blaine G Neway
(74) *Attorney, Agent, or Firm* — Banner & Witcoff, Ltd.

(57) ABSTRACT

A container having a base and a lid is provided. The lid may be rotatable about a hinge from a closed configuration to an open configuration and may be secured, via one or more latching assemblies. The latching assembly may comprise a latch body, a locking member, a biasing member, and an activating member. Additional features of the container may include handles and strength increasing features. The base and lid may also feature attachment points for various accessories. A carry strap may attach to the base of the container to allow a user to lift and carry the container.

8 Claims, 48 Drawing Sheets

Related U.S. Application Data

(60) Provisional application No. 62/518,358, filed on Jun. 12, 2017.

(56) References Cited

U.S. PATENT DOCUMENTS 1,008,041 A 11/1911 Leonard
1,056,648 A 3/1913 Earley
2,028,339 A 1/1936 Levine et al.
2,101,337 A 12/1937 Komenak
2,109,928 A 3/1938 Passalaqua
2,183,121 A 12/1939 Levine
2,439,660 A 4/1948 Keil
2,455,069 A 11/1948 Launder
2,472,491 A 6/1949 Quinton
2,510,643 A 6/1950 Long
2,565,939 A 8/1951 Wriston
2,574,089 A 11/1951 Cochran
2,577,951 A 12/1951 Cortsen
2,581,417 A 1/1952 Jones
2,604,961 A 7/1952 Koch
2,647,653 A 8/1953 Dube
2,747,732 A 5/1955 Fischer
2,717,093 A 9/1955 Mautner
2,803,956 A 8/1957 Womer
2,869,909 A 1/1959 Harling
2,874,401 A 2/1959 Kotkins
2,912,080 A 11/1959 Ikelheimer
2,931,205 A 4/1960 Schmitz
2,936,189 A 5/1960 Pearson
3,009,193 A 11/1961 Lifton
3,057,636 A 10/1962 D'Ettorre
3,141,680 A 7/1964 McCord
3,191,244 A 6/1965 Burke
3,202,310 A 8/1965 Tibbets
3,225,983 A 12/1965 Majka
3,250,558 A 5/1966 McClintock
3,259,412 A 7/1966 Wheeler
3,416,701 A 12/1968 Kramer et al.
3,432,025 A 3/1969 Luhe
3,464,579 A 9/1969 Asenbauer
3,519,298 A 7/1970 Gley
3,565,305 A 2/1971 Belokin
3,642,168 A 2/1972 Wiley, Jr. et al.
3,656,650 A 4/1972 Frater
3,661,410 A 5/1972 Larson et al.
3,688,942 A 9/1972 Mitchell et al.
3,690,708 A 9/1972 Worley et al.
3,741,433 A 6/1973 Bentley et al.
3,797,876 A * 3/1974 Gummelt ..... H01M 50/256 16/DIG. 15
3,831,224 A 8/1974 MacMaster et al.
3,847,423 A 11/1974 Gley
3,861,504 A 1/1975 McGraw
3,882,914 A 5/1975 Strutz
3,886,625 A 6/1975 Rollband
3,902,628 A 9/1975 Schurman
3,915,362 A 10/1975 Hart
3,917,038 A 11/1975 Foge et al.
3,933,269 A 1/1976 Mastrovito
3,955,656 A 5/1976 Kashinski
3,987,829 A 10/1976 Leone
3,991,921 A 11/1976 Hirsch
4,094,392 A 6/1978 Gregg et al.
4,095,711 A 6/1978 Conley
4,116,479 A 9/1978 Poe
4,143,442 A 3/1979 Harlang
4,153,178 A 5/1979 Weavers
4,184,705 A 1/1980 Little
D256,630 S 9/1980 Maney
D257,218 S 10/1980 Eriksson
4,249,760 A 2/1981 Conley
4,254,850 A 3/1981 Knowles
4,273,223 A 6/1981 Tomlinson
4,343,412 A 8/1982 Wilcox et al.
4,351,165 A 9/1982 Gottsegen et al.
4,446,705 A 5/1984 Loucks
4,465,189 A 8/1984 Molzan
4,476,988 A 10/1984 Tanner
4,509,622 A 4/1985 Morszeck
4,515,421 A 5/1985 Steffes
4,516,686 A 5/1985 Chaussepied
4,522,312 A 6/1985 Rathgeber et al.
4,523,692 A 6/1985 Lemkin
4,541,540 A * 9/1985 Gretz ..... A45C 11/20 220/555
4,550,813 A 11/1985 Browning
4,561,526 A 12/1985 Winter et al.
4,573,202 A 2/1986 Lee
4,575,109 A 3/1986 Cowdery
D283,666 S 5/1986 Holzkopf
4,592,482 A 6/1986 Seager
4,615,464 A 10/1986 Byrns
4,662,188 A 5/1987 Hullihan
4,673,207 A 6/1987 Reynolds et al.
D290,908 S 7/1987 Thomas
4,706,344 A 11/1987 Tanaka et al.
4,707,011 A 11/1987 McKim, Jr.
4,712,657 A 12/1987 Myers et al.
4,746,008 A 5/1988 Heverly et al.
4,768,815 A 9/1988 Harmon
4,775,072 A 10/1988 Lundblade et al.
4,792,024 A 12/1988 Morton et al.
4,802,344 A 2/1989 Livingston et al.
4,805,272 A 2/1989 Yamaguchi
4,826,060 A 5/1989 Hollingsworth
4,858,444 A 8/1989 Scott
4,873,841 A 10/1989 Bradshaw et al.
4,899,904 A 2/1990 Dooley et al.
4,904,007 A 2/1990 Woodruff
4,917,261 A 4/1990 Borst
4,928,800 A 5/1990 Green et al.
4,930,649 A 6/1990 Moser
4,975,073 A 12/1990 Weisman
4,978,044 A * 12/1990 Silver ..... A45F 3/12 150/108
4,982,863 A 1/1991 Skillius
5,011,013 A 4/1991 Meisner et al.
5,011,020 A 4/1991 Stevens et al.
5,014,830 A 5/1991 Seynhaeve
5,024,471 A 6/1991 Kahl et al.
5,040,834 A 8/1991 Kahl et al.
5,044,513 A 9/1991 Van Berne
5,062,557 A 11/1991 Mahvi et al.
5,075,925 A 12/1991 Maloney
5,080,250 A 1/1992 Dickinson et al.
5,096,030 A 3/1992 Espinosa et al.
5,101,541 A 4/1992 Watanabe
5,105,920 A 4/1992 Grebenstein
5,111,920 A 5/1992 Castelli et al.
D327,427 S 6/1992 McCooey
5,117,952 A 6/1992 Suh
D328,186 S 7/1992 Hanke
5,139,294 A 8/1992 Ward et al.
D329,135 S 9/1992 Embree
5,153,561 A 10/1992 Johnson
5,165,583 A 11/1992 Kouwenberg
5,167,433 A 12/1992 Ryan
5,169,018 A 12/1992 Fiore
D333,775 S 3/1993 Krape
D334,870 S 4/1993 Griffin
D335,030 S 4/1993 Alfonso
5,205,413 A 4/1993 Cautereels et al.
5,213,381 A 5/1993 Anderson
5,216,905 A 6/1993 Sersch et al.
5,235,830 A 8/1993 Benge
D340,167 S 10/1993 Kahl
D342,609 S 12/1993 Brightbill
5,269,157 A 12/1993 Ciminelli et al.
5,282,706 A 2/1994 Anthony et al.
5,295,369 A 3/1994 Garcia
D347,114 S 5/1994 Tengvall
5,313,817 A 5/1994 Meinders
D347,971 S 6/1994 Krugman

(56) References Cited

U.S. PATENT DOCUMENTS 5,319,937 A 6/1994 Fritsch et al.
5,322,178 A 6/1994 Foos
5,335,451 A 8/1994 Druzynski
D351,533 S 10/1994 Lynam, Jr.
D351,726 S 10/1994 Lin
5,353,946 A 10/1994 Behrend
5,358,082 A 10/1994 Armstrong, IV
D353,265 S 12/1994 Newby, Sr.
5,373,708 A 12/1994 Dumoulin, Jr.
D355,568 S 2/1995 Paulin et al.
5,390,811 A 2/1995 Ogino et al.
5,398,807 A 3/1995 Plath
5,402,557 A 4/1995 Dalen
D358,765 S 5/1995 Dickinson et al.
5,419,432 A 5/1995 Ingram
5,423,644 A 6/1995 First, Sr.
5,427,308 A 6/1995 Swift et al.
D359,836 S 7/1995 Shuler
5,431,263 A 7/1995 Nordstrom
5,435,256 A 7/1995 Svehaug
D361,664 S 8/1995 Brown
D361,888 S 9/1995 Kahl et al.
5,454,477 A 10/1995 Bornhorst et al.
D364,426 S 11/1995 Bucaccio
5,465,985 A 11/1995 Devan et al.
5,474,162 A 12/1995 Shyr et al.
5,478,097 A 12/1995 Forma
D367,360 S 2/1996 Wolff
D368,161 S 3/1996 Miller
D369,342 S 4/1996 Williams
D369,695 S 5/1996 Imotani
5,518,139 A 5/1996 Trower et al.
5,519,919 A 5/1996 Lee
D370,619 S 6/1996 Hall et al.
D371,051 S 6/1996 Melk
D371,052 S 6/1996 Melk
5,524,737 A 6/1996 Wang
5,526,953 A 6/1996 Chieng
D371,724 S 7/1996 Melk
D371,942 S 7/1996 Lippincott et al.
5,533,231 A 7/1996 Bai
D373,514 S 9/1996 Melk
D373,515 S 9/1996 Melk
5,564,805 A 10/1996 Dickinson
5,568,848 A 10/1996 Liang
5,570,915 A 11/1996 Asadurian
5,575,362 A 11/1996 Franklin et al.
5,590,891 A 1/1997 Kazmark, Jr.
5,603,545 A 2/1997 Benson et al.
5,620,212 A 4/1997 Bourne et al.
5,620,213 A 4/1997 Ellis
5,626,373 A 5/1997 Chambers et al.
5,630,630 A 5/1997 Price et al.
D380,369 S 7/1997 Antonucci
D381,512 S 7/1997 Green
D381,562 S 7/1997 Westcott
D381,871 S 8/1997 Melk
D382,114 S 8/1997 Dickinson et al.
D383,306 S 9/1997 Pennoyer
D383,603 S 9/1997 Pedlar
5,662,223 A 9/1997 Sylegård
5,683,097 A 11/1997 Fenton et al.
5,688,001 A 11/1997 Klein et al.
D387,249 S 12/1997 Mogil
D387,558 S 12/1997 Mann et al.
D387,626 S 12/1997 Melk
5,704,158 A 1/1998 Whiteaker
5,718,350 A 2/1998 Williams
D392,510 S 3/1998 Perez
5,727,844 A 3/1998 O'Quinn et al.
5,732,987 A 3/1998 Wright et al.
5,755,311 A 5/1998 Younessian et al.
5,762,242 A 6/1998 Yost
5,762,411 A 6/1998 Yemini
5,769,194 A 6/1998 Chang
5,797,488 A 8/1998 Yemini
5,803,472 A 9/1998 Lien
5,813,503 A 9/1998 Chang
5,816,185 A 10/1998 Ruthrford
5,826,718 A 10/1998 Ahem, Jr. et al.
5,826,770 A 10/1998 Chuang
5,839,553 A 11/1998 Dorsam
5,860,281 A 1/1999 Coffee et al.
5,865,281 A 2/1999 Wang
5,875,948 A 3/1999 Sadler
5,887,745 A 3/1999 Wood
5,896,962 A 4/1999 Smith et al.
5,901,571 A 5/1999 Whaley
5,904,269 A 5/1999 Wolff
D410,387 S 6/1999 Jacques
5,924,303 A 7/1999 Hodosh
5,933,929 A 8/1999 Kawakami et al.
5,934,716 A 8/1999 Koveal et al.
5,940,940 A 8/1999 Tanikoshi et al.
5,950,368 A 9/1999 Bradford
5,956,805 A 9/1999 Huang
5,957,321 A 9/1999 Jones
D414,673 S 10/1999 Dickinson et al.
5,971,218 A 10/1999 Le
5,975,334 A 11/1999 Mayo
5,984,064 A 11/1999 Byington
5,984,326 A 11/1999 Abraham et al.
5,984,382 A 11/1999 Bourne et al.
5,988,658 A 11/1999 Ritchie et al.
6,015,072 A 1/2000 Young
D419,767 S 2/2000 Richardson et al.
D419,768 S 2/2000 Richardson et al.
D420,221 S 2/2000 Williams et al.
6,039,205 A 3/2000 Flink
6,047,976 A 4/2000 Wang
6,050,373 A 4/2000 Wonka et al.
D425,301 S 5/2000 Sagol
6,079,083 A 6/2000 Akashi
6,079,754 A 6/2000 Alexy
D427,767 S 7/2000 Young
D427,882 S 7/2000 Wytcherley et al.
D428,254 S 7/2000 Alexander-Katz
D428,698 S 8/2000 Cheng
6,105,767 A 8/2000 Vasudeva
6,129,231 A 10/2000 Hsiao et al.
6,135,253 A 10/2000 Weissman et al.
6,152,501 A 11/2000 Magi et al.
D435,780 S 1/2001 Tieu
6,167,994 B1 1/2001 Kuo et al.
6,170,122 B1 1/2001 Kuo
6,176,499 B1 1/2001 Conrado et al.
6,176,559 B1 1/2001 Tiramani et al.
6,179,176 B1 1/2001 Saggese et al.
D440,118 S 4/2001 Claffy et al.
D441,954 S 5/2001 Parker
6,224,258 B1 5/2001 Dodson
6,234,287 B1 5/2001 Pfeiffer
6,244,064 B1 6/2001 Powell et al.
6,244,066 B1 6/2001 LaRose
6,244,458 B1 6/2001 Frysinger et al.
6,247,203 B1 6/2001 Kuo
6,247,328 B1 6/2001 Mogil
6,260,240 B1 7/2001 Akashi et al.
6,279,971 B1 8/2001 Dessenberger, Jr.
6,289,554 B1 9/2001 Wang
6,289,684 B1 9/2001 Guidry, II et al.
D449,163 S 10/2001 Dahlen et al.
6,305,185 B1 10/2001 Sloan
D451,278 S 12/2001 Cooper
6,343,815 B1 2/2002 Poe
D454,292 S 3/2002 Plummer et al.
6,353,978 B1 3/2002 Kawahara et al.
6,357,080 B1 3/2002 Tsai
6,360,400 B1 3/2002 Chang
6,363,739 B1 4/2002 Hodosh et al.
6,367,602 B1 4/2002 Chang
6,371,320 B2 4/2002 Sagol
6,371,346 B1 4/2002 Sharma
6,375,237 B1 4/2002 Koenig

(56) References Cited

U.S. PATENT DOCUMENTS

D457,724 S 5/2002 Och
D457,725 S 5/2002 Parsons
6,389,645 B1 5/2002 Polidoro
6,398,272 B1 6/2002 Plummer et al.
6,401,308 B1 6/2002 Kawahara
6,422,386 B1 7/2002 Wiese et al.
6,427,475 B1 8/2002 DeFelice et al.
6,427,501 B2 8/2002 Ramsauer
D462,519 S 9/2002 Gaydos et al.
6,446,382 B1 9/2002 Cloutier et al.
6,446,988 B1 9/2002 Kho
D464,196 S 10/2002 Parker
D464,485 S 10/2002 Sward et al.
6,467,779 B1 10/2002 Mills
6,478,463 B2 11/2002 Snider
6,481,239 B2 11/2002 Hodosh et al.
D466,439 S 12/2002 Wagner et al.
D467,424 S 12/2002 Hardigg et al.
D467,425 S 12/2002 Hardigg et al.
D467,426 S 12/2002 Hardigg et al.
6,497,311 B2 12/2002 Tiramani et al.
6,497,438 B1 12/2002 Holub et al.
6,499,574 B1 12/2002 Anthony
6,502,677 B1 1/2003 Tiramani et al.
6,508,389 B1 1/2003 Ripoyla et al.
6,520,514 B2 2/2003 Clegg
D471,711 S 3/2003 Addison
6,527,309 B1 3/2003 Gaydos et al.
6,532,624 B1 3/2003 Yang
D472,431 S 4/2003 Spence, Jr.
6,543,096 B2 4/2003 Settelmayer et al.
6,547,218 B2 4/2003 Landy
6,547,289 B1 4/2003 Greenheck et al.
6,550,592 B1 4/2003 Godshaw et al.
6,554,327 B1 4/2003 Riley
D474,649 S 5/2003 Spence, Jr.
6,574,983 B2 6/2003 Smith et al.
6,585,090 B2 7/2003 Harvey
D477,916 S 8/2003 Nykoluk
D478,782 S 8/2003 Li
6,612,411 B2 9/2003 Nykoluk et al.
6,619,448 B1 9/2003 Wang
D481,293 S 10/2003 Ayrest
6,637,077 B2 10/2003 Doty
6,637,562 B2 10/2003 Oh
D482,593 S 11/2003 Wolf
6,640,397 B1 11/2003 Gipson
6,646,864 B2 11/2003 Richardson
D484,004 S 12/2003 Lee
6,658,903 B1 12/2003 McShane et al.
6,679,358 B2 1/2004 Be
6,679,359 B2 1/2004 Pfeiffer
6,691,451 B1 2/2004 Keenan
D487,348 S 3/2004 Fenton et al.
6,698,608 B2 3/2004 Parker et al.
6,718,559 B1 4/2004 Davidson
D489,531 S 5/2004 Oh
D489,595 S 5/2004 Gleichauf et al.
6,736,265 B2 5/2004 Kipper et al.
D490,980 S 6/2004 Concari
D491,797 S 6/2004 Eriksson
D492,184 S 6/2004 Parker et al.
6,755,448 B2 6/2004 Jackson et al.
D493,286 S 7/2004 Concari
6,757,942 B2 7/2004 Matsui et al.
6,761,366 B1 7/2004 Klemmensen et al.
6,779,681 B2 8/2004 Doerfler et al.
6,789,692 B2 9/2004 Prezelin
6,793,096 B1 9/2004 Seok
D497,480 S 10/2004 Drew et al.
D498,053 S 11/2004 Nordstrom et al.
D498,054 S 11/2004 Moon
6,821,019 B2 11/2004 Mogil
D500,598 S 1/2005 Ramos
6,877,189 B2 4/2005 Simonson et al.
6,883,208 B1 4/2005 Huang
D505,011 S 5/2005 Einav
6,895,789 B2 5/2005 Masseth, Jr. et al.
D508,376 S 8/2005 Bhavnani
6,929,145 B2 8/2005 Shepler
6,955,381 B2 10/2005 Parker et al.
6,981,780 B2 1/2006 Einav
6,983,946 B2 1/2006 Sullivan et al.
D515,362 S 2/2006 Chan
D517,947 S 3/2006 Hollingworth et al.
7,017,740 B2 3/2006 Itzkovitch
7,028,730 B2 4/2006 Pace et al.
D520,237 S 5/2006 Cheng
7,040,115 B1 5/2006 Lopez et al.
D522,751 S 6/2006 Irwin et al.
D522,811 S 6/2006 Martinez et al.
D523,242 S 6/2006 Hardigg et al.
7,066,311 B2 6/2006 O'Shea
D525,714 S 7/2006 Ueda
7,082,641 B1 8/2006 Jung et al.
7,093,699 B2 8/2006 Yu
D528,800 S 9/2006 Liu et al.
D530,095 S 10/2006 Herzberg
7,162,890 B2 1/2007 Mogil et al.
D537,251 S 2/2007 Musgrove
7,171,731 B1 2/2007 Borcherding
D539,543 S 4/2007 Wu
D540,540 S 4/2007 Szyf et al.
D540,651 S 4/2007 Wolf, V
D540,652 S 4/2007 Wolf, V
D544,211 S 6/2007 Herzberg
7,237,660 B2 7/2007 Wu
7,246,704 B2 7/2007 Brunson et al.
7,246,718 B2 7/2007 Einav et al.
D552,352 S 10/2007 Lin
7,284,393 B1 10/2007 Macmillan
7,284,763 B1 10/2007 King
D555,902 S 11/2007 Pendergraph et al.
7,296,434 B2 11/2007 Scroggs
7,306,243 B2 12/2007 Van Horn et al.
7,309,106 B2 12/2007 Stallman
D562,646 S 2/2008 Lown et al.
7,334,680 B2 2/2008 Cunningham et al.
7,334,802 B2 2/2008 Kaplan
D563,101 S 3/2008 Kuchler
7,344,028 B2 3/2008 Hanson
D566,479 S 4/2008 Kabalin
7,367,451 B2 5/2008 Pendergraph et al.
7,370,891 B1 5/2008 Schmitt et al.
D570,601 S 6/2008 Drew et al.
D570,603 S 6/2008 Wu et al.
7,387,350 B2 6/2008 Killinger et al.
D572,577 S 7/2008 Hatton
7,397,674 B2 7/2008 Schlack
D574,150 S 8/2008 Ross
D574,667 S 8/2008 Grabijas, III et al.
D575,059 S 8/2008 Cappiello et al.
7,415,794 B1 8/2008 Thompson
7,418,311 B1 8/2008 Lagassey et al.
D578,758 S 10/2008 Stevens et al.
D579,202 S 10/2008 Grenier et al.
7,434,410 B2 10/2008 Ford
7,441,641 B2 10/2008 Beakey
D581,161 S 11/2008 Tong
D582,678 S 12/2008 Rekuc et al.
7,458,481 B2 12/2008 Yuen
7,461,871 B2 12/2008 Vauchel
7,475,782 B2 1/2009 Lombardi
D587,902 S 3/2009 Yoneno
7,503,439 B2 3/2009 O'Shea et al.
D590,694 S 4/2009 Stuckey
7,516,520 B2 4/2009 Kelaher et al.
7,516,842 B2 4/2009 Gu
D591,511 S 5/2009 Wu
7,530,405 B2 5/2009 Kollath et al.
7,533,782 B2 5/2009 Parker et al.
7,540,364 B2 6/2009 Sanderson
7,549,652 B2 6/2009 Wu
D596,400 S 7/2009 Chu et al.

(56) References Cited

U.S. PATENT DOCUMENTS

| | | | |
|---|---|---|---|
| D597,652 | S | 8/2009 | Tang |
| 7,568,739 | B2 | 8/2009 | Lee |
| 7,571,915 | B1 | 8/2009 | Simmons |
| D600,912 | S | 9/2009 | Brunner |
| 7,581,656 | B2 | 9/2009 | Gnepper et al. |
| D601,801 | S | 10/2009 | Perez |
| D602,252 | S | 10/2009 | Ehret |
| 7,604,290 | B1 | 10/2009 | Giordano |
| 7,607,540 | B2 | 10/2009 | Ballard |
| D603,165 | S | 11/2009 | Losiewicz |
| D605,896 | S | 12/2009 | Zalewski et al. |
| D607,697 | S | 1/2010 | Whitlock et al. |
| D608,159 | S | 1/2010 | Whitlock et al. |
| D608,601 | S | 1/2010 | Whitlock et al. |
| D610,349 | S | 2/2010 | Ehret |
| 7,658,269 | B2 | 2/2010 | Wu |
| 7,669,436 | B2 | 3/2010 | Mogil et al. |
| 7,688,584 | B1 | 3/2010 | Becklin |
| D613,560 | S | 4/2010 | Robichaud et al. |
| D614,404 | S | 4/2010 | Brunner |
| 7,703,588 | B2 | 4/2010 | Chiang |
| 7,722,204 | B1 | 5/2010 | Sandberg |
| D617,561 | S | 6/2010 | Salerno-Tortora |
| 7,735,261 | B2 | 6/2010 | Sellati |
| D618,966 | S | 7/2010 | Koehler et al. |
| D619,423 | S | 7/2010 | Koehler et al. |
| D619,854 | S | 7/2010 | Koehler et al. |
| D619,855 | S | 7/2010 | Koehler et al. |
| 7,748,232 | B2 | 7/2010 | Kang |
| D624,315 | S | 9/2010 | Amatrudo |
| 7,806,287 | B2 | 10/2010 | Rouns |
| D626,451 | S | 11/2010 | Helwig et al. |
| D627,162 | S | 11/2010 | Weng |
| D627,199 | S | 11/2010 | Pruchnicki |
| 7,841,207 | B2 | 11/2010 | Mogil et al. |
| D629,200 | S | 12/2010 | Turella-Yuan et al. |
| 7,854,321 | B2 | 12/2010 | Twig et al. |
| D630,435 | S | 1/2011 | Brunner |
| D630,851 | S | 1/2011 | Landau et al. |
| 7,861,552 | B1 | 1/2011 | Hughes |
| 7,861,834 | B2 | 1/2011 | Gorga et al. |
| 7,874,047 | B2 | 1/2011 | Breeden |
| 7,874,408 | B2 | 1/2011 | Suppancig |
| D633,300 | S | 3/2011 | Fair |
| D634,545 | S | 3/2011 | Fair |
| 7,909,148 | B1 | 3/2011 | Miller et al. |
| D635,366 | S | 4/2011 | Luburic |
| D636,292 | S | 4/2011 | Brown |
| 7,922,052 | B2 | 4/2011 | Podschus |
| D637,811 | S | 5/2011 | Hong |
| 7,937,884 | B1 | 5/2011 | Naylor et al. |
| 7,959,194 | B2 | 6/2011 | Mahoney |
| D640,869 | S | 7/2011 | Katz et al. |
| D642,379 | S | 8/2011 | Buller |
| D643,624 | S | 8/2011 | Hong |
| D643,629 | S | 8/2011 | Sofy et al. |
| 7,997,591 | B2 | 8/2011 | Arthur |
| D644,434 | S | 9/2011 | Miles et al. |
| D644,435 | S | 9/2011 | Weng |
| 8,016,153 | B2 | 9/2011 | Boenig et al. |
| D646,528 | S | 10/2011 | Stallman et al. |
| 8,037,983 | B2 | 10/2011 | Leung |
| D648,538 | S | 11/2011 | Reinhart et al. |
| D649,786 | S | 12/2011 | Lipfert et al. |
| D650,585 | S | 12/2011 | Jamison et al. |
| D651,860 | S | 1/2012 | Nie |
| D652,216 | S | 1/2012 | Fair |
| 8,091,731 | B2 | 1/2012 | Kidd et al. |
| 8,096,152 | B2 | 1/2012 | Wagh et al. |
| 8,096,442 | B2 | 1/2012 | Ramundi |
| 8,099,836 | B2 | 1/2012 | Breeden et al. |
| D654,694 | S | 2/2012 | Wu |
| 8,141,211 | B2 | 3/2012 | Weyer et al. |
| D659,395 | S | 5/2012 | Sijmons |
| D660,000 | S | 5/2012 | Peterson et al. |
| 8,167,166 | B2 | 5/2012 | Kidd et al. |
| 8,176,749 | B2 | 5/2012 | LaMere et al. |
| 8,191,747 | B2 | 6/2012 | Pruchnicki |
| 8,210,353 | B2 | 7/2012 | Epicureo |
| 8,214,972 | B2 | 7/2012 | Lai |
| D664,891 | S | 8/2012 | Takeda |
| D665,166 | S | 8/2012 | Khalifa et al. |
| D666,002 | S | 8/2012 | Lai |
| 8,245,868 | B2 | 8/2012 | Ikeda et al. |
| 8,251,113 | B2 | 8/2012 | Baxter |
| 8,251,245 | B2 | 8/2012 | DiPietro et al. |
| D666,831 | S | 9/2012 | Kinskey et al. |
| D666,832 | S | 9/2012 | Kinskey et al. |
| D667,697 | S | 9/2012 | Shah |
| 8,256,156 | B1 | 9/2012 | Burgoyne, Jr. |
| 8,263,257 | B2 * | 9/2012 | Bielawski ..... H01M 50/20 429/187 |
| D668,049 | S | 10/2012 | Buller |
| 8,286,828 | B2 | 10/2012 | Schafer |
| 8,287,009 | B2 | 10/2012 | Dane et al. |
| 8,292,119 | B2 | 10/2012 | Kenneally |
| 8,297,464 | B2 | 10/2012 | Grenier et al. |
| D670,502 | S | 11/2012 | Wu |
| D673,024 | S | 12/2012 | Caffin et al. |
| 8,328,247 | B2 | 12/2012 | Tonelli |
| 8,336,708 | B2 | 12/2012 | Potterfield et al. |
| D674,192 | S | 1/2013 | Li |
| 8,342,580 | B2 | 1/2013 | Cowie et al. |
| 8,378,323 | B1 | 2/2013 | Spann et al. |
| 8,382,171 | B2 | 2/2013 | Williams |
| D677,896 | S | 3/2013 | Wu |
| D678,749 | S | 3/2013 | Tung |
| D678,750 | S | 3/2013 | Tung |
| 8,424,930 | B2 | 4/2013 | Matsubara et al. |
| 8,430,284 | B2 | 4/2013 | Broadbent et al. |
| D681,337 | S | 5/2013 | Wu |
| 8,459,058 | B2 | 6/2013 | Mogil |
| 8,459,422 | B1 | 6/2013 | Efron |
| 8,459,487 | B2 | 6/2013 | Sharma et al. |
| 8,459,495 | B2 | 6/2013 | Koenig et al. |
| D685,186 | S | 7/2013 | Massaud |
| 8,474,098 | B1 | 7/2013 | Yang |
| 8,484,813 | B2 | 7/2013 | Taniguchi et al. |
| 8,490,413 | B2 | 7/2013 | Blackway et al. |
| 8,496,133 | B2 | 7/2013 | Mizukoshi et al. |
| D688,589 | S | 8/2013 | Hung et al. |
| 8,505,729 | B2 | 8/2013 | Sosnovsky et al. |
| 8,517,211 | B2 | 8/2013 | Brown et al. |
| D688,920 | S | 9/2013 | Manley et al. |
| D690,939 | S | 10/2013 | Lintz et al. |
| D691,808 | S | 10/2013 | Wu |
| 8,544,648 | B2 | 10/2013 | Cleveland et al. |
| 8,561,264 | B2 | 10/2013 | Hasegawa et al. |
| 8,561,269 | B2 | 10/2013 | LeCompte et al. |
| 8,567,631 | B2 | 10/2013 | Brunner |
| 8,567,796 | B2 | 10/2013 | Bar-Erez et al. |
| 8,572,821 | B2 | 11/2013 | Hasegawa |
| 8,573,399 | B2 | 11/2013 | Ulmer et al. |
| 8,590,704 | B2 | 11/2013 | Koenig et al. |
| 8,590,724 | B2 | 11/2013 | Kreidler et al. |
| 8,596,485 | B2 | 12/2013 | Lindsay |
| 8,596,487 | B1 | 12/2013 | Su |
| 8,601,838 | B2 | 12/2013 | Hansen et al. |
| 8,616,600 | B2 | 12/2013 | Owen |
| D697,717 | S | 1/2014 | Santy |
| 8,622,235 | B2 | 1/2014 | Suchecki |
| 8,627,972 | B2 | 1/2014 | Thomas |
| D699,100 | S | 2/2014 | Moreau et al. |
| D699,438 | S | 2/2014 | Mathieu et al. |
| 8,640,937 | B2 | 2/2014 | Pruchnicki |
| 8,677,661 | B2 | 3/2014 | Michels et al. |
| 8,678,227 | B2 | 3/2014 | Patstone |
| D701,697 | S | 4/2014 | Sabbag et al. |
| D703,435 | S | 4/2014 | Wile et al. |
| 8,683,660 | B2 | 4/2014 | Hasegawa et al. |
| 8,689,396 | B2 | 4/2014 | Wolfe et al. |
| D704,935 | S | 5/2014 | Lintz et al. |
| 8,714,568 | B2 | 5/2014 | Allam et al. |
| 8,740,010 | B1 | 6/2014 | Page |

(56) References Cited

U.S. PATENT DOCUMENTS 8,757,642 B2 6/2014 Arthur et al.
8,757,643 B2 6/2014 Arthur et al.
8,757,696 B2 6/2014 Schneider
D709,336 S 7/2014 Liebenthal
D709,696 S 7/2014 Wu
8,763,848 B2 7/2014 Carey
8,763,851 B2 7/2014 Jiang et al.
8,770,426 B2 7/2014 Arnett et al.
8,777,045 B2 7/2014 Mitchell et al.
D710,099 S 8/2014 Horovitz et al.
D710,610 S 8/2014 Sijmons et al.
D710,614 S 8/2014 Meersschaert
D711,104 S 8/2014 Lai
D711,646 S 8/2014 Ke
D711,647 S 8/2014 Chen
D711,648 S 8/2014 Chen
D711,649 S 8/2014 Chen
D712,143 S 9/2014 Chehebar
D714,056 S 9/2014 Weng
D714,057 S 9/2014 Hou
D714,064 S 9/2014 Kim
8,844,749 B2 9/2014 Manahan et al.
8,844,950 B2 9/2014 Greene et al.
8,850,666 B2 10/2014 Hasegawa et al.
8,851,282 B2 10/2014 Brunner
8,851,289 B2 10/2014 Shi
8,857,654 B2 10/2014 Mogil et al.
8,863,975 B2 10/2014 McCanless
8,864,185 B2 10/2014 Do
8,864,189 B2 10/2014 Fournie et al.
D717,152 S 11/2014 Weinerman et al.
D718,051 S 11/2014 Frahm et al.
8,875,877 B2 11/2014 Cottle et al.
8,875,888 B2 11/2014 Koenig et al.
8,875,934 B2 11/2014 Deka
8,881,930 B2 11/2014 Banik
8,887,515 B2 11/2014 Patstone
D718,936 S 12/2014 Sanz et al.
D719,351 S 12/2014 Hailwood
8,905,412 B2 12/2014 Fux
8,910,788 B2 12/2014 Roach et al.
8,910,819 B2 12/2014 Seiders
8,919,596 B2 12/2014 Carino
D720,536 S 1/2015 Hsu
D720,599 S 1/2015 Weinerman et al.
D720,928 S 1/2015 Roncato
8,925,752 B2 1/2015 Smith
D722,771 S 2/2015 Wu
D722,860 S 2/2015 Linares
8,944,476 B1 2/2015 Henderson
8,960,430 B2 2/2015 Roach et al.
8,960,735 B2 2/2015 Michael et al.
D723,806 S 3/2015 Salmon
D724,323 S 3/2015 Wang
8,979,100 B2 3/2015 Bensman et al.
8,979,101 B2 3/2015 Primiano
8,979,144 B2 3/2015 Paugh et al.
8,985,326 B2 3/2015 Halsne et al.
8,985,385 B2 3/2015 Parker et al.
D725,907 S 4/2015 Yu
D727,620 S 4/2015 Tonelli
9,004,274 B2 4/2015 Thornberg
9,004,548 B2 4/2015 Joret et al.
D728,933 S 5/2015 Sanz et al.
D730,050 S 5/2015 Hogan et al.
9,027,751 B2 5/2015 Lee
D730,716 S 6/2015 Weinerman et al.
D731,250 S 6/2015 Butler et al.
D732,348 S 6/2015 Seiders et al.
D732,349 S 6/2015 Seiders et al.
D732,350 S 6/2015 Seiders et al.
D732,823 S 6/2015 Baron
D732,899 S 6/2015 Seiders et al.
D732,923 S 6/2015 Rechberg et al.
9,045,264 B2 6/2015 Pils
9,060,577 B2 6/2015 Farrelly et al.
9,067,081 B2 6/2015 Roach et al.
D734,742 S 7/2015 Fujioka
9,079,595 B2 7/2015 Chen et al.
9,085,403 B2 7/2015 Roach et al.
9,101,186 B2 8/2015 Lai
9,108,772 B2 8/2015 Hovatter
9,113,686 B1 8/2015 Bishop
9,114,909 B2 8/2015 Wagner
D738,702 S 9/2015 Linares
9,139,352 B2 9/2015 Seiders et al.
D740,557 S 10/2015 Liao
D740,558 S 10/2015 Liao
D741,064 S 10/2015 Ramos
D741,600 S 10/2015 Della Vecchia
9,163,871 B1 10/2015 Costello
9,169,678 B2 10/2015 Rozema
D743,171 S 11/2015 Reinhart
9,187,210 B2 11/2015 Zhu et al.
9,193,060 B2 11/2015 Ben-Gigi
D744,750 S 12/2015 Sabbag et al.
9,198,492 B2 12/2015 Chehebar
9,199,370 B2 12/2015 Crull
9,199,657 B2 12/2015 Martin
9,204,699 B2 12/2015 Pickens et al.
9,205,551 B2 12/2015 Green et al.
9,211,040 B2 12/2015 Lane
9,215,918 B2 12/2015 Kao et al.
D747,639 S 1/2016 Linares
D747,950 S 1/2016 Jacobsen et al.
D747,951 S 1/2016 Jacobsen et al.
9,233,465 B2 1/2016 Lai
D748,452 S 2/2016 Jacobsen et al.
9,248,566 B2 2/2016 Horiyama et al.
9,254,901 B2 2/2016 Gill
9,259,090 B1 2/2016 Cronin
9,259,593 B2 2/2016 Roach et al.
9,259,828 B2 2/2016 Bermes
9,266,462 B2 2/2016 Miller
D750,953 S 3/2016 Jacobsen et al.
D752,344 S 3/2016 Green
9,272,820 B2 3/2016 Cowie
9,278,704 B2 3/2016 Cates
9,290,297 B2 3/2016 Overath
D752,862 S 4/2016 Riddiford et al.
9,307,840 B2 4/2016 Restrepo et al.
9,322,192 B2 4/2016 Burd
D755,518 S 5/2016 Sijmons
9,327,887 B2 5/2016 Farentinos et al.
9,340,224 B2 5/2016 Yoder et al.
9,341,003 B2 5/2016 Ely et al.
9,341,403 B2 5/2016 Conrad et al.
9,346,616 B2 5/2016 Foster
9,351,550 B2 5/2016 Arthur et al.
D759,971 S 6/2016 Riddiford et al.
9,359,798 B2 6/2016 Greenwood et al.
9,376,050 B1 6/2016 Gill
9,387,963 B2 7/2016 McBroom et al.
9,393,684 B2 7/2016 Christopher et al.
D762,471 S 8/2016 Green et al.
D762,977 S 8/2016 Xu
9,408,449 B1 8/2016 Tsai
9,415,787 B2 8/2016 Mericle
9,427,058 B2 8/2016 Boglione
D765,397 S 9/2016 Reinhart
D765,406 S 9/2016 Faibish
D765,407 S 9/2016 Reinhart
D765,408 S 9/2016 Reinhart
D765,409 S 9/2016 Reinhart
D765,410 S 9/2016 Reinhart
D765,411 S 9/2016 Reinhart
D765,973 S 9/2016 Tonelli et al.
D767,277 S 9/2016 Faibish
9,435,578 B2 9/2016 Calderon et al.
9,443,366 B2 9/2016 Rayner
D768,464 S 10/2016 Hatton
D768,985 S 10/2016 Morszeck
9,468,277 B2 10/2016 King
D770,179 S 11/2016 Menirom

(56) References Cited

U.S. PATENT DOCUMENTS

| | | | |
|---|---|---|---|
| D771,381 | S | 11/2016 | Sosnovsky et al. |
| D772,577 | S | 11/2016 | Muchin et al. |
| D773,821 | S | 12/2016 | Reinhart |
| D773,901 | S | 12/2016 | Marret |
| 9,511,491 | B2 | 12/2016 | Brunner |
| D776,429 | S | 1/2017 | Zagorski et al. |
| D776,932 | S | 1/2017 | Reinhart |
| D776,934 | S | 1/2017 | Braendle |
| D777,441 | S | 1/2017 | Li |
| D777,530 | S | 1/2017 | Marret |
| D778,054 | S | 2/2017 | Li |
| D778,707 | S | 2/2017 | Tonelli |
| D779,201 | S | 2/2017 | Beilman et al. |
| 9,566,704 | B1 | 2/2017 | Stoikos et al. |
| 9,567,784 | B2 | 2/2017 | Defrance et al. |
| D780,523 | S | 3/2017 | Jacobsen |
| D780,524 | S | 3/2017 | Jacobsen |
| D780,525 | S | 3/2017 | Jacobsen |
| D784,017 | S | 4/2017 | Hsieh |
| 9,622,547 | B2 | 4/2017 | Seader |
| D785,937 | S | 5/2017 | Morszeck |
| D786,561 | S | 5/2017 | Seiders et al. |
| 9,637,294 | B2 | 5/2017 | Kinskey |
| 9,655,418 | B2 | 5/2017 | Chien et al. |
| D788,460 | S | 6/2017 | Morszeck |
| D788,461 | S | 6/2017 | Tonelli |
| D789,690 | S | 6/2017 | Foley et al. |
| D789,766 | S | 6/2017 | Todd, Jr. et al. |
| 9,669,986 | B1 | 6/2017 | Evans |
| D791,477 | S | 7/2017 | Liu |
| D792,094 | S | 7/2017 | Stoikos et al. |
| D792,105 | S | 7/2017 | Reinhart |
| D792,708 | S | 7/2017 | Tazawa |
| D793,089 | S | 8/2017 | Jackson |
| D796,199 | S | 9/2017 | Law |
| D796,838 | S | 9/2017 | Sijmons et al. |
| D797,518 | S | 9/2017 | Pavia, III |
| 9,770,084 | B1 | 9/2017 | Shiekh |
| D802,924 | S | 11/2017 | Mahanavanont |
| 9,809,376 | B2 | 11/2017 | Mitchell et al. |
| D804,174 | S | 12/2017 | Morszeck |
| D804,818 | S | 12/2017 | It |
| D804,819 | S | 12/2017 | Faibish et al. |
| D805,772 | S | 12/2017 | Oshima |
| D805,851 | S | 12/2017 | Sullivan et al. |
| 9,839,272 | B2 | 12/2017 | Licciardino |
| 9,848,681 | B1 | 12/2017 | Chen |
| 9,849,901 | B2 | 12/2017 | Jackman |
| D806,483 | S | 1/2018 | Stanford et al. |
| D807,123 | S | 1/2018 | Carey et al. |
| D807,124 | S | 1/2018 | Carey et al. |
| D808,164 | S | 1/2018 | Summers |
| D808,653 | S | 1/2018 | Rayeski et al. |
| D808,655 | S | 1/2018 | Seiders et al. |
| D808,730 | S | 1/2018 | Sullivan et al. |
| 9,878,841 | B2 | 1/2018 | Holderness et al. |
| D809,293 | S | 2/2018 | Virassamy et al. |
| D809,295 | S | 2/2018 | Ehret |
| D810,432 | S | 2/2018 | Ballou et al. |
| D810,433 | S | 2/2018 | Ballou et al. |
| D810,434 | S | 2/2018 | Xu |
| D811,084 | S | 2/2018 | Ballou et al. |
| D811,090 | S | 2/2018 | Karl |
| 9,883,724 | B2 | 2/2018 | Woode |
| 9,894,971 | B2 | 2/2018 | Scicluna et al. |
| 9,901,153 | B2 | 2/2018 | Nash |
| D811,742 | S | 3/2018 | Ballou et al. |
| D811,744 | S | 3/2018 | Ballou et al. |
| D812,909 | S | 3/2018 | Morszeck |
| 9,913,518 | B2 | 3/2018 | Su |
| D814,187 | S | 4/2018 | Caglar |
| D815,787 | S | 4/2018 | Seiders et al. |
| D815,831 | S | 4/2018 | Tonelli |
| D815,919 | S | 4/2018 | DeFrancia |
| D816,337 | S | 5/2018 | Cheng |
| D816,492 | S | 5/2018 | Reinhart |
| D817,722 | S | 5/2018 | Bradley |
| D818,712 | S | 5/2018 | Fleming et al. |
| 9,968,170 | B2 | 5/2018 | Morszeck |
| D819,331 | S | 6/2018 | Ballou et al. |
| D820,049 | S | 6/2018 | Ahlstrom et al. |
| 9,999,284 | B1 | 6/2018 | Tan |
| D821,824 | S | 7/2018 | Rane et al. |
| D821,825 | S | 7/2018 | Sullivan et al. |
| D823,065 | S | 7/2018 | Eichinger et al. |
| D824,168 | S | 7/2018 | Morszeck |
| 10,028,561 | B2 | 7/2018 | Vecellio |
| D824,674 | S | 8/2018 | Seiders et al. |
| D824,731 | S | 8/2018 | Sullivan et al. |
| 10,058,151 | B2 | 8/2018 | Morszeck |
| D827,304 | S | 9/2018 | Tao |
| D828,028 | S | 9/2018 | Seiders et al. |
| D828,029 | S | 9/2018 | Seiders et al. |
| D828,108 | S | 9/2018 | Bowling |
| D828,112 | S | 9/2018 | Furneaux et al. |
| D829,244 | S | 9/2018 | Sullivan et al. |
| 10,080,412 | B2 | 9/2018 | Hartmann et al. |
| D830,132 | S | 10/2018 | Sullivan et al. |
| D830,133 | S | 10/2018 | Sullivan et al. |
| D830,134 | S | 10/2018 | Sullivan et al. |
| 10,086,745 | B2 | 10/2018 | Gill |
| 10,088,144 | B1 | 10/2018 | Sandberg |
| D832,653 | S | 11/2018 | Waskow et al. |
| 10,124,742 | B2 | 11/2018 | Martinez et al. |
| 10,138,048 | B2 | 11/2018 | Mitchell et al. |
| D834,819 | S | 12/2018 | Burek et al. |
| D835,470 | S | 12/2018 | Seiders et al. |
| D835,472 | S | 12/2018 | Seiders et al. |
| D835,473 | S | 12/2018 | Jacobsen |
| D835,946 | S | 12/2018 | Seiders et al. |
| 10,143,282 | B2 | 12/2018 | Seiders et al. |
| 10,159,312 | B2 | 12/2018 | Ito |
| 10,160,471 | B2 | 12/2018 | Yahav et al. |
| D836,993 | S | 1/2019 | Meda et al. |
| D836,996 | S | 1/2019 | Jacobsen |
| D836,997 | S | 1/2019 | Jacobsen |
| D836,998 | S | 1/2019 | Jacobsen |
| D836,999 | S | 1/2019 | Jacobsen |
| D837,001 | S | 1/2019 | Jacobsen |
| D837,515 | S | 1/2019 | Shpitzer |
| D837,611 | S | 1/2019 | Lane et al. |
| D838,208 | S | 1/2019 | Hirabayashi et al. |
| D838,983 | S | 1/2019 | Seiders et al. |
| D838,984 | S | 1/2019 | Seiders et al. |
| D839,094 | S | 1/2019 | Giraud et al. |
| D839,682 | S | 2/2019 | Jacobsen |
| D840,150 | S | 2/2019 | Seiders et al. |
| D840,194 | S | 2/2019 | Furneaux et al. |
| D842,048 | S | 3/2019 | Wells |
| D843,114 | S | 3/2019 | Sanz |
| 10,219,601 | B2 | 3/2019 | Selvi |
| D844,325 | S | 4/2019 | Nelson |
| D844,386 | S | 4/2019 | Ahlstrom et al. |
| 10,272,934 | B2 | 4/2019 | DeFrancia |
| D848,219 | S | 5/2019 | Munie et al. |
| D848,220 | S | 5/2019 | Munie et al. |
| D848,221 | S | 5/2019 | Munie et al. |
| D848,222 | S | 5/2019 | Munie et al. |
| D848,223 | S | 5/2019 | Munie et al. |
| D848,744 | S | 5/2019 | Axelbaum |
| D848,798 | S | 5/2019 | Munie et al. |
| D849,486 | S | 5/2019 | Munie et al. |
| 10,292,473 | B2 | 5/2019 | Meersschaert |
| D850,796 | S | 6/2019 | Ricca |
| D851,401 | S | 6/2019 | Zhang |
| 10,314,377 | B2 | 6/2019 | Stephens |
| D852,504 | S | 7/2019 | Ben-David |
| D853,729 | S | 7/2019 | Axelbaum |
| D854,826 | S | 7/2019 | Tonelli |
| 10,334,935 | B2 | 7/2019 | Chung |
| 10,350,746 | B2 | 7/2019 | Martinez et al. |
| 10,351,330 | B2 | 7/2019 | Smith et al. |
| 10,357,874 | B2 | 7/2019 | Engvall et al. |
| D857,386 | S | 8/2019 | Shpitzer |

(56) References Cited

U.S. PATENT DOCUMENTS 10,376,031 B1 8/2019 Majhess
10,378,569 B2 8/2019 Jensen et al.
D858,986 S 9/2019 Shalgi
D859,842 S 9/2019 Frank
D860,789 S 9/2019 Rayeski et al.
10,399,748 B2 9/2019 Reinhart
10,401,075 B2 9/2019 Bond
D861,535 S 10/2019 Venables
10,443,918 B2 10/2019 Li et al.
D869,160 S 12/2019 Seiders et al.
D869,244 S 12/2019 Ellison et al.
D869,848 S 12/2019 Wu
D871,767 S 1/2020 Harrison
D872,478 S 1/2020 Seiders et al.
D872,485 S 1/2020 Seiders et al.
D873,020 S 1/2020 Seiders et al.
D873,024 S 1/2020 Usui
D874,139 S 2/2020 Rubio et al.
D874,140 S 2/2020 Rubio et al.
D874,141 S 2/2020 Rubio et al.
10,568,395 B2 2/2020 Hayashi
10,568,400 B2 2/2020 Shechter et al.
D876,833 S 3/2020 Brunner et al.
D876,835 S 3/2020 Libman et al.
D878,054 S 3/2020 Reinhart et al.
D878,929 S 3/2020 Rubio et al.
10,595,608 B2 3/2020 Korey et al.
D881,569 S 4/2020 Rubio et al.
D881,578 S 4/2020 Prommel et al.
D882,266 S 4/2020 Prommel et al.
D882,267 S 4/2020 Prommel et al.
D887,788 S 6/2020 Meda et al.
D887,789 S 6/2020 Seiders et al.
D899,083 S 10/2020 Rubio et al.
D904,829 S 12/2020 Nichols et al.
D907,445 S 1/2021 Nichols et al.
D909,062 S 2/2021 Qian et al.
D912,983 S 3/2021 Newson
D915,069 S 4/2021 Tonelli
D925,299 S 7/2021 Nichols et al.
D925,911 S 7/2021 Sun
D927,851 S 8/2021 Chasseriaux et al.
D929,189 S 8/2021 Pennington et al.
D942,812 S 2/2022 Luo et al.
D944,299 S 2/2022 Astle et al.
D946,279 S 3/2022 Seiders et al.
2002/0024189 A1 2/2002 Chen
2002/0038745 A1 4/2002 Lamming
2002/0074332 A1 6/2002 Sagol
2002/0148694 A1 10/2002 Tong
2002/0162841 A1 11/2002 Shamir et al.
2002/0185871 A1 12/2002 Straka
2002/0195827 A1 12/2002 Jackson et al.
2003/0019705 A1 1/2003 Lau
2003/0038007 A1 2/2003 Han
2003/0038142 A1 2/2003 Gee
2003/0106821 A1 6/2003 Bar-Erez
2003/0111476 A1 6/2003 Serio
2003/0136702 A1 7/2003 Redzisz et al.
2004/0007604 A1 1/2004 Plzak
2004/0016854 A1 1/2004 Hart
2004/0025306 A1 2/2004 Coffey
2004/0040967 A1 3/2004 Eiskant et al.
2004/0163910 A1 8/2004 Lee
2004/0178208 A1 9/2004 Leba et al.
2004/0238543 A1 12/2004 Askew
2004/0246695 A1 12/2004 Schlack
2004/0262319 A1 12/2004 Fisher
2005/0023096 A1 2/2005 Tiramani
2005/0099019 A1 5/2005 Rlall et al.
2005/0103813 A1 5/2005 Edwards
2005/0139741 A1 6/2005 Yuen
2005/0150892 A1 7/2005 Miller
2005/0180835 A1 8/2005 Schneider
2005/0199628 A1 9/2005 Van Handel et al.
2005/0217071 A1 10/2005 Shinner
2005/0258610 A1 11/2005 Stone et al.
2005/0279123 A1 12/2005 Maldonado et al.
2006/0011641 A1 1/2006 Sanderson
2006/0017293 A1 1/2006 Tonelli
2006/0037178 A1 2/2006 Sulhoff
2006/0037824 A1 2/2006 Park et al.
2006/0042897 A1 3/2006 Sanderson
2006/0049640 A1 3/2006 Lee
2006/0180422 A1 8/2006 Lin
2006/0196218 A1 9/2006 Mogil et al.
2006/0213736 A1 9/2006 Godshaw
2006/0213941 A1 9/2006 Sweeney
2006/0225981 A1 10/2006 Lin
2006/0249412 A1 11/2006 Hernandez et al.
2006/0249522 A1 11/2006 Ringo
2006/0276768 A1 12/2006 Miller et al.
2007/0039957 A1 2/2007 Shulz et al.
2007/0101754 A1 5/2007 Maldonado
2007/0175898 A1 8/2007 Craft et al.
2007/0235452 A1 10/2007 Killinger et al.
2007/0261977 A1 11/2007 Sakai
2008/0001373 A1 1/2008 Vaughn
2008/0029528 A1 2/2008 Mireault
2008/0042460 A1 2/2008 Fuchs
2008/0067095 A1 3/2008 Mueller
2008/0067206 A1 3/2008 Kuhn
2008/0078637 A1 4/2008 Su
2008/0078682 A1 4/2008 Clark et al.
2008/0110892 A1 5/2008 House
2008/0116215 A1 5/2008 Chuang
2008/0128428 A1 6/2008 Beckerman
2008/0156858 A1 7/2008 Perry et al.
2008/0170388 A1 7/2008 Greil
2008/0190940 A1 8/2008 Scott
2008/0196650 A1 8/2008 Fernung
2008/0230339 A1 9/2008 Pereira
2008/0245095 A1 10/2008 Schlipman et al.
2008/0257775 A1 10/2008 Randolph
2008/0264946 A1 10/2008 Moschella et al.
2009/0009039 A1 1/2009 Mayes, Jr.
2009/0014974 A1 1/2009 VanVorst et al.
2009/0033110 A1 2/2009 Fragale
2009/0049859 A1 2/2009 Moon
2009/0078593 A1 3/2009 Patstone
2009/0080809 A1 3/2009 Pham et al.
2009/0101460 A1 4/2009 Justham et al.
2009/0114646 A1 5/2009 Whalen
2009/0114653 A1 5/2009 Schenker
2009/0120126 A1 5/2009 Mew
2009/0158770 A1 6/2009 Cohrs et al.
2009/0173744 A1 7/2009 Hassell
2009/0194541 A1 8/2009 Mayo
2009/0277905 A1 11/2009 Gillan
2010/0001013 A1 1/2010 Sommerfeld
2010/0072215 A1 3/2010 Coon
2010/0078451 A1 4/2010 Mount
2010/0108556 A1 5/2010 Claffy
2010/0133132 A1 6/2010 Allan
2010/0200784 A1 8/2010 Turner
2010/0258576 A1 10/2010 Marquez
2010/0270116 A1* 10/2010 Wilson ..... A45C 13/30
190/102
2010/0275642 A1 11/2010 Klettner
2011/0016911 A1 1/2011 Mosby
2011/0064332 A1 3/2011 Piazza et al.
2011/0114526 A1 5/2011 Neumann et al.
2011/0119986 A1 5/2011 Sellers
2011/0121002 A1 5/2011 Stiller
2011/0127264 A1 6/2011 Analen
2011/0132046 A1 6/2011 Tonelli
2011/0181008 A1 7/2011 Bensman et al.
2011/0182532 A1 7/2011 Baltus
2011/0186396 A1 8/2011 Sheikh
2011/0186398 A1 8/2011 Sheikh
2011/0197625 A1 8/2011 Urban et al.
2011/0203328 A1 8/2011 Vilkomirski et al.
2011/0220531 A1 9/2011 Meether et al.
2011/0226003 A1 9/2011 Chaney et al.

(56) References Cited

U.S. PATENT DOCUMENTS

| | | | |
|---|---|---|---|
| 2011/0226785 | A1 | 9/2011 | Sakell |
| 2012/0024896 | A1 | 2/2012 | Scobey et al. |
| 2012/0103740 | A1 | 5/2012 | Moussatche et al. |
| 2012/0104012 | A1 | 5/2012 | Cowie et al. |
| 2012/0168444 | A1 | 7/2012 | Shitrit et al. |
| 2012/0193353 | A1 | 8/2012 | Cronin et al. |
| 2012/0267208 | A1 | 10/2012 | D'Angelo |
| 2012/0273506 | A1 | 11/2012 | Adams et al. |
| 2012/0286489 | A1 | 11/2012 | Bartholomew |
| 2012/0312708 | A1 | 12/2012 | Roehm et al. |
| 2013/0068579 | A1 | 3/2013 | Mathieu et al. |
| 2013/0140120 | A1 | 6/2013 | Rasmussen |
| 2013/0168196 | A1 | 7/2013 | Stanley |
| 2013/0175130 | A1 | 7/2013 | Liang |
| 2013/0175276 | A1 | 7/2013 | Gleichauf et al. |
| 2013/0248390 | A1 | 9/2013 | Roehm et al. |
| 2013/0284619 | A1 | 10/2013 | Daley |
| 2013/0292220 | A1 | 11/2013 | Kerley |
| 2013/0292221 | A1 | 11/2013 | Ryan et al. |
| 2013/0307214 | A1 | 11/2013 | Groller et al. |
| 2013/0313058 | A1 | 11/2013 | Yoshida |
| 2014/0027454 | A1 | 1/2014 | Banik |
| 2014/0062042 | A1 | 3/2014 | Wagner et al. |
| 2014/0069832 | A1 | 3/2014 | Roehm |
| 2014/0130310 | A1 | 5/2014 | Roth |
| 2014/0137370 | A1 | 5/2014 | Lo et al. |
| 2014/0138384 | A1 | 5/2014 | O'Brien |
| 2014/0151388 | A1 | 6/2014 | Culeron et al. |
| 2014/0158028 | A1 | 6/2014 | Adams |
| 2014/0166516 | A1 | 6/2014 | Martinez et al. |
| 2014/0197059 | A1 | 7/2014 | Evans et al. |
| 2014/0251864 | A1 | 9/2014 | Voeller |
| 2014/0252010 | A1 | 9/2014 | Miller |
| 2014/0265197 | A1 | 9/2014 | Russell et al. |
| 2014/0271095 | A1 | 9/2014 | Umans et al. |
| 2014/0284158 | A1 | 9/2014 | Reid |
| 2014/0284243 | A1 | 9/2014 | Tucker |
| 2014/0311361 | A1 | 10/2014 | Wangler |
| 2014/0311844 | A1 | 10/2014 | Meersschaert et al. |
| 2014/0319147 | A1 | 10/2014 | Horovitz et al. |
| 2015/0021132 | A1 | 1/2015 | Sijmons et al. |
| 2015/0027835 | A1 | 1/2015 | Moon |
| 2015/0034515 | A1 | 2/2015 | Monyak et al. |
| 2015/0069962 | A1 | 3/2015 | Dietzel et al. |
| 2015/0089903 | A1 | 4/2015 | Carey |
| 2015/0090551 | A1 | 4/2015 | Sikka |
| 2015/0114024 | A1 | 4/2015 | Grepper |
| 2015/0129569 | A1 | 5/2015 | Miller |
| 2015/0150347 | A1 | 6/2015 | Scicluna |
| 2015/0150348 | A1 | 6/2015 | Wax |
| 2015/0175338 | A1 | 6/2015 | Culp et al. |
| 2015/0189963 | A1 | 7/2015 | Lai et al. |
| 2015/0190920 | A1 | 7/2015 | Karlsson et al. |
| 2015/0208779 | A1 | 7/2015 | Tong |
| 2015/0209226 | A1 | 7/2015 | Priebe et al. |
| 2015/0233630 | A1 | 8/2015 | Bond |
| 2015/0292840 | A1 | 10/2015 | Tobin |
| 2015/0296945 | A1 | 10/2015 | Douglas |
| 2015/0296948 | A1 | 10/2015 | Kung |
| 2015/0315532 | A1 | 11/2015 | Bergbohm et al. |
| 2015/0352709 | A1 | 12/2015 | Diamond |
| 2015/0375558 | A1 | 12/2015 | Ben-Or |
| 2015/0375918 | A1 | 12/2015 | Holderness et al. |
| 2016/0023837 | A1 | 1/2016 | Furneaux et al. |
| 2016/0046417 | A1 | 2/2016 | Kromer |
| 2016/0052682 | A1 | 2/2016 | Gunnerson et al. |
| 2016/0083186 | A1 | 3/2016 | Wright |
| 2016/0084454 | A1 | 3/2016 | Svitak, Sr. et al. |
| 2016/0091239 | A1 | 3/2016 | Beland |
| 2016/0135563 | A1 | 5/2016 | Truong |
| 2016/0138809 | A1 | 5/2016 | Colucci et al. |
| 2016/0150862 | A1 | 6/2016 | Tonelli |
| 2016/0166024 | A1 | 6/2016 | Lai |
| 2016/0183651 | A1 | 6/2016 | Tonelli |
| 2016/0244209 | A1 | 8/2016 | Hain |
| 2016/0251124 | A1 | 9/2016 | Arnold et al. |
| 2016/0279840 | A1 | 9/2016 | French et al. |
| 2016/0286912 | A1 | 10/2016 | Morszeck |
| 2017/0079398 | A1 | 3/2017 | Reh et al. |
| 2017/0082342 | A1 | 3/2017 | Weinberg et al. |
| 2017/0108260 | A1 | 4/2017 | Ansted et al. |
| 2017/0127782 | A1 | 5/2017 | Korey et al. |
| 2017/0165829 | A1 | 6/2017 | Damberg |
| 2017/0173781 | A1 | 6/2017 | Damberg |
| 2017/0196332 | A1 | 7/2017 | Tong |
| 2017/0215537 | A1 | 8/2017 | Yu |
| 2017/0290400 | A1 | 10/2017 | Thomas |
| 2017/0347765 | A1 | 12/2017 | Jackson et al. |
| 2018/0035774 | A1 | 2/2018 | Pelatti |
| 2018/0035775 | A1 | 2/2018 | Haimoff |
| 2018/0037394 | A1 | 2/2018 | Seiders et al. |
| 2018/0078008 | A1 | 3/2018 | Sturm |
| 2018/0087819 | A1 | 3/2018 | Triska et al. |
| 2018/0087955 | A1 | 3/2018 | Lu |
| 2018/0141718 | A1 | 5/2018 | Ahlstrom et al. |
| 2018/0194533 | A1 | 7/2018 | Bramwell |
| 2018/0325230 | A1 | 11/2018 | Morszeck |
| 2018/0335241 | A1 | 11/2018 | Li et al. |
| 2018/0339820 | A1 | 11/2018 | Reinhart et al. |
| 2018/0354687 | A1 | 12/2018 | Seiders et al. |
| 2019/0008254 | A1 | 1/2019 | Newson |
| 2019/0092530 | A1 | 3/2019 | Seiders et al. |
| 2019/0170422 | A1 | 6/2019 | Dexter |
| 2019/0234671 | A1 | 8/2019 | Stanford et al. |
| 2019/0256119 | A1 | 8/2019 | Brilhante et al. |
| 2019/0271433 | A1 | 9/2019 | Tonelli |
| 2020/0029664 | A1 | 1/2020 | Tonelli |
| 2020/0037719 | A1 | 2/2020 | Jaworski et al. |
| 2020/0039056 | A1 | 2/2020 | Damberg |
| 2020/0060400 | A1 | 2/2020 | Glaser |
| 2020/0061802 | A1 | 2/2020 | Samsel et al. |
| 2020/0062454 | A1 | 2/2020 | Duong et al. |
| 2020/0086905 | A1 | 3/2020 | Yao et al. |
| 2020/0196725 | A1 | 6/2020 | Tonelli |
| 2020/0214407 | A1 | 7/2020 | Nichols et al. |
| 2020/0217576 | A1 | 7/2020 | Guan et al. |
| 2021/0102409 | A1 | 4/2021 | Seiders et al. |
| 2022/0114853 | A1 | 4/2022 | Emde et al. |

FOREIGN PATENT DOCUMENTS

| | | | |
|---|---|---|---|
| BR | 202015031355 | U2 | 6/2017 |
| CA | 60997 | A | 8/1898 |
| CA | 72336 | A | 7/1901 |
| CA | 72337 | A | 7/1901 |
| CA | 73327 | A | 10/1901 |
| CA | 77273 | A | 9/1902 |
| CA | 81456 | A | 6/1903 |
| CA | 72338 | A | 7/1907 |
| CA | 152411 | A | 12/1913 |
| CA | 175930 | A | 3/1917 |
| CA | 175939 | A | 3/1917 |
| CA | 2624994 | A1 | 5/2000 |
| CA | 89737 | A | 6/2000 |
| CA | 2483772 | A1 | 4/2005 |
| CA | 2633223 | A1 | 12/2009 |
| CA | 2635328 | A1 | 12/2009 |
| CA | 2782668 | A1 | 12/2013 |
| CH | 365631 | A | 11/1962 |
| CN | 2073459 | U | 3/1991 |
| CN | 2132145 | Y | 5/1993 |
| CN | 1112819 | A | 12/1995 |
| CN | 2515999 | Y | 10/2002 |
| CN | 2549792 | Y | 5/2003 |
| CN | 1457237 | A | 11/2003 |
| CN | 2664452 | Y | 12/2004 |
| CN | 3498732 | | 1/2006 |
| CN | 3498735 | | 1/2006 |
| CN | 2813823 | Y | 9/2006 |
| CN | 300690540 | | 9/2007 |
| CN | 300690541 | | 9/2007 |
| CN | 201076126 | Y | 6/2008 |
| CN | 300854008 | | 12/2008 |
| CN | 300856959 | | 12/2008 |

(56) References Cited

FOREIGN PATENT DOCUMENTS

| | | | |
|---|---|---|---|
| CN | 300918117 | | 5/2009 |
| CN | 301150817 | | 3/2010 |
| CN | 301189065 | | 5/2010 |
| CN | 201691232 | U | 1/2011 |
| CN | 301548656 | | 5/2011 |
| CN | 301620134 | | 7/2011 |
| CN | 201919912 | U | 8/2011 |
| CN | 201938601 | U | 8/2011 |
| CN | 304823685 | | 9/2011 |
| CN | 301711528 | | 11/2011 |
| CN | 301808188 | | 1/2012 |
| CN | 301950501 | | 6/2012 |
| CN | 102626271 | A | 8/2012 |
| CN | 302115731 | | 10/2012 |
| CN | 102805467 | A | 12/2012 |
| CN | 202722894 | U | 2/2013 |
| CN | 102948946 | A | 3/2013 |
| CN | 202760445 | U | 3/2013 |
| CN | 302365993 | | 3/2013 |
| CN | 202874104 | U | 4/2013 |
| CN | 302425923 | | 5/2013 |
| CN | 302448361 | | 6/2013 |
| CN | 203182247 | U | 9/2013 |
| CN | 203283617 | U | 11/2013 |
| CN | 302631183 | | 11/2013 |
| CN | 203439475 | U | 2/2014 |
| CN | 302811286 | | 5/2014 |
| CN | 302868078 | | 7/2014 |
| CN | 203789329 | U | 8/2014 |
| CN | 203814784 | U | 9/2014 |
| CN | 204032607 | U | 12/2014 |
| CN | 104433073 | A | 3/2015 |
| CN | 204245396 | U | 4/2015 |
| CN | 303154464 | | 4/2015 |
| CN | 303186110 | | 4/2015 |
| CN | 303221245 | | 5/2015 |
| CN | 303228514 | | 5/2015 |
| CN | 204409860 | U | 6/2015 |
| CN | 303228513 | | 6/2015 |
| CN | 303251869 | | 6/2015 |
| CN | 303324038 | | 8/2015 |
| CN | 303333672 | | 8/2015 |
| CN | 201530103483 | | 8/2015 |
| CN | 303381343 | | 9/2015 |
| CN | 303390870 | | 9/2015 |
| CN | 303499903 | | 12/2015 |
| CN | 303514839 | | 12/2015 |
| CN | 303546215 | | 1/2016 |
| CN | 201530438676 | | 2/2016 |
| CN | 201530438792 | | 2/2016 |
| CN | 105473462 | A | 4/2016 |
| CN | 303630971 | | 4/2016 |
| CN | 303680031 | | 5/2016 |
| CN | 303680054 | | 5/2016 |
| CN | 303687108 | | 6/2016 |
| CN | 205521292 | U | 8/2016 |
| CN | 303783877 | | 8/2016 |
| CN | 303799176 | | 8/2016 |
| CN | 201630123602 | | 8/2016 |
| CN | 303904119 | | 11/2016 |
| CN | 303918135 | | 11/2016 |
| CN | 205831341 | U | 12/2016 |
| CN | 303973165 | | 12/2016 |
| CN | 303982382 | | 12/2016 |
| CN | 303982387 | | 12/2016 |
| CN | 304000494 | | 1/2017 |
| CN | 304036742 | | 2/2017 |
| CN | 304036750 | | 2/2017 |
| CN | 304050612 | | 2/2017 |
| CN | 304068469 | | 3/2017 |
| CN | 304076890 | | 3/2017 |
| CN | 106551485 | A | 4/2017 |
| CN | 304172638 | | 6/2017 |
| CN | 107125891 | A1 | 9/2017 |
| CN | 107173938 | A | 9/2017 |
| CN | 107307551 | A | 11/2017 |
| CN | 107467837 | A | 12/2017 |
| CN | 206702967 | U | 12/2017 |
| CN | 304411334 | | 12/2017 |
| CN | 304411336 | | 12/2017 |
| CN | 304411337 | | 12/2017 |
| CN | 304411389 | | 12/2017 |
| CN | 304417314 | | 12/2017 |
| CN | 304423206 | | 12/2017 |
| CN | 304423258 | | 12/2017 |
| CN | 304423259 | | 12/2017 |
| CN | 304423260 | | 12/2017 |
| CN | 304423317 | | 12/2017 |
| CN | 206880270 | U | 1/2018 |
| CN | 304461798 | | 1/2018 |
| CN | 107668874 | A | 2/2018 |
| CN | 304532315 | | 3/2018 |
| CN | 304532317 | | 3/2018 |
| CN | 304532318 | | 3/2018 |
| CN | 304532319 | | 3/2018 |
| CN | 304539046 | | 3/2018 |
| CN | 304555895 | | 3/2018 |
| CN | 304562598 | | 4/2018 |
| CN | 304569073 | | 4/2018 |
| CN | 304569074 | | 4/2018 |
| CN | 108078109 | A | 5/2018 |
| CN | 304645055 | | 5/2018 |
| CN | 207428627 | U | 6/2018 |
| CN | 303242426 | | 6/2018 |
| CN | 304653754 | | 6/2018 |
| CN | 304660325 | | 6/2018 |
| CN | 304660327 | | 6/2018 |
| CN | 304660329 | | 6/2018 |
| CN | 304660332 | | 6/2018 |
| CN | 304691246 | | 6/2018 |
| CN | 304701684 | | 6/2018 |
| CN | 304749390 | | 7/2018 |
| CN | 304764980 | | 8/2018 |
| CN | 108497660 | A | 9/2018 |
| CN | 304823694 | | 9/2018 |
| CN | 108608804 | A | 10/2018 |
| CN | 207949211 | U | 10/2018 |
| CN | 304836888 | | 10/2018 |
| CN | 304854893 | | 10/2018 |
| CN | 304862165 | | 10/2018 |
| CN | 304862166 | | 10/2018 |
| CN | 108741519 | A | 11/2018 |
| CN | 108783799 | A | 11/2018 |
| CN | 108835813 | A | 11/2018 |
| CN | 108835814 | A | 11/2018 |
| CN | 304877452 | | 11/2018 |
| CN | 304900938 | | 11/2018 |
| CN | 108945792 | A | 12/2018 |
| CN | 109043770 | A | 12/2018 |
| CN | 208192442 | U | 12/2018 |
| CN | 208192487 | U | 12/2018 |
| CN | 304970790 | | 1/2019 |
| CN | 304995265 | | 1/2019 |
| CN | 305641119 | | 1/2019 |
| CN | 109303399 | A | 2/2019 |
| CN | 305019548 | | 2/2019 |
| CN | 109431028 | A | 3/2019 |
| CN | 109497673 | A | 3/2019 |
| CN | 208581902 | U | 3/2019 |
| CN | 305050777 | | 3/2019 |
| CN | 305078423 | | 3/2019 |
| CN | 305078424 | | 3/2019 |
| CN | 305111950 | | 4/2019 |
| CN | 305181544 | | 5/2019 |
| CN | 305184268 | | 5/2019 |
| CN | 305242413 | | 7/2019 |
| CN | 305283238 | | 8/2019 |
| CN | 209403814 | U | 9/2019 |
| CN | 305344781 | | 9/2019 |
| CN | 305347993 | | 9/2019 |
| CN | 305359134 | | 9/2019 |
| CN | 305359135 | | 9/2019 |
| CN | 209528183 | U | 10/2019 |
| CN | 305398498 | | 10/2019 |

(56) References Cited

FOREIGN PATENT DOCUMENTS

| | | | |
|---|---|---|---|
| CN | 209563672 | U | 11/2019 |
| CN | 209628893 | U | 11/2019 |
| CN | 305424085 | | 11/2019 |
| CN | 305424089 | | 11/2019 |
| CN | 305437133 | | 11/2019 |
| CN | 305437134 | | 11/2019 |
| CN | 305437137 | | 11/2019 |
| CN | 110605939 | A | 12/2019 |
| CN | 209719155 | U | 12/2019 |
| CN | 209719159 | U | 12/2019 |
| CN | 209732871 | U | 12/2019 |
| CN | 209788810 | U | 12/2019 |
| CN | 305476163 | | 12/2019 |
| CN | 305488622 | | 12/2019 |
| CN | 305499080 | | 12/2019 |
| CN | 305506675 | | 12/2019 |
| CN | 305518862 | | 12/2019 |
| CN | 209931762 | U | 1/2020 |
| CN | 209965461 | U | 1/2020 |
| CN | 305527333 | | 1/2020 |
| CN | 305533439 | | 1/2020 |
| CN | 305533533 | | 1/2020 |
| CN | 305533534 | | 1/2020 |
| CN | 305533538 | | 1/2020 |
| CN | 305533539 | | 1/2020 |
| CN | 305540311 | | 1/2020 |
| CN | 305547763 | | 1/2020 |
| CN | 305547764 | | 1/2020 |
| CN | 305547961 | | 1/2020 |
| CN | 305556652 | | 1/2020 |
| CN | 305563596 | | 1/2020 |
| CN | 305571758 | | 1/2020 |
| CN | 305571764 | | 1/2020 |
| CN | 305577923 | | 1/2020 |
| CN | 305577960 | | 1/2020 |
| CN | 305578103 | | 1/2020 |
| CN | 210076793 | U | 2/2020 |
| CN | 210114130 | U | 2/2020 |
| CN | 305584094 | | 2/2020 |
| CN | 305584095 | | 2/2020 |
| CN | 305584098 | | 2/2020 |
| CN | 305605578 | | 2/2020 |
| CN | 305614805 | | 2/2020 |
| CN | 305621592 | | 2/2020 |
| CN | 305621593 | | 2/2020 |
| CN | 305629332 | | 2/2020 |
| CN | 305635594 | | 3/2020 |
| CN | 305636583 | | 3/2020 |
| CN | 305639489 | | 3/2020 |
| CN | 305642338 | | 3/2020 |
| CN | 305642339 | | 3/2020 |
| CN | 305642418 | | 3/2020 |
| CN | 305657621 | | 3/2020 |
| CN | 305748162 | | 5/2020 |
| CN | 305873337 | | 6/2020 |
| DE | 74708 | C | 4/1894 |
| DE | 2020368 | A1 | 11/1971 |
| DE | 7502524 | U | 9/1975 |
| DE | 2939826 | A1 | 4/1980 |
| DE | 3344410 | A1 | 6/1985 |
| DE | 8620597 | U1 | 9/1986 |
| DE | 9012845 | U1 | 10/1990 |
| DE | 4042245 | A1 | 7/1991 |
| DE | 9105033 | U1 | 3/1992 |
| DE | 9408707 | U1 | 9/1995 |
| DE | 29516306 | U1 | 2/1997 |
| DE | 29815666 | U1 | 11/1998 |
| DE | 19755532 | A1 | 6/1999 |
| DE | 20312950 | U1 | 10/2003 |
| DE | 20313077 | U1 | 1/2004 |
| DE | 202004007996 | U1 | 7/2004 |
| DE | 202004012191 | U1 | 12/2004 |
| DE | 202004015475 | U1 | 1/2005 |
| DE | 202004016959 | U1 | 2/2005 |
| DE | 202005006105 | U1 | 6/2005 |
| DE | 202005014773 | U1 | 11/2005 |
| DE | 202006001888 | U1 | 4/2006 |
| DE | 402010002800-0008 | | 6/2010 |
| DE | 402010002800-0001 | | 7/2010 |
| DE | 402010002800-0002 | | 7/2010 |
| DE | 402010002800-0003 | | 7/2010 |
| DE | 402010002800-0004 | | 7/2010 |
| DE | 402010002800-0007 | | 7/2010 |
| DE | 402010002800-0009 | | 7/2010 |
| DE | 402010002800-0010 | | 7/2010 |
| DE | 402010002800-0011 | | 7/2010 |
| DE | 402010002800-0012 | | 7/2010 |
| DE | 202012006671 | U1 | 8/2012 |
| DE | 102012025617 | A1 | 10/2013 |
| DE | 102013004590 | A1 | 9/2014 |
| DE | 102013114520 | A1 | 6/2015 |
| DE | 202016004315 | U1 | 8/2016 |
| DE | 102015217545 | B3 | 12/2016 |
| DE | 202015106823 | U1 | 3/2017 |
| DE | 102017122609 | A1 | 3/2019 |
| EM | 000134804-0001 | | 6/2004 |
| EM | 001606468-0001 | | 9/2009 |
| EM | 001606468-0002 | | 9/2009 |
| EM | 00168228-0002 | | 4/2010 |
| EM | 001682428-0001 | | 4/2010 |
| EM | 001682428-0003 | | 4/2010 |
| EM | 001682428-0004 | | 4/2010 |
| EM | 001682428-0005 | | 4/2010 |
| EM | 001682428-0006 | | 4/2010 |
| EM | 001781865-0001 | | 12/2010 |
| EM | 001781865-0006 | | 12/2010 |
| EM | 001781865-0007 | | 12/2010 |
| EM | 001781865-0008 | | 12/2010 |
| EM | 001781899-0006 | | 2/2011 |
| EM | 001781899-0009 | | 2/2011 |
| EM | 002215897-0001 | | 8/2013 |
| EM | 002277574-0001 | | 8/2013 |
| EM | 002277574-0002 | | 8/2013 |
| EM | 002325209-0001 | | 11/2013 |
| EM | 002325209-0002 | | 11/2013 |
| EM | 002569467-0001 | | 11/2014 |
| EM | 002569467-0002 | | 11/2014 |
| EM | 002569467-0003 | | 11/2014 |
| EM | 002569467-0004 | | 11/2014 |
| EM | 002576728-0013 | | 11/2014 |
| EM | 002646935-0001 | | 3/2015 |
| EM | 002978569-0001 | | 2/2016 |
| EM | 003261668-0002 | | 7/2016 |
| EM | 003743905-0006 | | 2/2017 |
| EM | 004100048-0001 | | 9/2017 |
| EM | 004100048-0002 | | 9/2017 |
| EM | 004385409-0001 | | 10/2017 |
| EM | 004168789-0001 | | 11/2017 |
| EM | 004662039-0002 | | 3/2018 |
| EM | 004662039-0003 | | 3/2018 |
| EM | 005609583-0001 | | 8/2018 |
| EM | 005625977-0006 | | 9/2018 |
| EM | 005500311-0002 | | 10/2018 |
| EM | 005500311-0003 | | 10/2018 |
| EM | 005804747-0001 | | 10/2018 |
| EM | 005804762-0001 | | 10/2018 |
| EM | 005804770-0001 | | 10/2018 |
| EM | 005805140-0001 | | 10/2018 |
| EM | 005805199-0001 | | 10/2018 |
| EM | 006453072-0001 | | 5/2019 |
| EM | 006618583-0001 | | 10/2019 |
| EM | 006618583-0002 | | 10/2019 |
| EM | 006618583-0003 | | 10/2019 |
| EM | 006618583-0004 | | 10/2019 |
| EM | 007064233-0002 | | 11/2019 |
| EM | 007145461-0012 | | 11/2019 |
| EM | 007449095-0001 | | 1/2020 |
| EM | 007576806-0001 | | 2/2020 |
| EM | 007719141-0001 | | 3/2020 |
| EP | 0069419 | A1 | 1/1983 |
| EP | 0530067 | A1 | 3/1993 |
| EP | 0587451 | A1 | 3/1994 |
| EP | 0221215 | B1 | 6/1995 |
| EP | 0670791 | A1 | 9/1995 |

(56) References Cited

FOREIGN PATENT DOCUMENTS

| | | | |
|---|---|---|---|
| EP | 1000865 | A1 | 5/2000 |
| EP | 1059239 | A1 | 12/2000 |
| EP | 1080656 | A1 | 3/2001 |
| EP | 1442845 | A1 | 8/2004 |
| EP | 1475008 | A1 | 11/2004 |
| EP | 1880948 | A2 | 1/2008 |
| EP | 1921009 | A1 | 5/2008 |
| EP | 2024218 | A2 | 2/2009 |
| EP | 2107982 | A1 | 10/2009 |
| EP | 2236428 | A1 | 10/2010 |
| EP | 2330939 | A1 | 6/2011 |
| EP | 2344000 | A1 | 7/2011 |
| EP | 2387906 | A1 | 11/2011 |
| EP | 2412493 | A2 | 2/2012 |
| EP | 2441340 | A1 | 4/2012 |
| EP | 2522248 | A1 | 11/2012 |
| EP | 2543481 | A1 | 1/2013 |
| EP | 2745727 | A2 | 6/2014 |
| EP | 2826394 | A1 | 1/2015 |
| EP | 2829484 | A1 | 1/2015 |
| EP | 2829485 | A1 | 1/2015 |
| EP | 2904926 | A1 | 8/2015 |
| EP | 3013176 | A1 | 5/2016 |
| EP | 3027078 | A1 | 6/2016 |
| EP | 3073852 | A1 | 10/2016 |
| EP | 3216363 | A1 | 9/2017 |
| EP | 3351130 | A1 | 7/2018 |
| EP | 3403521 | A1 | 11/2018 |
| EP | 3581059 | A1 | 12/2019 |
| EP | 3402720 | B1 | 12/2020 |
| FR | 1198768 | A | 12/1959 |
| FR | 2179844 | A1 | 11/1973 |
| FR | 2223248 | A1 | 10/1974 |
| FR | 2638950 | A1 | 5/1990 |
| FR | 2689100 | A1 | 10/1993 |
| FR | 2711044 | A1 | 4/1995 |
| FR | 2712257 | A1 | 5/1995 |
| FR | 2809690 | A1 | 12/2001 |
| FR | 2870692 | A1 | 12/2005 |
| FR | 2912997 | A1 | 8/2008 |
| GB | 854540 | A | 11/1960 |
| GB | 1004335 | * | 4/1962 |
| GB | 1041392 | A | 9/1966 |
| GB | 2023550 | A | 1/1980 |
| GB | 2023551 | A | 1/1980 |
| GB | 2032814 | A | 5/1980 |
| GB | 2047073 | A | 11/1980 |
| GB | 2023549 | A | 9/1992 |
| GB | 2278874 | A | 12/1994 |
| GB | 2291042 | A | 1/1996 |
| GB | 2045135 | A | 2/1996 |
| GB | 2308803 | A | 7/1997 |
| GB | 2289713 | B | 12/1997 |
| GB | 2421713 | A | 7/2006 |
| GB | 2438189 | A | 11/2007 |
| GB | 2459111 | A | 10/2009 |
| GB | 4036176 | | 7/2014 |
| GB | 4037039 | | 10/2014 |
| GB | 9005804-0001 | | 10/2018 |
| GB | 9006576138-0004 | | 6/2019 |
| GB | 90066075520006 | | 7/2019 |
| GB | 2575671 | A | 1/2020 |
| ID | D0000002662-0001 | | 1/2003 |
| IL | 55179 | A | 7/1981 |
| IN | 266778 | | 5/2015 |
| IN | 266779-0001 | | 5/2015 |
| IN | 276720 | | 2/2016 |
| JP | S57-150175 | U | 9/1982 |
| JP | S60-164570 | A | 8/1985 |
| JP | H03-066374 | U | 6/1991 |
| JP | H0574275 | A | 3/1993 |
| JP | H07-102842 | A | 4/1995 |
| JP | H08-093298 | A | 4/1996 |
| JP | 2569734 | B2 | 1/1997 |
| JP | 2976179 | B2 | 11/1999 |
| JP | H11309011 | A | 11/1999 |
| JP | 2001-107621 | A | 4/2001 |
| JP | 3177720 | B2 | 6/2001 |
| JP | 3191248 | B2 | 7/2001 |
| JP | 3197227 | B2 | 8/2001 |
| JP | 2001-262907 | A | 9/2001 |
| JP | 3211023 | B2 | 9/2001 |
| JP | D1121506 | | 9/2001 |
| JP | 3225244 | B2 | 11/2001 |
| JP | D2001-10753 | | 6/2002 |
| JP | D1193948 | | 1/2004 |
| JP | 2004136941 | A | 5/2004 |
| JP | 2006122067 | A | 5/2006 |
| JP | D1312168 | | 10/2007 |
| JP | D2007-16058 | | 5/2008 |
| JP | D2007-16059 | | 5/2008 |
| JP | D1338388 | | 8/2008 |
| JP | D1382214 | | 3/2010 |
| JP | D1382215 | | 3/2010 |
| JP | D1397219 | | 9/2010 |
| JP | D1397346 | | 9/2010 |
| JP | D1408819 | | 3/2011 |
| JP | D1408988 | | 3/2011 |
| JP | 2014184051 | A | 10/2014 |
| JP | 6206200 | B2 | 10/2017 |
| JP | 6226662 | B2 | 11/2017 |
| JP | 2019119506 | A | 7/2019 |
| KR | 100395931 | B1 | 8/2003 |
| KR | 3020030024985 | | 9/2003 |
| KR | 200362331 | Y1 | 9/2004 |
| KR | 20070101643 | A | 10/2007 |
| KR | 20070103598 | A | 10/2007 |
| KR | 3020070008850 | | 12/2007 |
| KR | 300492699.0000 | | 5/2008 |
| KR | 20090074289 | A | 7/2009 |
| KR | 100921297 | B1 | 10/2009 |
| KR | 101267451 | B1 | 5/2013 |
| KR | 300740505.0000 | | 4/2014 |
| KR | 300831147.0000 | | 12/2015 |
| KR | 300887228.0000 | | 12/2016 |
| KR | 300908948.0000 | | 6/2017 |
| KR | 300908949.0000 | | 6/2017 |
| KR | 300915252.0000 | | 7/2017 |
| KR | 20180037090 | A | 4/2018 |
| KR | 300968949.0000 | | 8/2018 |
| KR | 300982867.0000 | | 11/2018 |
| KR | 300983257.0000 | | 12/2018 |
| KR | 300990244.0000 | | 1/2019 |
| KR | 300990253.0000 | | 1/2019 |
| KR | 300996066.0000 | | 3/2019 |
| KR | 102054504 | B1 | 12/2019 |
| KR | 301037245.0000 | | 12/2019 |
| KR | 301037251.0000 | | 12/2019 |
| KR | 301050842.0000 | | 3/2020 |
| KR | 301541440002 | | 4/2020 |
| NL | 7504291 | A | 10/1975 |
| NL | 8903105 | A | 7/1991 |
| NL | 1032860 | C1 | 11/2006 |
| RU | 00100422 | U1 | 12/2010 |
| TR | 201708307-0001 | | 2/2018 |
| TW | M310869 | U | 5/2007 |
| WO | 9400034 | A1 | 1/1994 |
| WO | D032061-005 | | 4/1995 |
| WO | D035637-003 | | 2/1996 |
| WO | D036648-008 | | 6/1996 |
| WO | 9631140 | A1 | 10/1996 |
| WO | 9748613 | A1 | 12/1997 |
| WO | 0041937 | A1 | 7/2000 |
| WO | 0168477 | A1 | 9/2001 |
| WO | 02064445 | A1 | 8/2002 |
| WO | 03041529 | A1 | 5/2003 |
| WO | 04076291 | A2 | 9/2004 |
| WO | 06019314 | A1 | 2/2006 |
| WO | 06037302 | A1 | 4/2006 |
| WO | 08001029 | A1 | 1/2008 |
| WO | 2008034603 | A1 | 3/2008 |
| WO | 09028960 | A1 | 3/2009 |
| WO | 1135559 | A1 | 3/2011 |
| WO | 11135559 | A1 | 11/2011 |

(56) References Cited

FOREIGN PATENT DOCUMENTS

| | | | |
|---|---|---|---|
| WO | 12000497 | A1 | 1/2012 |
| WO | 2012029119 | A1 | 3/2012 |
| WO | D078390-004 | | 11/2012 |
| WO | 13014670 | A1 | 1/2013 |
| WO | D080557-001 | | 4/2013 |
| WO | 2013126851 | A1 | 8/2013 |
| WO | 14131214 | A1 | 9/2014 |
| WO | 14193073 | A1 | 12/2014 |
| WO | 2015040526 | | 3/2015 |
| WO | 15087357 | A1 | 6/2015 |
| WO | 16072912 | A1 | 5/2016 |
| WO | 16091570 | A1 | 6/2016 |
| WO | 2017034992 | A1 | 3/2017 |
| WO | 17088278 | A1 | 6/2017 |
| WO | 17091899 | A1 | 6/2017 |
| WO | 17192694 | A1 | 11/2017 |
| WO | 2017191628 | A1 | 11/2017 |
| WO | 2018012675 | A1 | 1/2018 |
| WO | 2018086193 | A1 | 5/2018 |
| WO | 18169478 | A1 | 9/2018 |
| WO | 2019238228 | A1 | 12/2019 |
| WO | 2020030766 | A1 | 2/2020 |
| WO | 2020206312 | A2 | 10/2020 |

OTHER PUBLICATIONS

2020 Dec. 2020—(CN) First Office Action—App. No. 201880036572.1.

Oct. 18, 2021—(WO) International Search Report & Written Opinion—PCT/US21/023632.

Jul. 6, 2020—(WO) International Search Report & Written Opinion—PCT/US2020/012404.

Amazon.ca, Site visited Dec. 28, 2021, Samsonite Centric, First available Sep. 20, 2017, https://www.amazon.ca/Samsonite-Ce 1ntric-Hardside-Expandable-Luggage/dp/B074VJYRZN (Year: 2017).

Whereintheworldisnina.com, Site visited Dec. 28, 2021, "Choosing the Best Hard Shell Luggage for your Trip" by Nina Ragusa published on Apr. 29, 2019 Features the Maxlite, Timberland, and Level8 luggage cases with compression straps, https://whereintheworldisnina.com/best-hard-shell-luggage/ (Year: 2019).

Nytimes.com. Site visited Dec. 28, 2021, "Are Away Carry-Ons Worth the Hype" by Kit Dillon published on May 19, 2020 Features the Muji Carry-on with compression strap, https://www.nytimes.com/wirecutter/reviews/are-away-carry-ons-worth-the-hype/ (Year: 2020).

Amazon.ca, Site visited Dec. 28, 2021, Bamboo Wolf Hard Shell Luggage, First available May 29, 2020, https://www amazon.ca/Aluminum-Magnesium-Hardside-Suitcase-Zipperless-Business/dp/B085M1CB6J (Year: 2020).

9to5toys.com, Site visited Dec. 28, 2021, "Review, Pelican's Impressive Elite Luggage is built like a tank, but is it worth the price tag?" Published by Justin Kahn on May 29, 2016, https://9to5toys.com/2016/05/29/review-pelicans-impressive-elite-luggage-is-built-like-a-tank-but-is-it-worth-the-price-tag/ (Year: 2016).

Amazon.ca, Site visited Dec. 27, 2021, Trolley Box Suitcase by Yadsheng, First available Sep. 23, 2019, https://www.amazon.ca/Suitcase-Universal-Portable-Hardshell-Business/dp/B07Y7RBRN1 (Year: 2019).

Amazon.ca, Site visited Dec. 27, 2021, Bamboo Wolf Hardside Suitcase, First available May 29, 2020, https://www.amazon.ca/Aluminum-Hardside-Suitcase-Business-Travelling/dp/B085M1CB6J (Year: 2020).

Amazon.ca, Site visited Dec. 28, 2021 , Rimowa Suitcase, First available Jan. 25, 2017, https://www.amazon.ca/Rimowa-Classic-Luggage-Multiwheel-Suitcase/dp/B01N6NEIIX (Year: 2017).

Amazon.ca, Site visited Dec. 28, 2021 , Travelking Spinner Suitcase, First available May 4, 2017, https://www.amazon.ca/Multi-size-Aluminum-Luggage-Suitcase-TravelKing/dp/B06Y53X785 (Year: 2017).

Amazon.ca, Site visited Dec. 28, 2021 , Level8 Gibraltar Suitcase, First available Jan. 24, 2019, https://www.amazon.ca/dp/B07MX224X5 (Year: 2019).

May 12, 2020—(WO) Partial International Search—PCT/US2020/012404.

Jan. 28, 2022—(JP) Office Action—App. No. 2019566933.

Oct. 7, 2020—(WO) ISR & WO—PCT/US2020/026655.

Apr. 7, 2021—(CN) First Office Action—App. No. 202030815015.X.

www.amazon.com; website visited Oct. 6, 2021; Pelican 1510 Case with Foam; Date First Available Oct. 2, 2001; https://www.amazon.com/Pelican-1510-Case-Foam-Black/dp/B0002SKHIK/ref=sr_1_123?dchild=1&keywords=wheeled+tool+box+for+flying&qid=16%E2%80%A6 (Year: 2001).

Halliburton Pursuit Aluminum Continental Carry-on Case, Site visited on Oct. 6, 2021; website captured on May 20, 2020 via wayback: https://web.archive.org/web/20200520103816/https://zerohalliburton.com/collections/luggage (Year 2020).

Sep. 2, 2022—(CN) Second Office Action—App. No. 202080008216.6.

Nordstrom.com, Rimowa Original Cabin 22-Inch Wheeled Carry-On, Oldest review dated Apr. 14, 2019, https://www.nordstrom.com/s/ rimowa-original-cabin-22-inch-wheeled-carry-on/5102644 (Year: 2019).

Youtube.com, Site visited Sep. 28, 2022, "Carl Friedrik 'The Carry-On' First Look," published by Bo Ismono on Jun. 21, 2020 features the Carl Friedrik carry on, https://youtu.be/XYCU00WAIO4 (Year: 2020).

Amazon.com, site visited Sep. 29, 2022, SureSeal by FireKing Waterproof Fireproof Safe Chest, first available Aug. 10, 2012, https:// www.amazon.com/dp/B008VXQ72I (Year: 2012).

bhphotovideo.com, site visited Sep. 29, 2022, Nanuk 935 Wheeled Hard Utility Case, oldest review dated Jul. 1, 2014, https://www.bhphotovideo.com/c/product/1504694-REG/nanuk_935_6005_935_waterproof_hard_case.html (Year: 2014).

Amazon.ca, Site visited Sep. 28, 2022, Delsey Titanium Spinner Luggage, First available Oct. 27, 2014, https://www.amazon.ca/Delsey-Luggage-Titanium-Spinner-Trolley/dp/B00MQF0QTM?th=1 (Year: 2014).

Amazon.ca, Site visited Sep. 28, 2022, Nanuk Waterproof Hard Case, First available Nov. 13, 2019, https://www.amazon.ca/Nanuk-Waterproof-Hard-Case-Wheels/dp/B07YXLQX4Z (Year: 2019).

Sep. 27, 2022—(JP) Office Action—App. No. 2021-559258.

Oct. 8, 2022—(CN) OA—App No. 202110925931.2.

Jun. 3, 2022—(WO) International Search Report and Written Opinion—PCT/US2022/063684.

Aug. 3, 2022—(EP) Extended Search Report—App. No. 22162500.7.

Aug. 29, 2022—(AU) Examination Report No. 1—App. No. 2020256255.

Lowe's, "Craftsman 37-in Black Plastic Wheels Lockable Tool Box," https://www.lowes.com/pd/CRAFTSMAN-37-in-Black-Plastic-Wheeled-Lockable-Tool-Box/1000578337.

Home Depot, "Husky 37 in. Rolling Tool Box Utility Cart Black," <https://www.homedepot.com/p/Husky-37-in-Rolling-Tool-Box-Utility-Cart-Black-209261/203668066>.

B&H, "Nanuk 960 Protective Rolling Case with Dividers and Organizer (Black)," https://www.bhphotovideo.com/c/product/1504703-REG/nanuk_960_6001_960_waterproof_hard_case.html.

Pelican Elite 50 Quart Cooler, available Nov. 9, 2016, [online], [site visited Mar. 31, 2018]. Available from internet, <URL: https://www.amazon.com/Pelican-Elite-Quart-Cooler-White/product-reviews/B01G7KG5PA/ref=cm_cr_getr_d_paging_btm_5?ie=UTF8&reviewerType=all_reviews&sortBy=recent&pageNumber=5 (Year:2016)

Pelican Storm Waterproof Case, available Jul. 27, 2009, [online], [site visited Mar. 31, 2018]. Available from internet, <URL: https://www.amazon.com/dp/B002JB07D8?aaxitk=EqSpVoa9QpKAGqst7rmxMA&pd_rd_i=B002JB07D8&pf_rd_m=ATVPDKIKX0DER&pf (Year: 2009).

Outdoor Products Small Watertight Dry Box, Blue, available May 31, 2016, [online], [site visited Mar. 31, 2018]. Available from

(56) References Cited

OTHER PUBLICATIONS internet, <URL: https://www.walmart.com/ip/Outdoor-Products-Small-Watertight-Dry-Box-Blue/26674162 (Year: 2016).
Sep. 20, 2018—(WO) International Search Report and Written Opinion—App. PCT/US2018/037100.
yeti.com, Images of Loadout Bucket Web Page visited on Mar. 17, 2020, at https://www.yeti.com/en_US/buckets/loadout-5-gallon-bucket/YLOB5.html?dwvar_YLOB5_color=white&cgid=buckets#start=1 <https://www.yeti.com/en_US/buckets/loadout-5-gallon-bucket/YLOB5.html?dwvar_YLOB5_color=white&cgid=buckets>.
amazon.com, "Pelican 015100-0050-110 Protector Carry-On Case Black w/TrekPak Insert: Camera & Photo," visited Oct. 16, 2019 and revisited Jan. 6, 2020 at https://www.amazon.com/Pelican-1510TP-Carry-TrekPak-Divider/dp/B01E4E1BFK/ref=sr_1_48?crid=3CLVWN9DJ62R&keywords=carry+on+organizer+insert&qid=1571270299&sprefix=carry+on+organizer%Caps%2C143&sr=8-48.
amazon.com, "Samsonite F'Lite GT 31" Hardside Wheeled Luggage (Vivid Blue)," visited Dec. 16, 2019 and revisited Jan. 7, 2020 at <https://www.amazon.com/Samsonite-Flite-Spinner-Black-Size/dp/B01LTG2XVC?th=1> Samsonite F'Lite GT 31" Hardside Wheeled Luggage (Vivid Blue).
alibaba.com, "Removable Spinner Wheels for Suitcase Replacement Suitcase Luggage," visited Dec. 16, 2019 and revisited Jan. 7, 2020 at https://www.alibab.com/product-detail/Removable-Spinner-Wheels-For-Suitcase-Replacement_605641600.
amazon.com, "Lockable Tackle Box Fishing Waterproof Fly Fishing Box Double Sided Ice Fishing Tackle Case Box Storage Waterproof: 360 Degree Rubber Gasket, Durable Plastic Construction Double Sided Triangle-Cut For," visited Dec. 16, 2019 and revisited Jan. 7, 2020 at <https://www.amazon.com/Lockable-Tackle-Fishing-Waterproof-Storage/dp/B07MFF6S6N>.
yankodesign.com, "Vacuum Packed Suitcase," visited Dec. 16, 2019 and revisited Jan. 7, 2020 at <https://www.yankodesign.com/2011/11/28/vacuum-packed-suitcase/>.
alibaba.com, "Portable Luggage Wheels for Luggage Trolley Bags & Suitcase," visited Dec. 16, 2019 and revisited Jan. 7, 2020 at https://www.alibaba.com/product-detail/Portable-Luggage-Wheels-for-luggage-Trolley_1854722793.html.
northerntool.com, "Dewalt 28in. Wheeled Toolbox, Model# DWST28100," visited on Apr. 6, 2020 at https://www.northerntool.com/shop/tools/product_200726534_200726534.
walmart.com, "Sterilite 151L Black Wheeled Industrial Tote," visited on Apr. 6, 2020 at https://www.walmart.ca/en/ip/sterilite-151l-black-wheeled-industrial-tote/6000195957310.
globalindustrial.com, "Contico UK3725-4 Rolling Pro Tuff Work Box," visited on Apr. 6, 2020 at https://www.globalindustial.com/p/tools/tool-storage/Jo-Site/rolling-pro-tuff-work-box?infoParam.campaignID=T9F.
amazon.com, "Grey: Akro-Mils 33105 Akro-Grid Slotted Divider Plastic Tote Box," visited on Apr. 6, 2020 at https://www.amazon.in/Grey-Akro-Mils-Akro-Grid-Slotted-Divider/dp/B004C044VU.
globalindustrial.com, "Global Industrial™ Plastic Dividable Grid Container," visited on Apr. 6, 2020 at https://www.globalindustrial.com/p/storage/bins-totes-containers/dividable-grid/grid-wall-bin-stackable-1.
globalindustrial.com, "Straight Wall Container Solid," visited Apr. 6, 2020 at https://www.globalindustrial.com/p/storage/bins-totes-containers/stacking-containers/straight-wall-container-12x7-2-5x5.
amazon.com, "Top Shelf Custom Injection Molded ABS Saddlebag Organizer Tray, 2014—Current H-D ABS Hard Bags, LFT by Advanced Accessory Concepts LLC," visited Oct. 16, 2019 and revisited Jan. 6, 2020 at https://www.amazon.com/Custom-Injection-Molded-Saddlebag-Organizer/dp/B01MQWBM40/ref=sr_1_38?keywords=luggage+hard+removable+liner&qid=1571270714&sr=8-38.
amazon.com, "Pelican Air 1615 Travel Case—Suitcase Luggage (Blue) by Pelican," visited Oct. 16, 2019 and revisited Jan. 6, 2020 at https://www.amazon.com/Pelican-Air-1615-Travel-Case/dp/B07XGHDK66?ref_=ast_sto_dp.

* cited by examiner

24B

CARRY STRAP FOR CONTAINER

CROSS-REFERENCE TO RELATED APPLICATION

This application is a continuation-in-part of U.S. patent application Ser. No. 16/006,344 filed on Jun. 12, 2018, which claims priority to U.S. Provisional Patent Application No. 62/518,358 filed on Jun. 12, 2017. The above referenced applications are incorporated by reference in their entirety.

BACKGROUND

Various types of containers and latching systems exist. Containers may be used for food, beverages, and other materials or items. Latching systems exist to lock the containers in a closed configuration. However, conventional containers and latching systems are often not very durable and may not be easy to use. For instance, containers may not be strong enough to hold certain items and may not be strong enough to hold items on top of the container. Additionally, some latching systems may engage when a user does not want the system engaged and in other cases may not provide a sufficient lock between for the container. In such arrangements these and other deficiencies may render the container and/or latching system virtually useless.

BRIEF SUMMARY

This Summary is provided to introduce a selection of concepts in a simplified form that are further described below in the Detailed Description. The Summary is not intended to identify key features or essential features of the claimed subject matter, nor is it intended to be used to limit the scope of the claimed subject matter.

According to one aspect of this disclosure, a strap for lifting a container where the strap includes a base member having a first end, a second end opposite the first end, and an elongated member extending between the first end and the second end. The base member may be formed from a woven fiber material. The strap may have a first end portion located at the first end having a first engaging member, where the first engaging member includes a first layered portion, a second end portion located at the second end, where the second end portion includes a second engaging member that has a second engaging member, which includes a second layered portion. The strap may also have a carry handle that includes a first opening and a second opening, where the elongated member extends through the first opening and the second opening. The base member may include a pair of overlap regions arranged on both sides of the carry handle, where each overlap region includes a plurality of layers of the base member and stitching to join the plurality of layers together. The carry handle may be substantially centered along an entire length of the strap. Additionally, the first end portion and the second end portion both include stitching that joins the first layered portion and the second layered portion. The stitching of the first layered portion may be located a fixed distance from the first end defining an inboard portion and an outboard portion of the first layered portion, where the inboard portion has a first length defined as a distance from a centerline of the stitching to the first end of the base member and the outboard portion has a second length defined as a distance from the centerline of the stitching to an end of the outboard portion. The first length of the inboard portion may be less than the second length of the outboard portion. The base member may be a single unitary member, and in some examples, the strap may have a variable width along an overall length of the strap.

Other aspects of this disclosure may describe a system of a strap for lifting a container that include a container having a first side handle that includes a first elongated opening on a first side of the container and a second side handle having a second elongated opening on a second side of the container opposite the first side, where the first elongated opening has a first opening width and the second elongated opening has a second opening width. The strap may include a base member having a first end, a second end opposite the first end, and an elongated member extending between the first end and the second end, the base member having a strap width. The strap may also include a first end portion located at the first end having a first engaging member that includes a first layered portion, and a second end portion located at the second end, where the second end portion includes a second engaging member that has a second layered portion. The strap may also include a carry handle with a first opening and a second opening opposite the first opening, where the elongated member extends through the first opening and the second opening. The first end portion may extend through the first elongated opening and the second end may extend through the second elongated opening and secure the strap to the container using a friction fit. The strap width of the base member at the first end portion may be greater than the width of the first elongated opening of the container. The strap width may be within a range of 1 percent to 10 percent greater than the first opening width. The first engaging member may include stitching located a fixed distance from the first end to a centerline of the stitching defining an inboard portion and an outboard portion of the first end portion, where the inboard portion has a first length defined as a distance from the centerline of the stitching to the first end of the strap and the outboard portion has a second length defined as a distance from the centerline of the stitching to an end of the outboard portion, where the first length is less than the second length. The container may include a first recess offset below a first top surface of the first side handle, where the first recess has an inboard recess portion that extends toward an interior void of the container from the first elongated opening and an outboard recess portion that extends away from the first elongated opening in a direction extending away from the interior void of the container, and where an inboard portion of the first end portion is received in the inboard recess portion. A depth of the first recess may be greater than a thickness of the first end portion. A majority of the strap may extend below the first side handle.

Yet other aspects of this disclosure may relate to a method for installing a strap on a container that include: (a) opening a lid from a base of the container, wherein the lid is rotationally coupled to the base; (b) inserting a first end portion of the strap through a first elongated opening on a first handle of the base, wherein the first end portion is inserted at a first acute angle to a first top surface of the first handle; (c) rotating a first inboard portion of the first end portion onto the first top surface of the first handle; (d) rotating a first outboard portion of the first end portion onto the first top surface of the first handle; (e) inserting a second end portion of the strap into a second opening on a second handle of the base, wherein the strap is inserted at a second acute angle to a second top surface of the second handle; (f) rotating a second inboard portion of the second end portion onto the second top surface of the second handle; and (g) unfolding a second outboard portion of the second end onto the second top surface of the second handle. In some examples, the method may also include: (a) placing the first inboard portion into a first inboard recess, wherein the first inboard recess is offset below the first top surface of the first handle and extends toward an interior void of the container from the first elongated opening; (b) placing the first outboard portion into a first outboard recess, where the first outboard recess is offset below the first top surface of the first handle and extends away from the interior void of the container from the first elongated opening; (c) closing the lid onto the base; and (d) lifting the strap by a centrally located strap handle, where a base member of the strap extends around the first handle and contacts an outboard surface of the first handle. The first acute angle may be between 1 degree and 55 degrees. A width of the first end portion may be greater than a width of the first elongated opening.

According to another aspect, a container is disclosed. The container may comprise a molded base that includes a sidewall structure having a first side, a second side opposite the first side, a third side extending between an edge of the first side and an edge of the second side, and a fourth side opposite the third side, the sidewall structure having a first end and a second end; a bottom portion connected to a first end of the sidewall structure and configured to support the container on a surface, and an opening formed at a second end of the sidewall structure, opposite the first end, the opening being configured to allow access to an interior void of the container formed by the sidewall structure and the bottom portion. The base may further include a latch keeper extending from the sidewall structure, where the latch keeper has an upper surface, an inner surface and a lower surface. The container may also include a lid that is pivotal between an open configuration and a closed configuration, where the lid has a shape corresponding to a shape of the base and is configured to cover the opening formed at the second end of the sidewall structure when the container is in the closed configuration. A hinge may be configured to connect the lid to the base where the lid is rotatable from the closed configuration to the open configuration. The container may further include a latch assembly, where the latch assembly having a locked position and an unlocked position.

The latch assembly may include a latch body that is pivotally engaged with the lid and where the latch body having at least one engagement lug. The latch assembly may further include a locking member that is slidably engaged with the latch body, where the locking member is slidable between at least a downward position and an upward position. The locking member may be configured to lock the lid in the closed configuration when the locking member is in the downward position and configured to unlock the lid when the locking member is in the upward position. Still the latch assembly further includes a biasing member engaged with the latch body and the locking member, where the biasing member biases the locking member in a downward position; and an activating member pivotally engaged with the latch body and engaged with the locking member, where the activating member configured to move the locking member from the downward position to the upward position. The latch assembly may only be moved from the unlocked position to the locked position when the locking member is in the upward position. Another aspect of the latch assembly is that the at least one engagement lug of the latch body may be engaged to the lower surface of latch keeper when the latch assembly is in the locked position; and that a hook portion of the locking member may engage the upper surface of the latch keeper when the latch assembly is in the locked position.

Other aspects of this disclosure may relate to the lid of the container being rotated from the closed configuration to the open configuration may include rotating the lid 90 degrees from the closed configuration. In addition, the latch keeper may further include a support rib that extends from an exterior surface of the base to the inner surface of the latch keeper, where the support rib may be centrally located relative to the upper surface of the latch keeper. The locking member may further comprise at least two hook portions, such that when the latch assembly is in the locked position, the support rib is positioned between the at least two hook portions of the locking member. The base may further comprise at least one ramped surface adjacent the latch keeper, such that the ramped surface extends downwardly at an angle away from an interface surface of the base. The at least one ramped surface forms an angle between 30 degrees and 60 degrees relative to the interface surface of the base. A gasket may be arranged in a recess formed in at least one of the base and the lid. As another feature, the base may further comprise a handle on each of the sides of the container, where each handle is integrally molded with the base. The handles may have a curved profile underneath an exterior surface of the handle, and wherein the curved profile is formed by a plurality of ribs extending from one of the sides of the sidewall structure to an interior surface of the handle.

Other aspects of this disclosure may relate to a container comprising: a base that includes a sidewall structure having at least a first side and a second side opposite the first side, the sidewall structure having a first end and a second end; a bottom portion connected to a first end of the sidewall structure and configured to support the container on a surface; and an opening formed at a second end of the sidewall structure, opposite the first end, the opening being configured to allow access to an interior void of the container formed by the sidewall structure and the bottom portion. The base may also include a latch keeper extending from the sidewall structure, the latch keeper having an upper surface, an inner surface and a lower surface. The container may also comprise a lid that is pivotal between an open configuration and a closed configuration, where the lid has a shape corresponding to a shape of the base and is configured to cover the opening formed at the second end of the sidewall structure when the container is in the closed configuration. A hinge may be configured to connect the lid to the base and about which the lid is rotatable from the closed configuration to the open configuration, and a latch assembly that has a locked position and an unlocked position. The latch assembly may comprise a latch body pivotally engaged with the lid, where the latch body has an at least one engagement lug, a locking member that is engaged with the latch body, where the locking member is movable between a downward position and an upward position. The locking member may be configured to lock the lid in the closed configuration when the locking member is in the downward position and configured to unlock the lid when the locking member is in the upward position. The latch assembly may also have a biasing member engaged with the latch body and the locking member, where the biasing member biases the locking member in a downward position; and an activating member pivotally engaged with the latch body and engaged with the locking member, where the activating member is configured to move the locking member from the downward position to the upward position.

Additional aspects of this disclosure may relate to a base portion of the container that includes a plurality of tabs positioned along interior surfaces of the interior void. Each tab of the plurality of tabs may extend from one of the interior surfaces and comprise an upper support surface and an opening, where the opening of each tab has an elongated shape. The upper support surface may be located in an upper region of the interior void of the base or at a height that is greater than fifty percent of a height of the interior void. In addition, the base may include a pair of tracks are positioned on at least an interior surface of at least one sidewall, where the pair of tracks are positioned on at least an interior surface of at least two sidewalls. Similarly, the lid may comprise a plurality of clips positioned along an interior surface of the lid, where each clip includes an engaging member and an elongated opening, where the elongated opening of each tab of the plurality of tabs may have substantially the same width as the elongated opening of each clip. The container may also have a gasket arranged in a recess formed in at least one of the base and the lid and a channel integrally molded with an exterior surface of the base, wherein the channel extends around an entire exterior surface of the base.

Still other aspects of this disclosure may relate to a container that includes a base having a sidewall structure with at least a first side and a second side opposite the first side, the sidewall structure having a first end and a second end, a bottom portion connected to a first end of the sidewall structure and configured to support the container on a surface; and an opening formed at a second end of the sidewall structure, opposite the first end, where the opening being allows access to an interior void of the container formed by the sidewall structure and the bottom portion. The container may also have a lid that is pivotal between an open configuration and a closed configuration, where the lid has a shape corresponding to a shape of the base and is configured to cover the opening formed at the second end of the sidewall structure when the container is in the closed configuration. The container may also include a latch assembly that has a locked position and an unlocked position, where the latch assembly includes a latch body pivotally engaged with the lid, a locking member engaged with the latch body, where the locking member is movable between a downward position and an upward position. The locking member is configured to lock the lid in the closed configuration when the locking member is in the downward position and configured to unlock the lid when the locking member is in the upward position. An activating member may be pivotally engaged with the latch body and also engaged with the locking member, where the activating member moves the locking member from the downward position to the upward position.

Other aspects of the container described within this disclosure may include the latch assembly having a biasing member engaged with the latch body and the locking member, where the biasing member biases the locking member in a downward position. The locking member may be slidable between the downward position and the upward position, where the latch assembly may only be moved from the unlocked position to the locked position when the locking member is in the upward position. The latch body may include an inner surface and at least one engagement lug, where the base includes a latch keeper that comprises an upper surface, an inner surface and a lower surface. The at least one engagement lug of the latch body may engage the lower surface of latch keeper when the latch assembly is in the locked position; and where a lower surface of a hook portion of the locking member engages the upper surface of the latch keeper when the latch assembly is in the locked position.

BRIEF DESCRIPTION OF THE DRAWINGS

The present invention is illustrated by way of example and not limited in the accompanying figures in which like reference numerals indicate similar elements and in which.

Further, it is to be understood that the drawings may represent the scale of different components of one single embodiment; however, the disclosed embodiments are not limited to that particular scale.

DETAILED DESCRIPTION

In the following description of various example structures according to the invention, reference is made to the accompanying drawings, which form a part hereof, and in which are shown by way of illustration various example devices, systems, and environments in which aspects of the invention may be practiced. It is to be understood that other specific arrangements of parts, example devices, systems, and environments may be utilized and structural and functional modifications may be made without departing from the scope of the present invention. Also, while the terms "top," "bottom," "front," "back," "side," "rear," and the like may be used in this specification to describe various example features and elements of the invention, these terms are used herein as a matter of convenience, e.g., based on the example orientations shown in the figures or the orientation during typical use. Additionally, the term "plurality," as used herein, indicates any number greater than one, either disjunctively or conjunctively, as necessary, up to an infinite number. Nothing in this specification should be construed as requiring a specific three dimensional orientation of structures in order to fall within the scope of this invention. Also, the reader is advised that the attached drawings are not necessarily drawn to scale.

In general, aspects of this invention relate to a containers and latching assemblies for containers. According to various aspects and embodiments, the containers and latching assemblies described herein may be formed of one or more of a variety of materials, such as metals (including metal alloys), polymers, and composites, and may be formed in one of a variety of configurations, without departing from the scope of the invention. It is understood that the containers and latching assemblies may contain components made of several different materials. Additionally, the components may be formed by various forming methods. For example, metal components, may be formed by forging, molding, casting, stamping, machining, and/or other known techniques. Additionally, polymer components, such as elastomers, can be manufactured by polymer processing techniques, such as various molding and casting techniques and/or other known techniques.

The various figures in this application illustrate examples of containers and latching assemblies according to this invention. When the same reference number appears in more than one drawing, that reference number is used consistently in this specification and the drawings refer to the same or similar parts throughout.

Figure 1A:
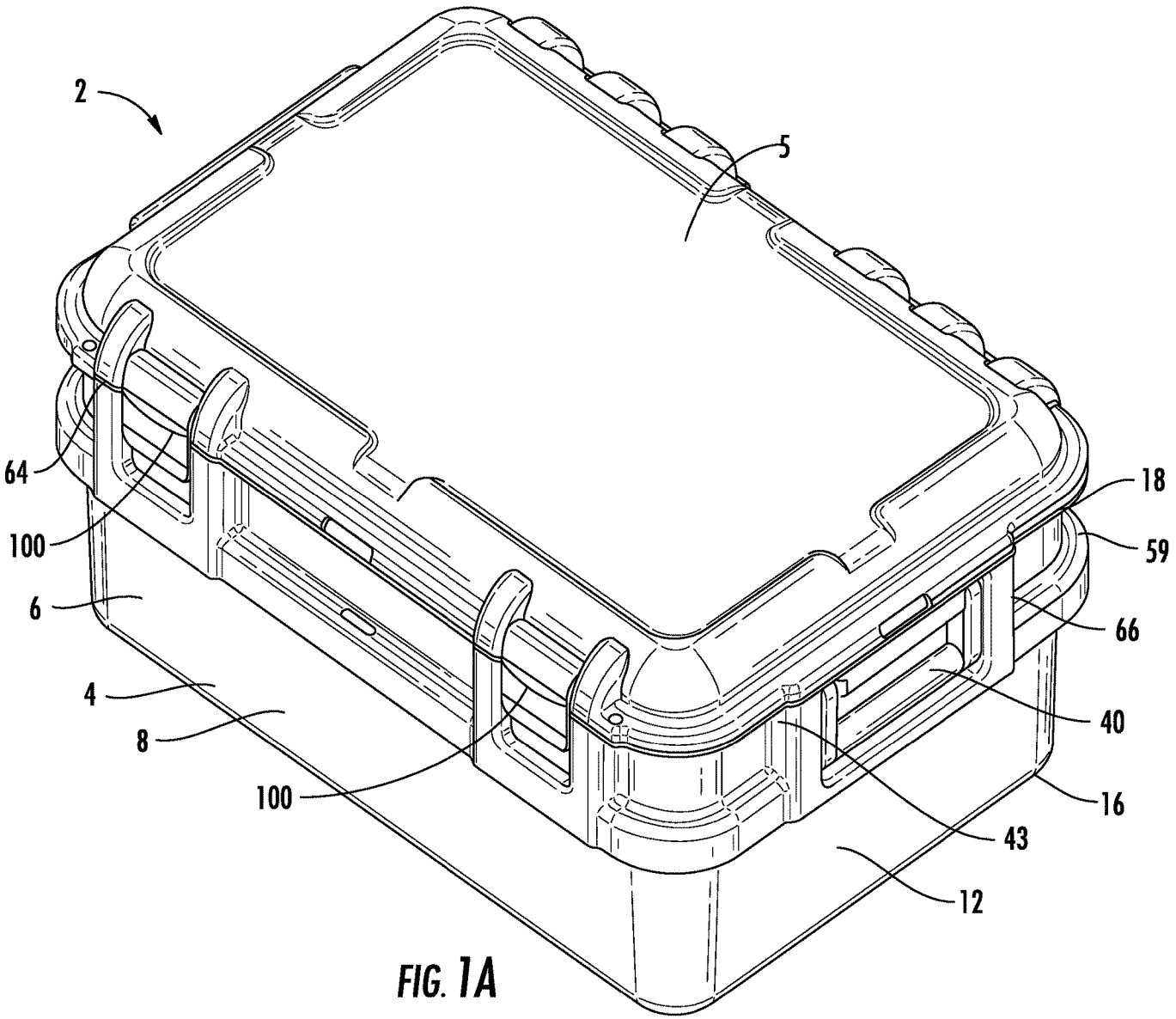
FIG. 1A is a top perspective view of a container according to one or more aspects described herein.
Figure 1B:
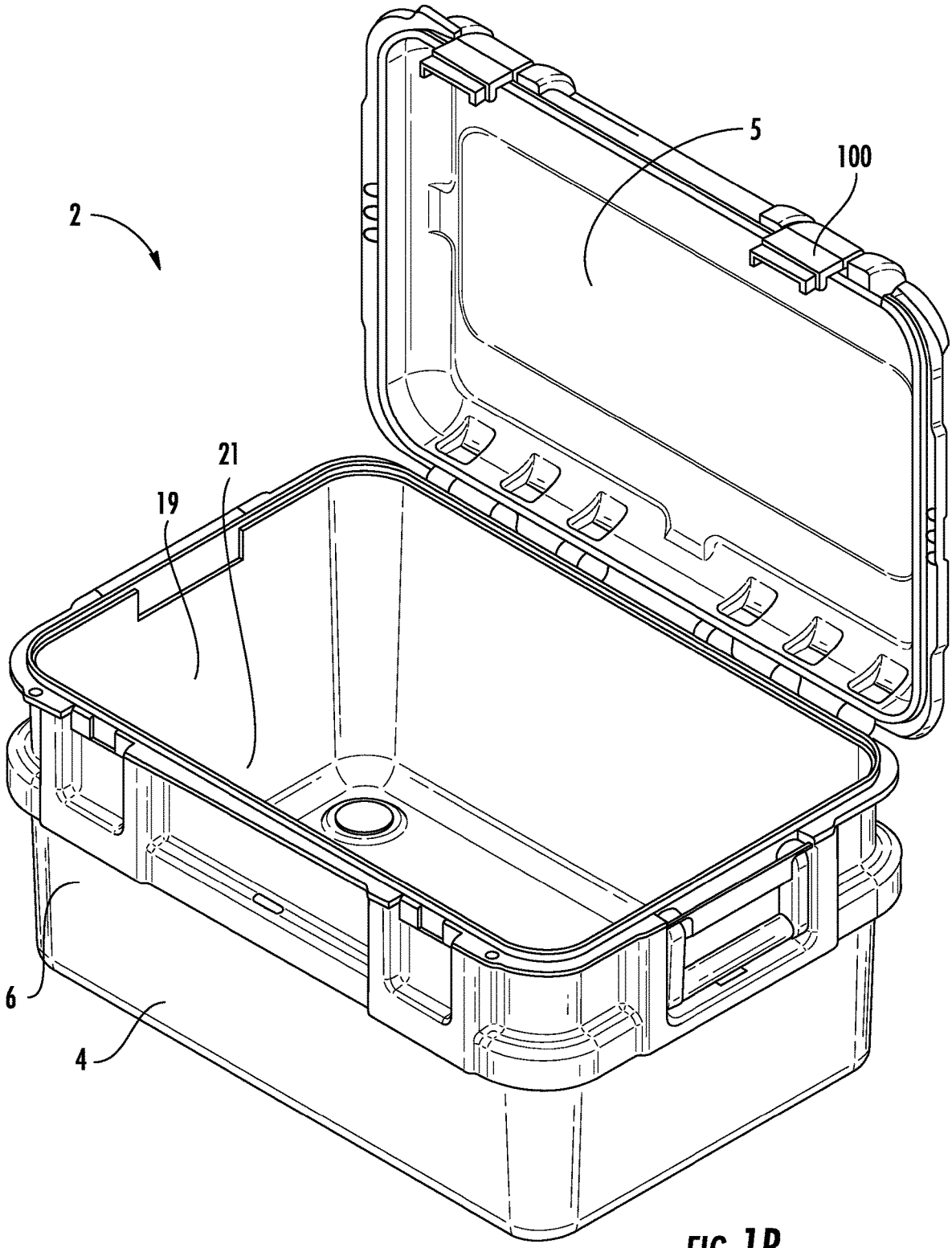
FIG. 1B is a top perspective view of the container of FIG. 1A with the lid in an open position according to one or more aspects described herein
Figure 2A:
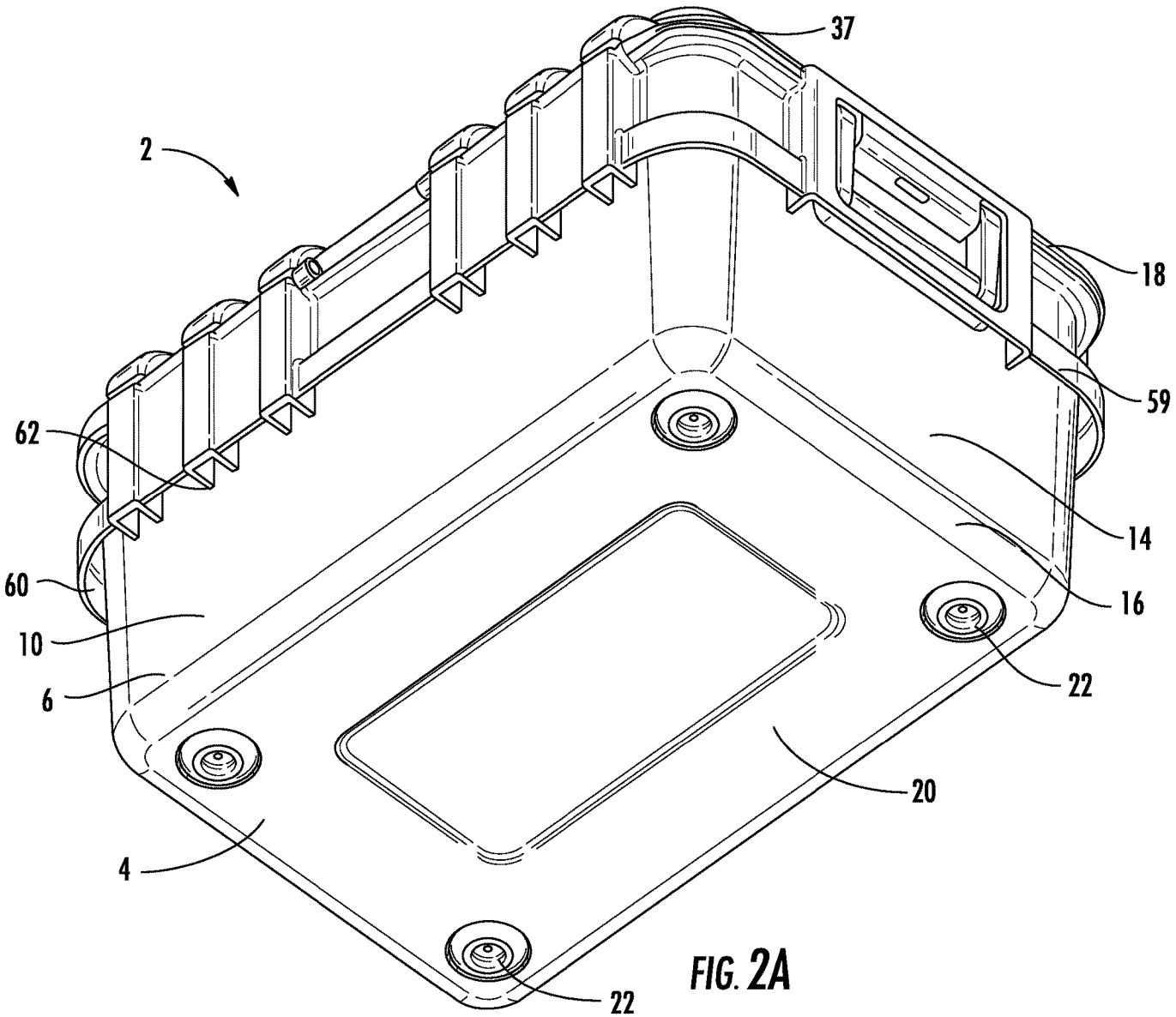
FIG. 2A is a bottom perspective view of the container of FIG. 1A according to one or more aspects described herein.
Figure 2B:
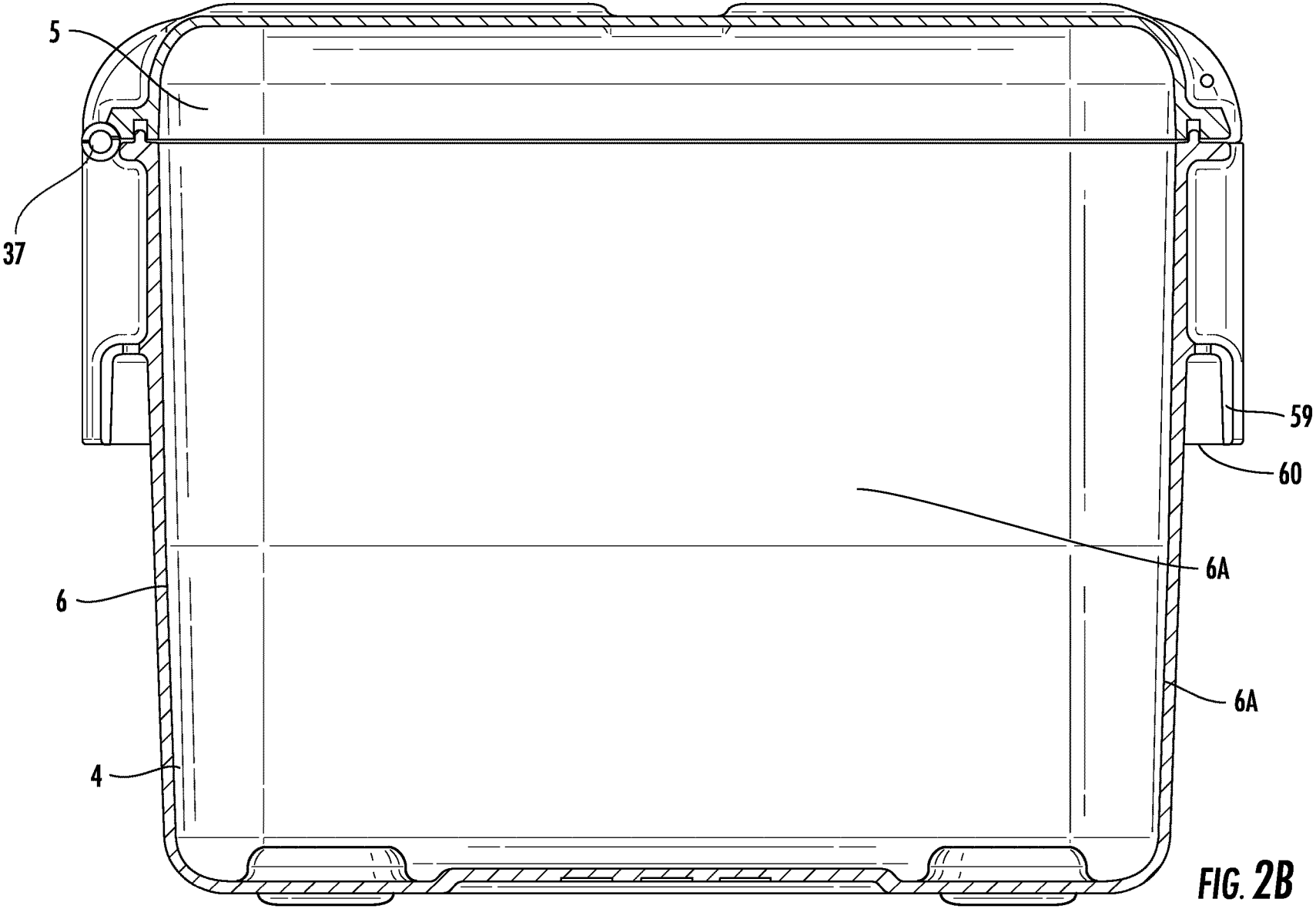
FIG. 2B is a side cross-sectional view of the container of FIG. 1A according to one or more aspects described herein.

FIGS. 1A, 1B, and 2A depict perspective views of a container 2. In one example, the container 2 may comprise a base portion 4 and a lid 5 that, in some examples, may be coupled, or in some examples may be non-destructively, removably coupled, thereto. The base portion 4 may be a structure forming a void for containing articles, as will be discussed more fully herein. In some examples, the base portion 4 may be cuboidal or substantially cuboidal in shape. In other examples, the base portion 4 may be prismoidal or substantially prismoidal (e.g., a pentagonal prism, hexagonal prism, heptagonal prism, or the like) in shape. In still other examples, the base portion 4 may be substantially cylindrical in shape or may have a substantially trapezoidal cross section. Various other shapes may be used without departing from the invention.

The base portion 4 may include a sidewall structure 6 having a first side 8, a second side 10 opposite the first side, a third side 12 extending between an edge of the first side and an edge of the second side, and a fourth side 14 opposite the third side. The sidewall structure 6 may also have a first end 16 and a second end 18. The sidewall structure 6 may also include a bottom portion 20 connected to a first end 16 of the sidewall structure 6 and configured to support the container on a surface such as a table, the ground, a vehicle bed, or the like. In some embodiments, the bottom portion 20 may also and/or alternatively include one or more feet 22 which may support the container 2 on a surface such as a table, the ground, a vehicle bed, or the like. The feet 22 may be integrally formed with the base 4 or may be attached to the base 4 after the base has been formed.

Figure 3:
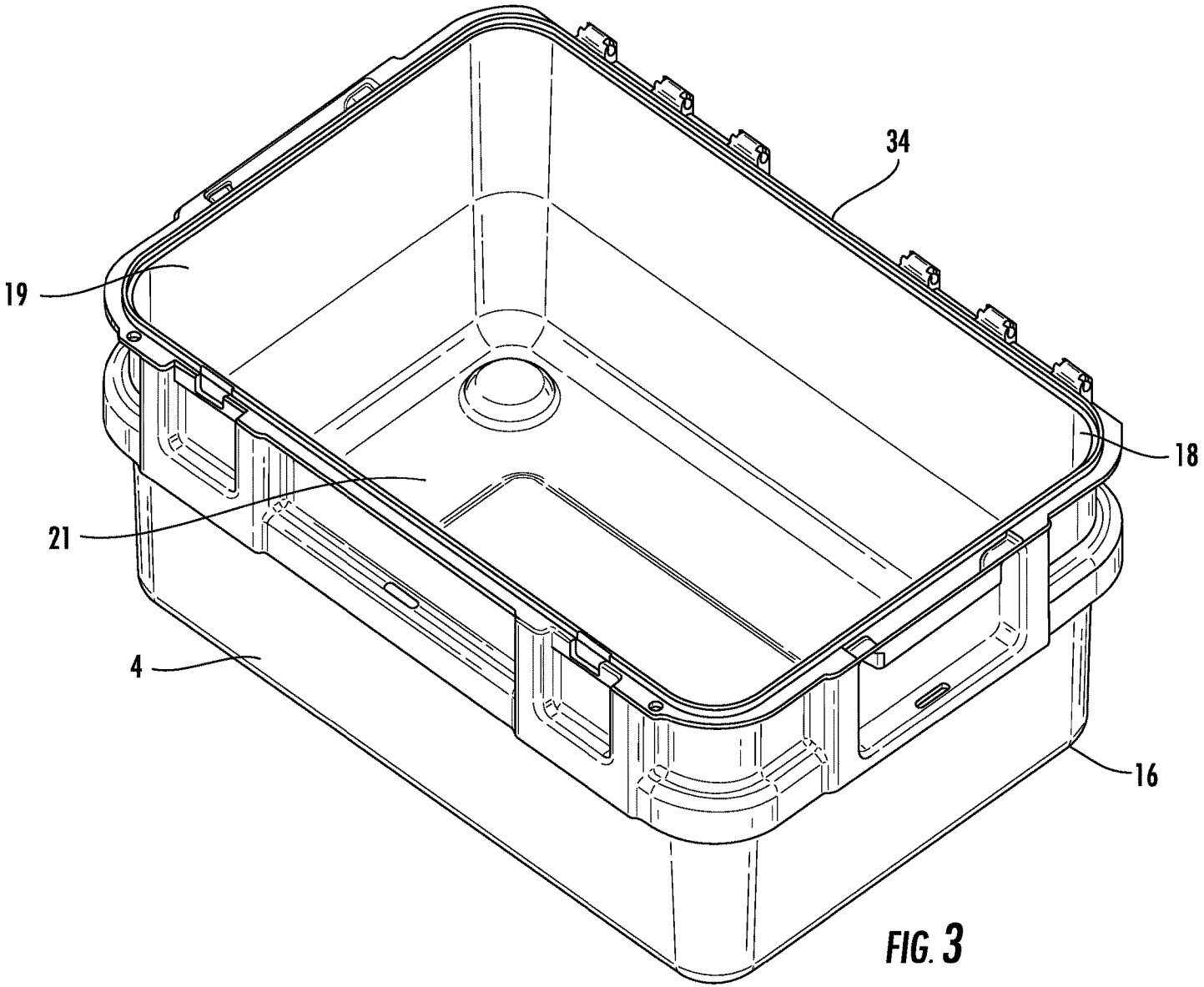
FIG. 3 is a top perspective view of the base portion of the container of FIG. 1A according to one or more aspects described herein.

The base portion 4 further includes a second end 18 defining an opening 19 (shown in FIG. 3). The opening 19 is configured to allow access to an interior void 21 of the container 2 formed by the sidewall structure 6 and the bottom portion 20.

The container 2 may include a lid 5. The lid 5 is pivotable between an open configuration and closed configuration. In some embodiments rotating the lid from the closed configuration to the open configuration includes rotating the lid about 90° from the closed configuration, or about 180° from the closed configuration, or about 270° from the closed configuration. As shown in FIG. 1, the opening 19 may be covered by lid 5, when the container is in use (e.g., when the container is in a closed configuration). In some arrangements, the lid 5 may connect to the base 4 in a closed configuration using a press fit. Additionally, or alternatively, other securing systems or devices may be used to secure the lid 5 to the base 4, as will be discussed more fully herein.

In some examples, the lid 5 may be hinged such that it is connected to (either removably or permanently) the base 4 at a hinge 37 and may be rotated about the hinge 37. The hinge 37 may be one of various types of hinges, including a continuous piano hinge, double hinge, ball joint hinge, living hinge, and the like. These and various other hinge arrangements may be discussed more fully herein. The hinge 37 may permit the lid 5 to be opened and rotated away from the base portion 4, to allow access to the void defined by the base portion 4 (e.g., via opening 19). That is, the hinge 37 may facilitate rotation of the lid 5 from a closed configuration of the container (e.g., when the lid is in place covering the void 21 formed by the base 4, as shown in FIG. 1A) to an open configuration (e.g., when the lid is not covering the void 21 formed by the base 4, as shown in FIG. 1B), and vice versa.

In addition, in some arrangements, the container 2 may include a gasket 30 or other sealing device. The gasket 30 may be arranged in either the lid 5 or the base 4 and may aid in sealing the lid 5 and base 4 when the lid 5 is in a closed configuration. For example, in one embodiment, the container 2 may be manufactured such that it is dust tight when tested for 8 hours and/or waterproof when tested for 30 minutes under 1 meter of water. In some embodiments, the container 2 may be capable of achieving an IP67 (as set forth by International Electrotechnical Commission) rating which specifies that there is no ingress of dust or complete protection from dust when tested for 8 hours and ingress of water in harmful quantities is not possible when the enclosure is immersed in water under defined conditions of pressure and time (up to 1 m of submersion). The IP67 dust test is 8 hours long and the enclosure is tested in a vacuum. The IP67 water test is 30 minutes long and the enclosure is tested with the lowest point of the enclosure 1000 mm below the surface of the water, or the highest point 150 mm below the surface whichever is deeper In some examples, (and as best shown in FIGS. 10A-11C) the gasket 30 may be seated in a recess 32 formed in at least one of the base 4 and the lid 5 and extending around a perimeter of the at least one of the base 4 or the lid 5. Additionally, in some example, the container 2 may include a ridge 34 in the opposite of the base 4 or the lid 5 and extending around a perimeter of the base 4 or the lid 5. The gasket 30 may be placed between the recess 32 and the ridge 34. The gasket 30 may aid in maintaining a seal between the interior of the container 2 and the outside environment, and in some examples may aid in maintaining the temperature of the articles contained within the container 2. One example gasket arrangement is shown in FIGS. 10A-11C, although this and various other gasket arrangements may be used with any of the containers described herein.

As shown, the gasket 30 is arranged in a recess or channel 32 in the lid 5. Alternatively, the gasket 30 may be arranged in a recess or channel formed in the base 4. When the lid 5 is in a closed configuration, the ridge 34 having a shape corresponding to recess 32 may contact the gasket 30 and compress the gasket 30 and aid in sealing the lid 5 and base 4 in the closed configuration. In some examples, the gasket 30 may be a traditional gasket having a substantially circular cross section. In other arrangements, the gasket 30 may include strategically placed cut-outs that may reduce or eliminate a need for a vent (e.g., a vent to prevent lid lock).

Figure 4B:
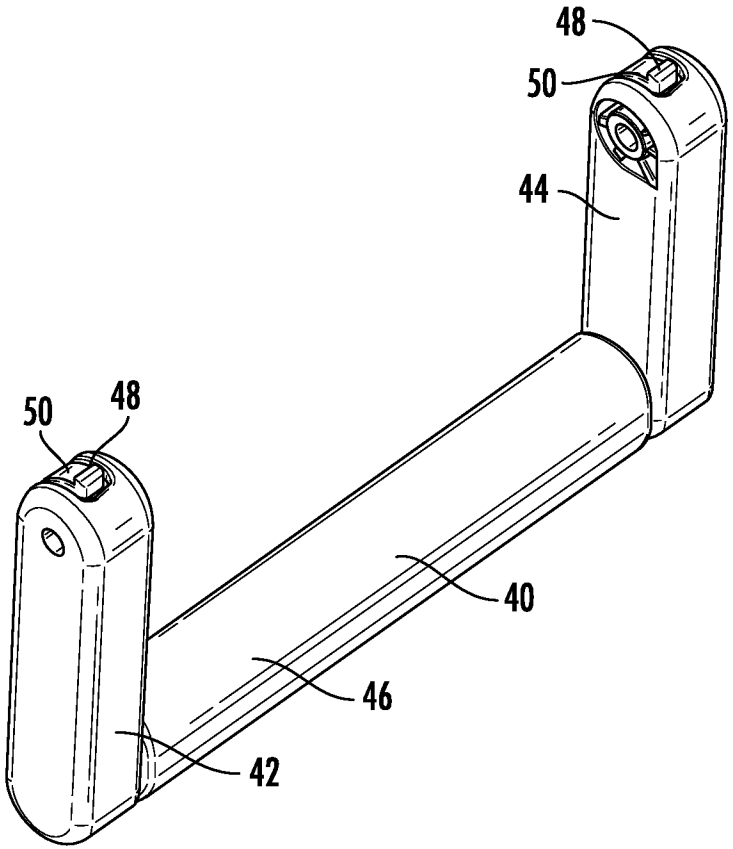
FIG. 4B is a top perspective view of a handle of the container of FIG. 1A according to one or more aspects described herein.
Figure 4A:
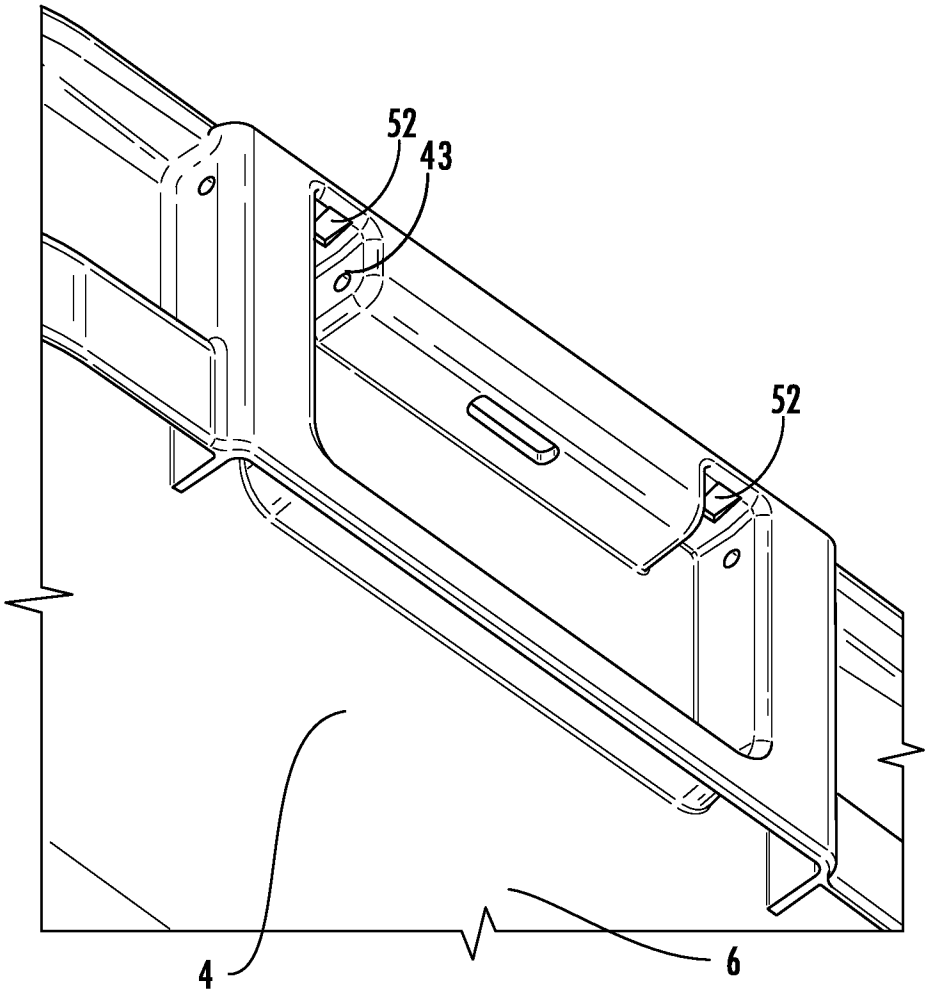
FIG. 4A is a bottom perspective view of a portion of the base portion of the container of FIG. 1A according to one or more aspects described herein.
Figure 4D:
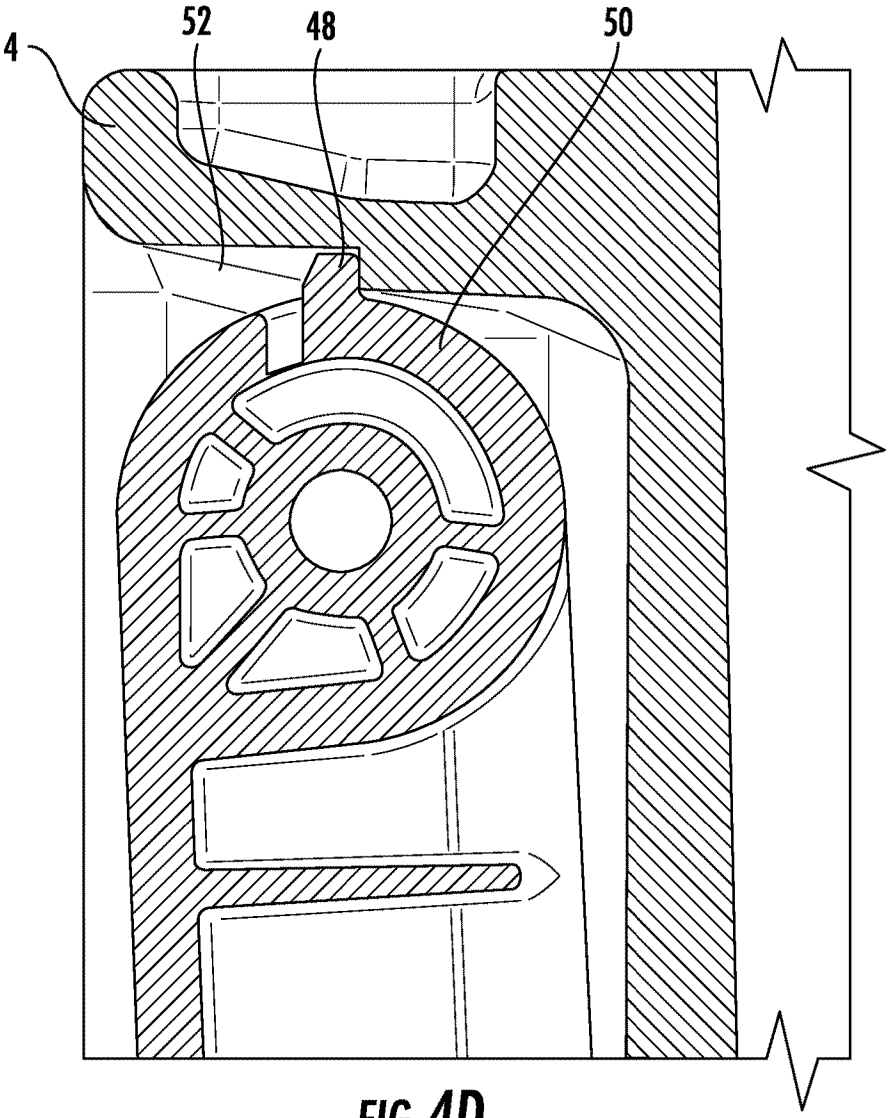
FIG. 4D is a side cross-sectional view of a portion of a handle and a container according to one or more aspects described herein.
Figure 4C:
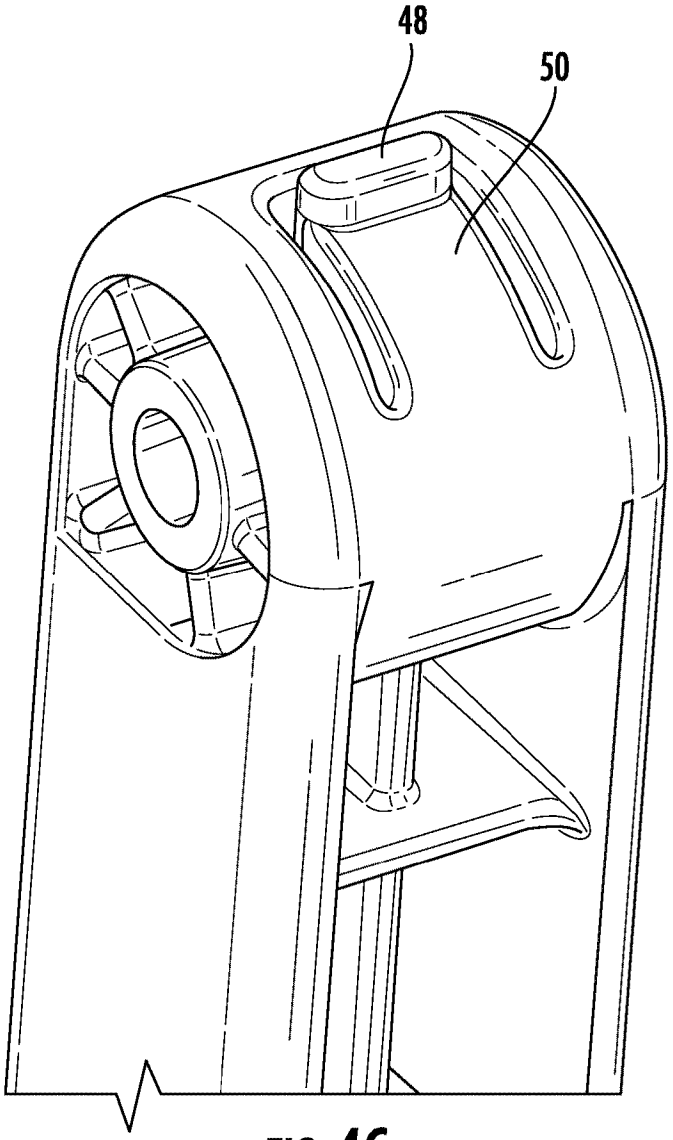
FIG. 4C is a top perspective view of portion of a handle according to one or more aspects described herein.

In some arrangements the container 2 may include additional features, such as one or more handles 40. The handles may be arranged on one or more portions of the sidewall structure 6, including on opposing sides, such as sides 12 and 14, as shown. As best shown in FIGS. 4A-4D the handles 40 may be constructed of first and second arms 42, 44 connected by a gripping member 46. The handle 40 may be pivotable about a hinge 43 passing through a portion of the sidewall structure 6 and through each of the first and second arms 42, 44. The handle 40 may also include features to reduce movement of, and possible rattling noise associated with, the handle when the handle is not in use. As shown in FIGS. 4A-4D, one or both of the arms 42, 44 may include a raised portion 48 at a distal end of the arm. In some embodiments the raised portion 48 may be attached to a resilient member 50. As best shown in FIGS. 4A and 4D, the container 2 may include a recessed portion 52. The raised portion 48 may be configured to be located within the recessed portion 52 of the sidewall structure 6 when the handle 40 is not in use. This may reduce movement of the handle 40 when the handle is not in use. However, when a user moves the handle 40 for use, the resilient member 50 may retract and allow the user to rotate the handle outward.

In other examples, as shown in FIGS. 14-16B and as will be discussed in more detail below, the handles 240 may be integrally molded with the base portion 204 and in some examples may generally be an undercut formed in the sidewall structure of the base 204. In some examples, the undercut forming the handle may include a recess extending along substantially all or a majority of the sidewall structure 6. This may provide ease of manufacturing the base 204 with the integrally molded handles 240. In some examples, the integrally molded handles 240 may be flush with an exterior surface of the base 204 in order to reduce the risk of breakage.

Figure 5B:
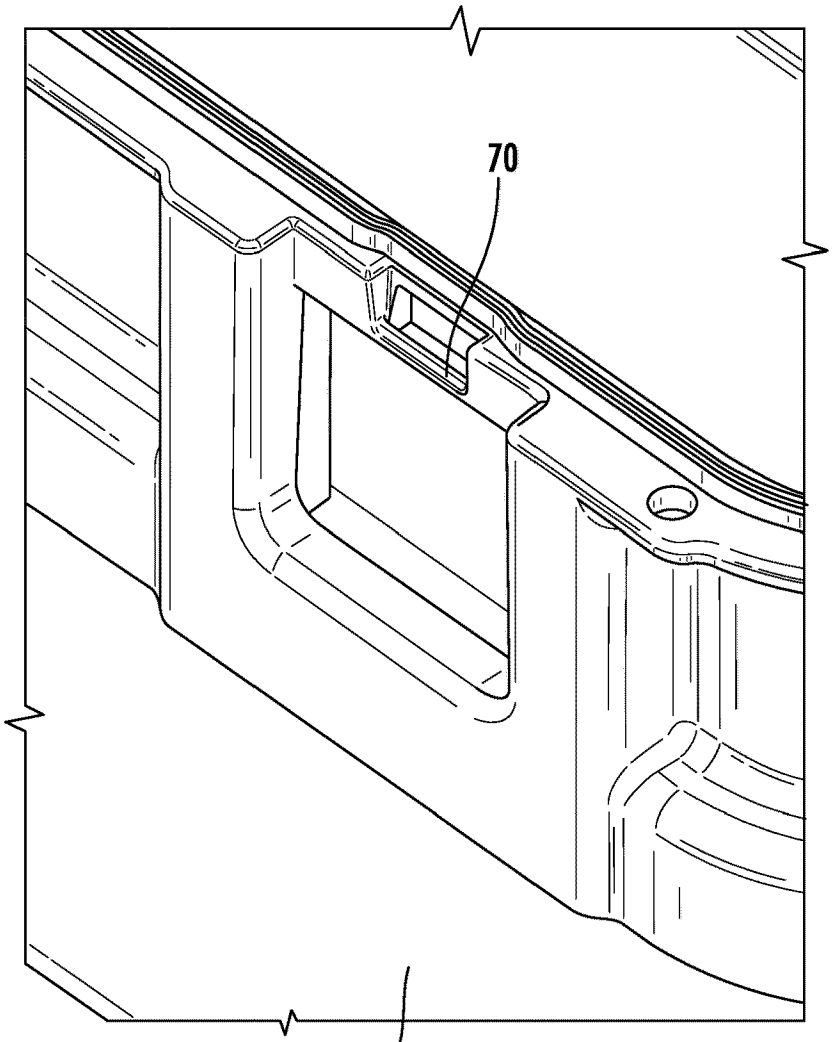
FIG. 5B is a top perspective view of a portion of the base portion of the container of FIG. 1A according to one or more aspects described herein.
Figure 5A:
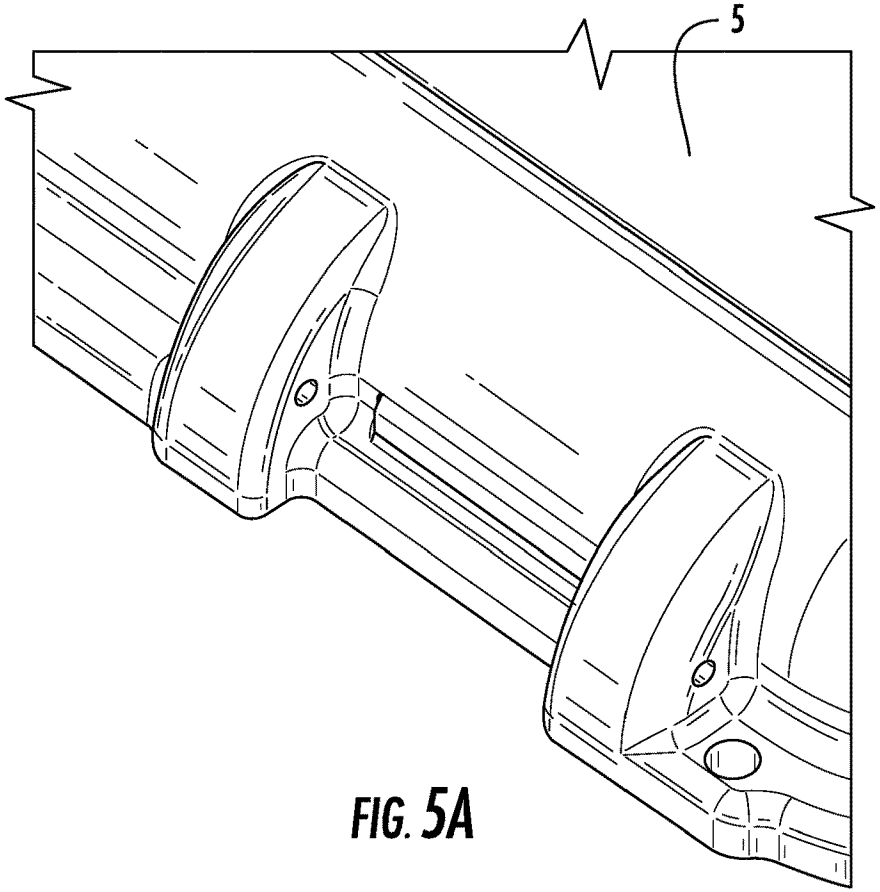
FIG. 5A is a top perspective view of a portion of the lid of the container of FIG. 1A according to one or more aspects described herein.
Figure 6B:
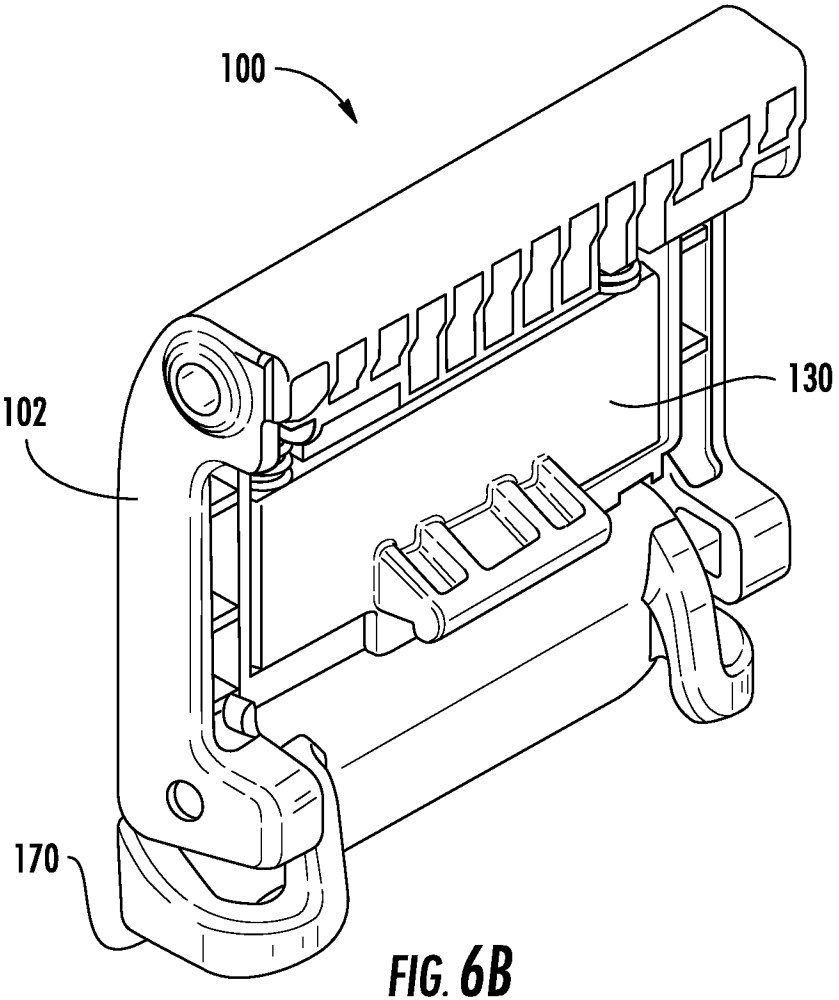
FIG. 6B is a top rear perspective view of a latch assembly according to one or more aspects described herein.
Figure 6A:
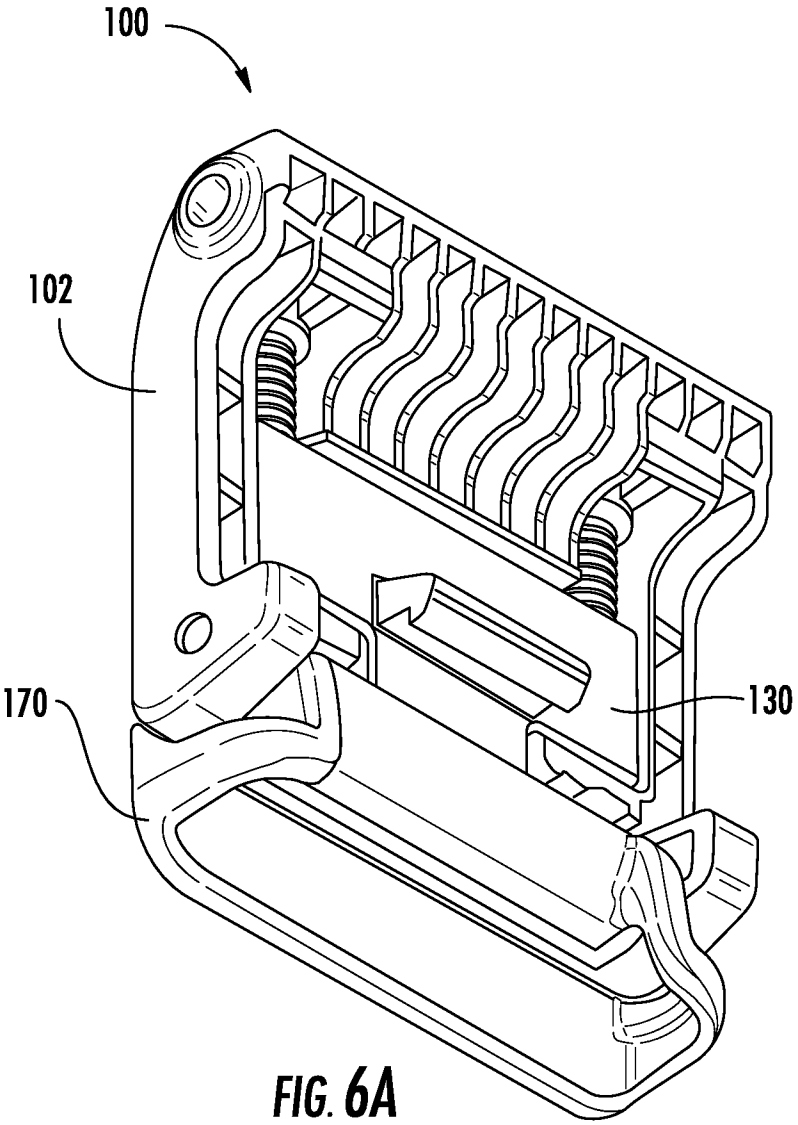
FIG. 6A is a bottom rear perspective view of a latch assembly according to one or more aspects described herein.
Figure 7B:
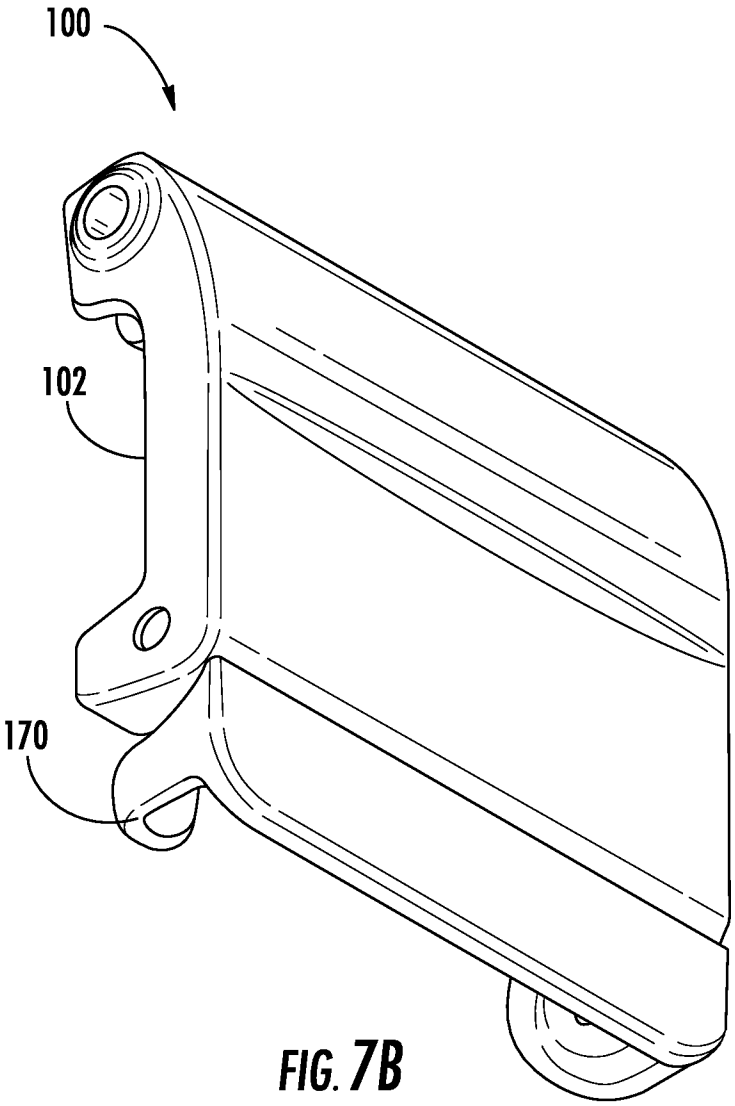
FIG. 7B is a bottom front perspective view of a latch assembly according to one or more aspects described herein.
Figure 7A:
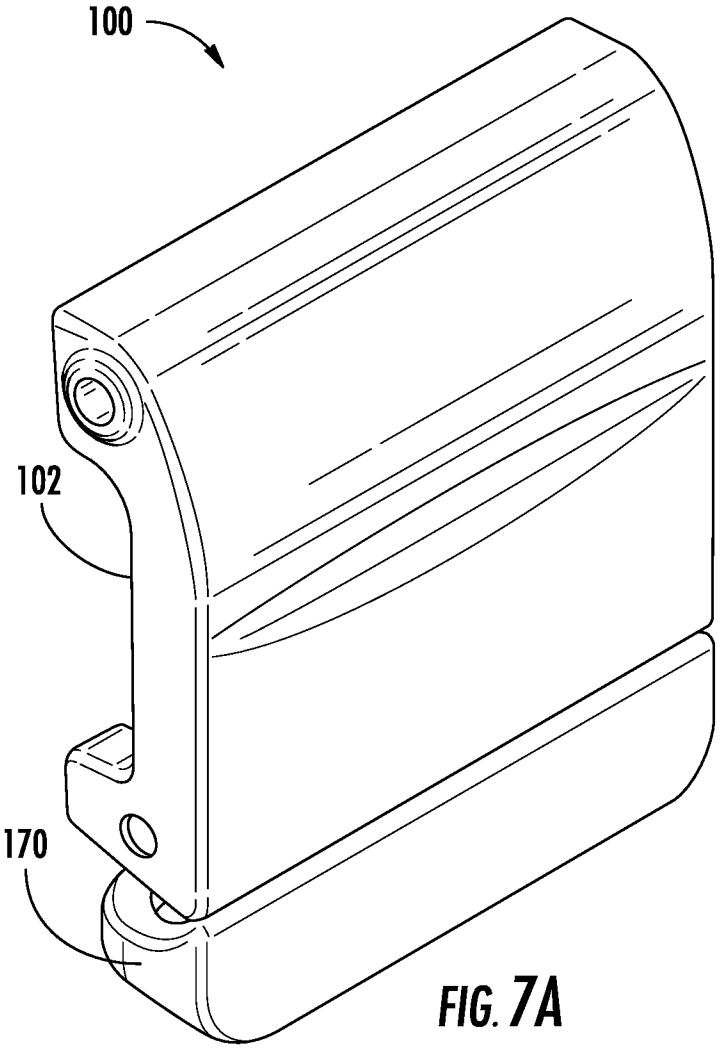
FIG. 7A is a top front perspective view of a latch assembly according to one or more aspects described herein.
Figure 9:
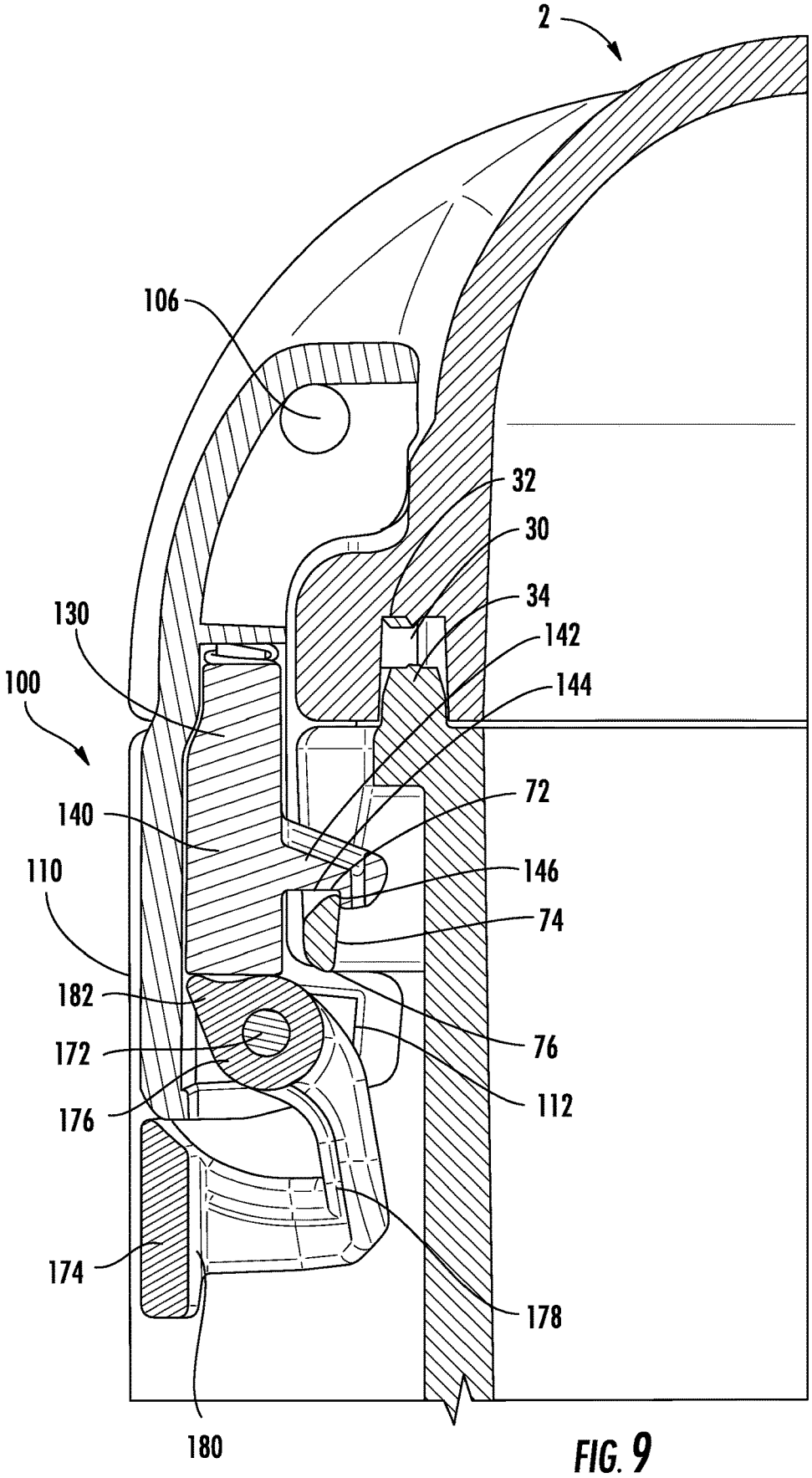
FIG. 9 is a side cross-sectional view of a latch assembly according to one or more aspects described herein.

In some arrangements, the container 2 may also include one or more latch assemblies 100. The latch assemblies 100 may have a locked position and an unlocked position and may be configured to lock the lid 5 when the lid 5 is in a closed configuration. The latch assemblies 100 may include one or more portions integrally formed with or otherwise attached to the container 2. As shown in FIGS. 5B and 9, the container 2 may include a latch keeper 70. The latch keeper 70 may extend from the sidewall structure 6 and may form a pocket within the container 2. The latch keeper 70 pocket has a shape configured to receive a portion of the locking member 130 as will be discussed in more detail below. The latch keeper may have an upper surface 72, an inner surface 74 and a lower surface 76. As will be discussed in greater detail below, the latch assemblies 100 may engage the latch keeper 70 to lock the lid 5 to the base 4 when the container 2 is in a closed configuration.

The container 2 may also include various features to improve the strength and/or functioning of the container 2. For example, the container may include various raised portions wherein certain portions of the base 4 and/or lid 5 extend further outward than other parts of the base 4 and/or lid. As best shown in FIGS. 1A, 1B, 2A, and 2B, the base 4 may include a J-shaped raised portion or wall 59 forming a channel 60, the raised wall 59 engaged with the sidewall structure 6. The channel 60 may surround the entire perimeter of the container 2. The channel 60 may also include strengthening members 62 at various locations within the channel. The channel 60 formed by the J-shaped wall 59 may increase the strength of the container 2, or the base 4. In some embodiments, and as shown for example in FIG. 2B, the J-shaped wall 59 may allow for the base 4 to be constructed such that the interior surfaces 6A of the sidewall structure 6 are substantially smooth throughout the interior portion of the container 2. Thus, for example, substantially all or all of the interior surface 6A of sidewall structure 6, including one or all of the first side 8, a second side 10 opposite the first side, a third side 12, may be substantially flat and/or smooth.

The container 2 may also include raised portions 64, 66 surrounding the latching assemblies 100 and handles 40 respectively. As shown in FIG. 4, the raised portions 64, 66 may exist on one or both of the base 4 or lid 5. The raised portions 64, 66 may be raised equal to or greater than the height of the latching assemblies 100 and handles 40 respectively, such that that latching assemblies 100 and/or handles 40 do not extend outward beyond the raised portions 64, 66 of the container 2. This may protect the latching assemblies 100 and/or handles 40 and reduce breakage of these components during use.

The container 2 may be configured to contain, store, carry, etc., items including food, beverages, or any other items. Additionally or alternatively, the container 2 may be configured to store materials in a solid or a gaseous state, or combinations thereof, without departing from the scope of the disclosure described herein.

The container 2 including the base 4 and lid 5 may be formed from various materials, such as one or more metals, alloys, polymers, ceramics, or fiber-reinforced materials. In some examples, the base 4 and lid 5 may be formed of a plastic material, such as polyethylene, that is molded to form both the base 4 and lid 5 portions. In some arrangements, the outer shells of the base 4 and lid 5 portions are formed using injection molding or roto-molding/rotational molding processes as would be understood by one of ordinary skill in the art (not shown). However, various other types of molding or other manufacturing processes (e.g., stamping, casting, forging, and the like) may be used to form the container 2 without departing from the invention.

In some arrangements herein, the base 4 and lid 5 may include an exterior surface or outer shell surrounding and enclosing an insulating portion (not shown), thus forming an insulating container. The outer shell may be typically formed from various materials, such as one or more metals, alloys, polymers, ceramics, or fiber-reinforced materials. In some examples, the outer shell may be formed of a plastic material, such as polyethylene, that is molded to form both the base 4 and lid 5 portions. In some examples, the insulating portion (not shown) may be formed of an insulating material that exhibits low thermal conductivity. For instance, the insulating portion may be formed of (or filled with) a polymer foam, such as polyurethane foam. Additional or other insulating materials may be used without departing from the invention, including for example, vacuum insulated panels. In some arrangements, the outer shells of the base 4 and lid 5 portions may be formed using an injection molding or roto-molding/rotational molding processes as would be understood by one of ordinary skill in the art (not shown). However, various other types of molding or other manufacturing processes (e.g., stamping, casting, forging, and the like) may be used to form the container without departing from the invention.

Figure 8:
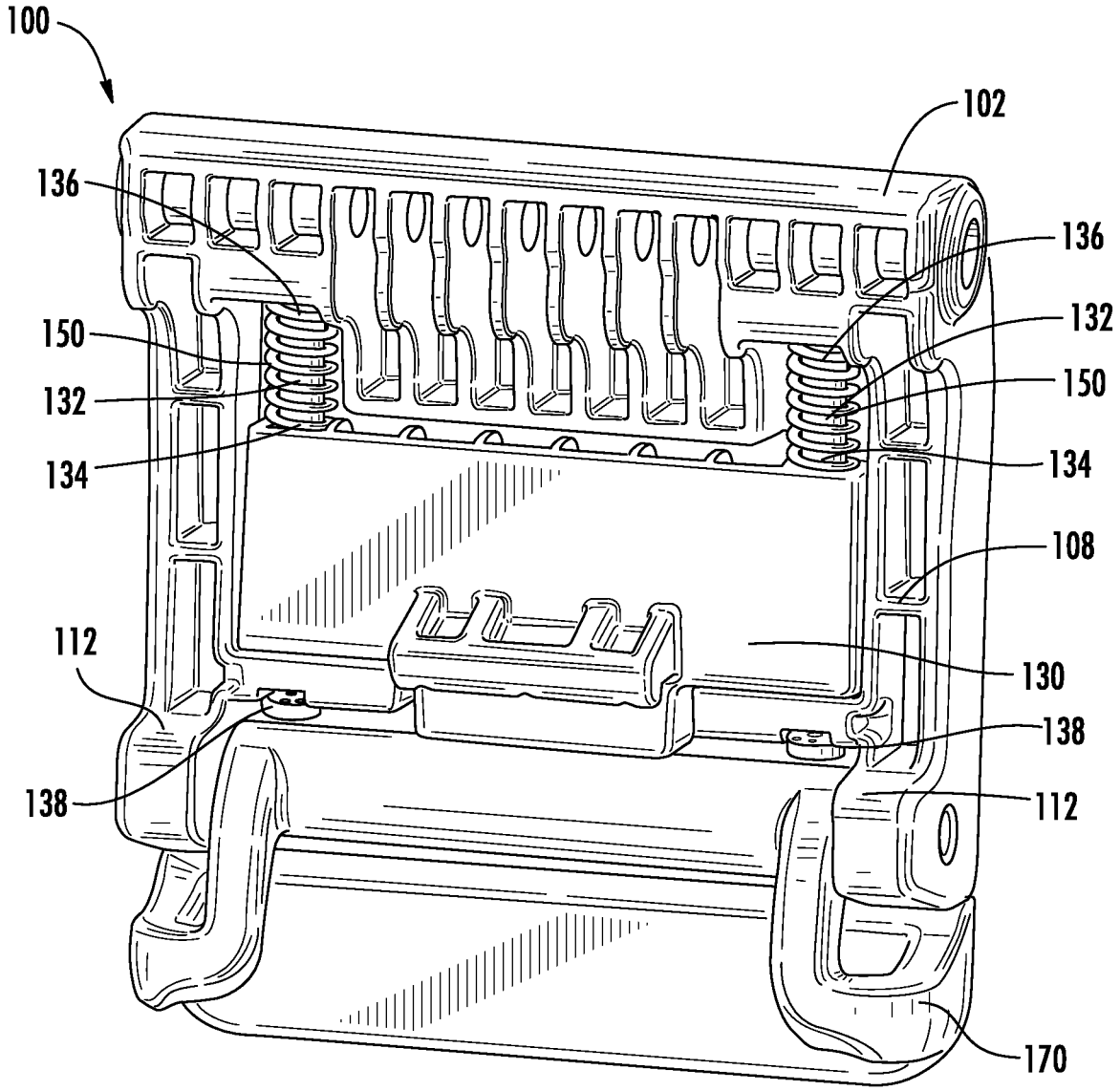
FIG. 8 is a rear perspective view of a latch assembly according to one or more aspects described herein.

Referring now more specifically to the latch assembly 100, as best shown in FIG. 8 and FIG. 9, the latch assembly 100 may include multiple components including a latch body 102, a locking member 130, a biasing member 150, and an activating member 170. As discussed above, the latch assembly 100 may include a locked position and an unlocked position.

The latch body 102 may be pivotally engaged with the lid 5. As shown in FIG. 9, the latch body may be pivotally engaged with the lid 5 using hinge 106, however, any suitable pivotal engagement may be used. In some embodiments, the hinge 106 may be removably engaged with the container 2. This hinge 106 may allow a user to easily remove and replace the latch assembly 100 if it becomes damaged. The latch body 102 may include an inner surface 108 and an outer surface 110. The outer surface may be curved and may generally follow the curve of the sidewall structure 6 of the container 2. As discussed above the outer surface 110 of the latch body 102 may, in some examples, not extend outward of the outer edge of the sidewall structure 6 of the container 2. The inner surface 108 may also be curved and may also include a number of different features. One exemplary feature that may be included on the latch body 102 may be one or more engagement lugs 112. As will be discussed in more detail below the engagement lugs 112 may engage the container base 4, or latch keeper 70, and may assist in compressing the lid 5 against the base 4 of the container 2.

The latch body 102 may also be engaged with the locking member 130. As shown in FIG. 8, the locking member 130 may be slidably engaged with the latch body 102 such that the locking member 130 may move between an upward position and a downward position in a substantially linear path. The locking member 130 may be configured to lock the lid 5 in a closed configuration when the locking member 130 is in the downward position and unlock the lid 5 when the locking member 130 is in the upward position.

As shown primarily in FIG. 8, the locking member 130 may be movably engaged with one or more guide members 132 such that the locking member 130 may slide up and down the guide members 132. In one embodiment, the locking member 130 may include apertures 134 passing through the locking member 130 and through which the guide members 132 may also pass. The guide members 132 may be engaged with the latch body 102 at a top end 136 and at a bottom end 138. As shown in FIG. 8 the guide members 132 are cylindrical rods but any suitable shape may be used that permits upward and downward movement of the locking member 130. For example, guide members 132 may be prismoidal or substantially prismoidal (e.g., a pentagonal prism, hexagonal prism, heptagonal prism, or the like) in shape. In still other examples, the latching assembly 100 may include other devices suitable for allowing generally linear movement between the locking member 130 and the latch body 102, including for example, rails.

As shown in FIG. 8, the latch assembly 100 may also include at least one biasing member 150 engaged with the latch body 102 and the locking member 130. As will be discussed in more detail below, the biasing member 150 is configured to bias the locking member 130 in a downward position. The biasing member 150 may be a compression spring as shown in FIG. 8, but may in alternative embodiments be any suitable device for biasing the locking member 130 in the downward position.

The locking member 130 may include a base portion 140 and a hook portion 142 extending inwards from the base portion 140. The hook portion 142 may include a lower surface 144 and an inward facing surface 146. As shown in FIG. 9, when the latch assembly 100 is in the locked position, the lower surface 144 of hook portion 142 of the locking member 130 may engage the upper surface 72 of the latch keeper 70 and the inward facing surface 146 of the hook portion 142 may engage the inner surface 74 of the latch keeper 70. Additionally, when the latch assembly 100 is in the locked position the upper surface of the engagement lugs 112 may engage the lower surface 76 of the latch keeper 70.

The latch body 102 may also be pivotally engaged with an activating member 170. The activating member 170 may also be engaged with the locking member 130 and may be configured to move the locking member 130 from the downward position to the upward position. As shown in FIGS. 8 and 9, the activating member 170 may be pivotally engaged to the latch body 102 by a hinge 172 extending through the latch body 102 and the activating member 170. The activating member 170 may include a grip portion 174, an activating barrel 176, and one or more arms 178 connecting the grip portion 174 and the activating barrel 176. As shown in FIG. 9, the grip portion 174 is spaced a distance from the sidewall structure 6 of the container 2. This distance may allow a user grip the back surface 180 of the grip portion 174 with their fingers placed between the sidewall structure 6 and the grip portion 174. As shown in FIG. 9, the activating barrel 176 of the activating member 170 may engage the locking member 130. The activating barrel 176 may include a raised portion 182. As will be discussed in greater detail below, a user may pull the grip portion 174 of the activating member 170 forward causing the raised portion 182 of the activating barrel 176 to rotate and lift up the locking member 130. This movement causes the latch assembly 100 to unlock and allows the lid 5 to be moved from the closed configuration to an open configuration.

Figure 10B:
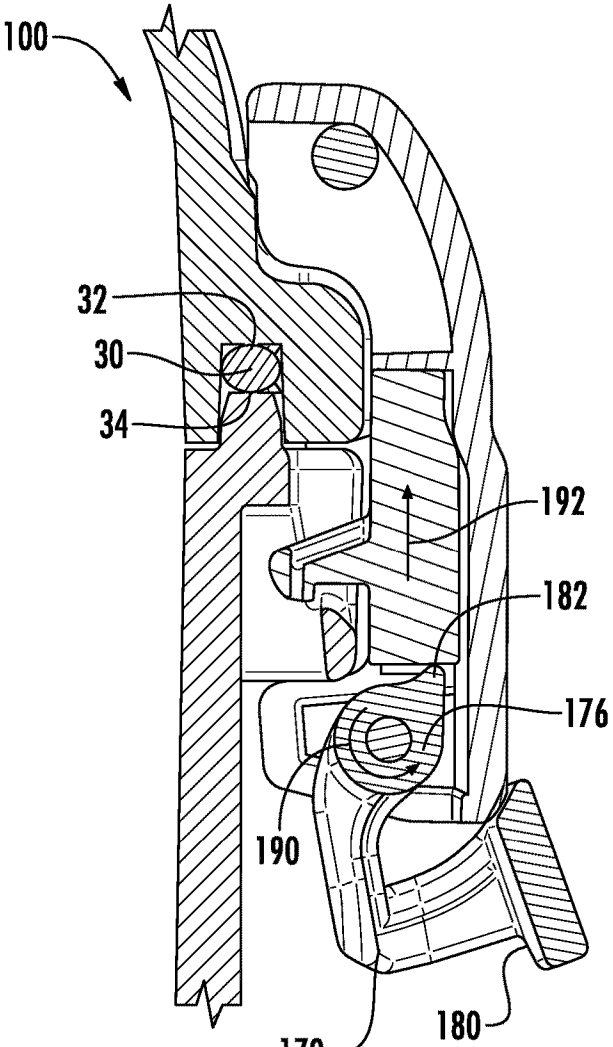
FIGS. 10A-10D illustrate side cross-sectional views of movement of a latch assembly from a locked position to an unlocked position according to one or more aspects described herein.
Figure 10A:
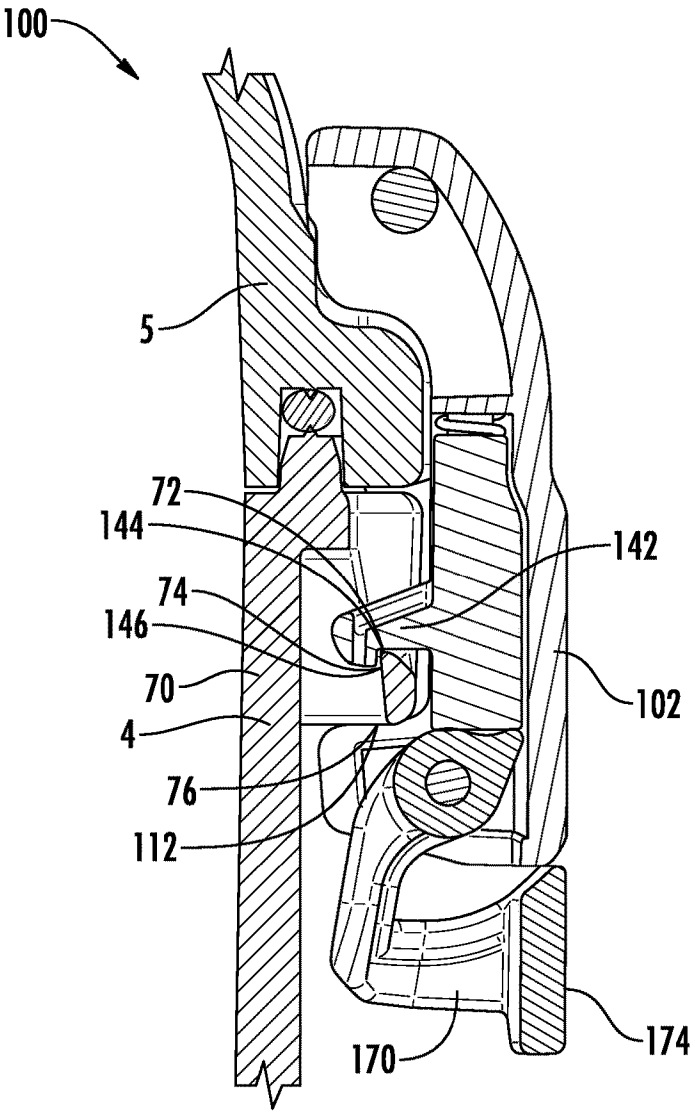
Figure 10D:
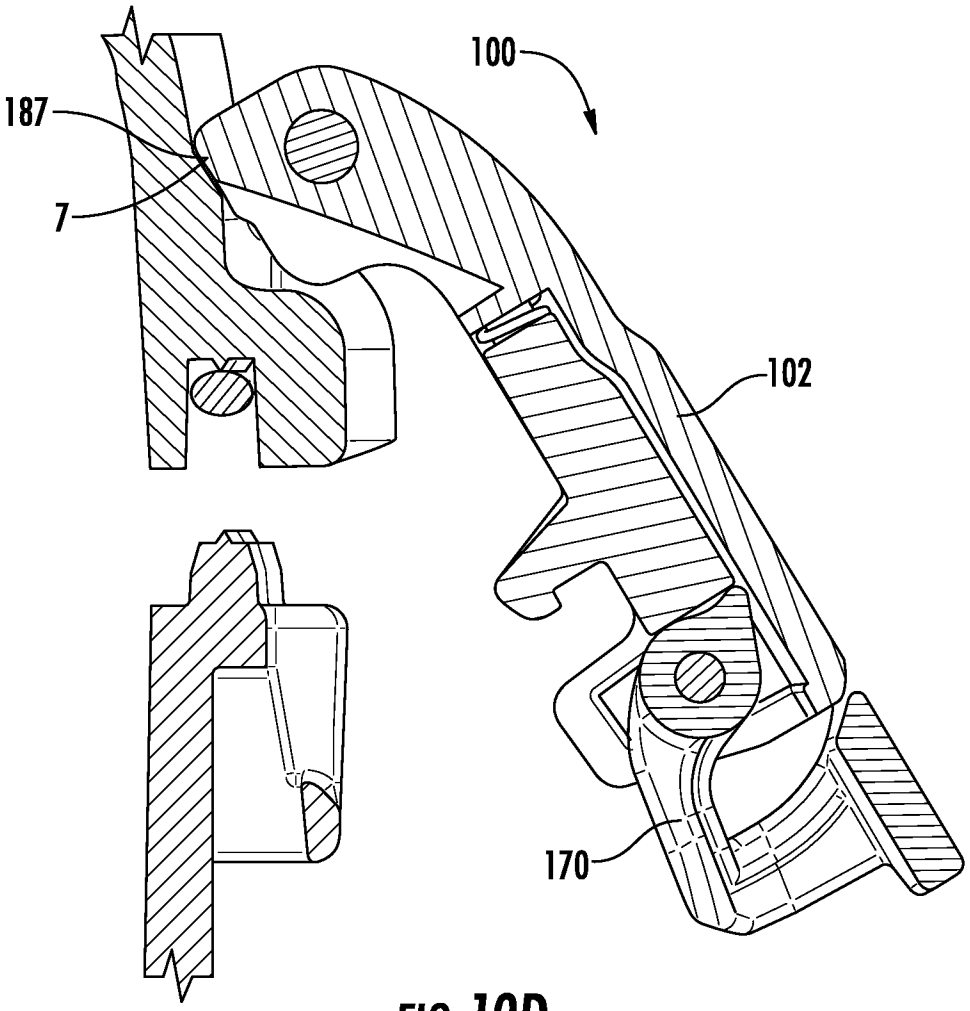
Figure 10C:
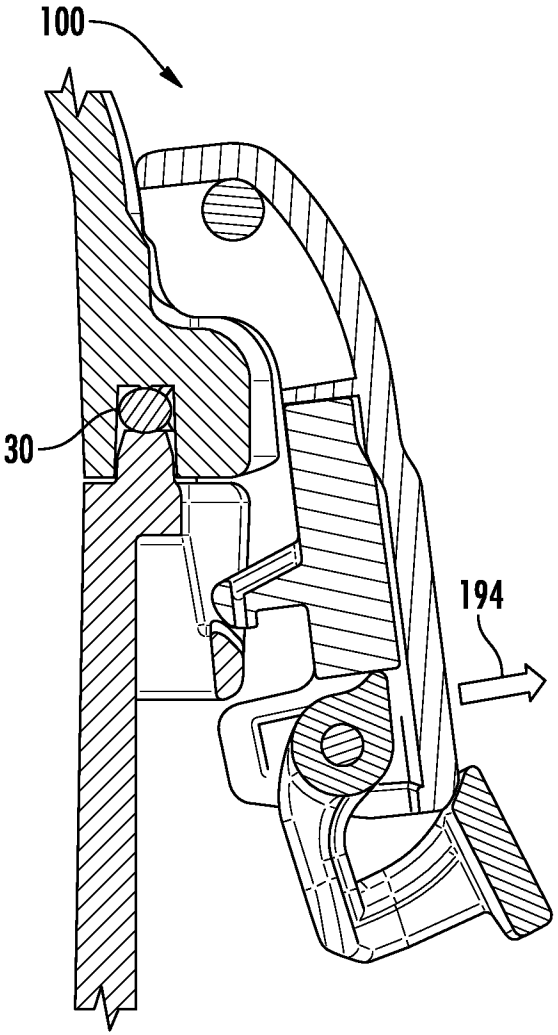

Referring now to FIGS. 10A-10D, a procedure for moving an embodiment of the latch assembly 100 from the locked position to an unlocked position is shown with side cross-sectional views of the latch assembly 100 and portions of the base 4 and lid 5. FIG. 10A depicts the latch assembly 100 in the locked position, FIG. 10B depicts the latch assembly 100 unlocking, FIG. 10C depicts the latch assembly 100 in an unlocked position, and FIG. 10D depicts the latch assembly 100 in an unlocked position and demonstrates an anti-rotation feature. As shown in FIG. 10A, in the locked position, the lower surface 144 of hook portion 142 is engaged with the upper surface 72 of the latch keeper 70; the inward facing surface 146 of the hook portion 142 is engaged with the inner surface 74 of the latch keeper 70; and the engagement lugs 112 are engaged with the lower surface 76 of the latch keeper 70.

As shown in FIG. 10B, the latching assembly 100 may be moved to the unlocked position by rotating the activating member 170 as shown with arrow 190. This rotation may be accomplished by a user pulling forward on back surface 180. As shown in FIG. 10B, as the activating barrel 176 rotates, the raised portion 182 engages the locking member 130 and raises the locking member 130. As shown in FIG. 10C, the latching assembly 100 is in an unlocked position. As the locking member 130 raises above latch keeper 70, the latch assembly 100 becomes unlocked and the latch body 102, including the locking member 130 and the activating member 170, may rotate forward as indicated by arrow 194.

FIG. 10D depicts an anti-rotation feature of the latch assembly 100 and container 2. As shown in FIG. 10D the latch assembly 100 is in the unlocked position and has been rotated further outward from the position shown in FIG. 10C. To restrict the rotation of the latch assembly 100, the latch body 102 may include a back surface 187 configured to engage an anti-rotation surface 7 of the lid once a user has rotated the latch assembly 100 a certain rotation away from the locked position. For example, the back surface 187 may be configured to engage the anti-rotation surface 7 when a user has rotated the latch assembly 100 at least 20 degrees from the locked position, or at least 30 degrees from the locked position, or at least 45 degrees from the locked position, or at least 90 degrees from the locked position. Advantageously this anti-rotation feature may also allow a user to utilize the latch assembly 100 as a handle to open the container 2.

Figure 11C:
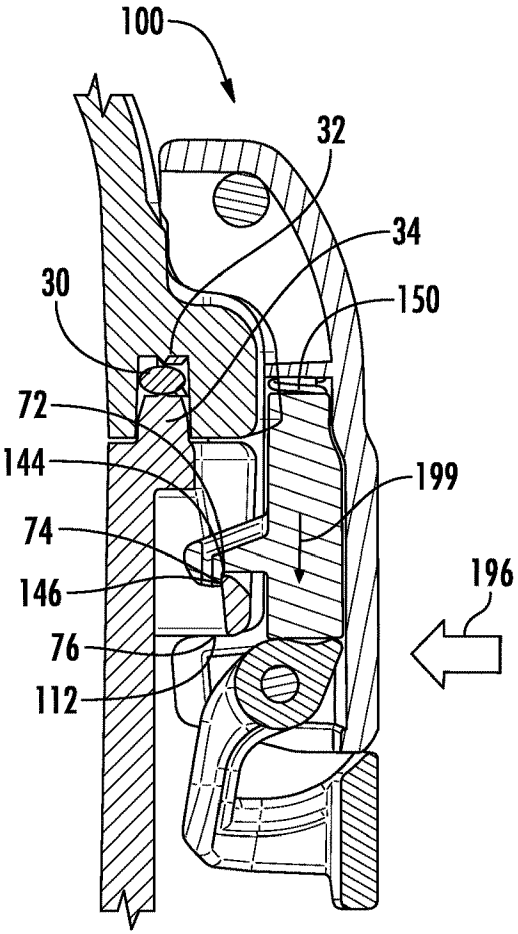
FIGS. 11A-11C illustrate side cross-sectional views of movement of the latch assembly of FIGS. 10A-10D from an unlocked position to a locked position according to one or more aspects described herein.
Figure 11B:
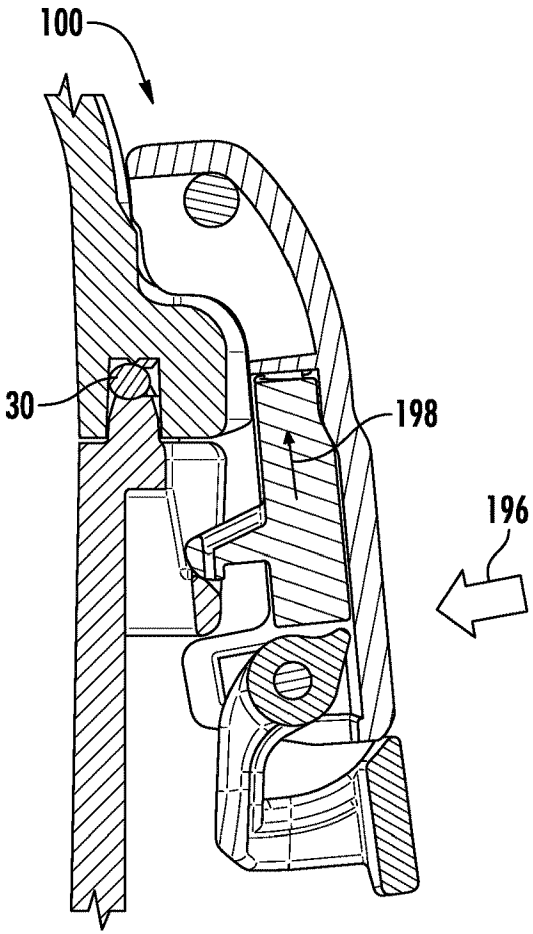
Figure 11A:
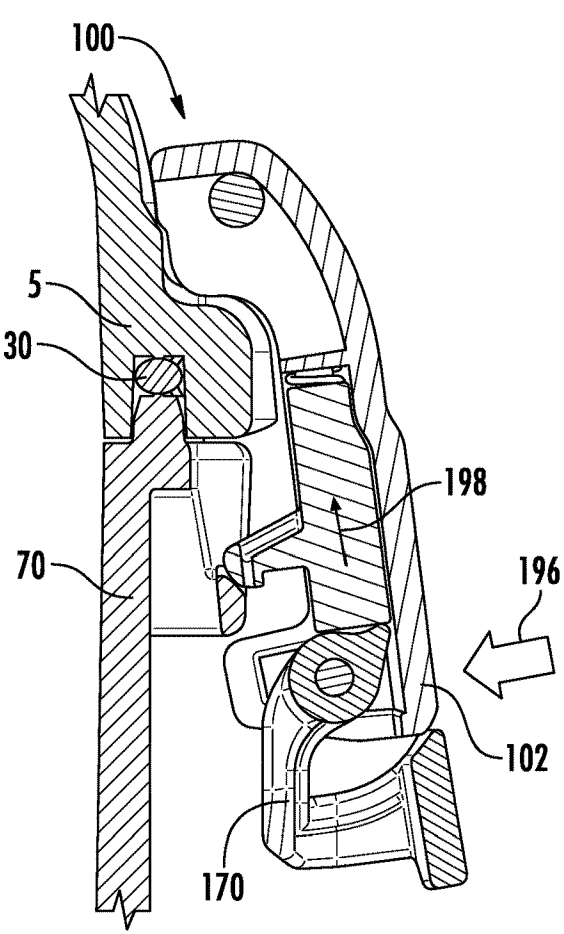

Referring now to FIGS. 11A-11C, a procedure for moving the latch assembly 100 from an unlocked position to locked position is shown with side cross-sectional views of the latch assembly 100 and portions of the base 4 and lid 5. FIG. 11A depicts the latch assembly 100 in an unlocked position, FIG. 11B depicts the latch assembly 100 locking, and FIG. 11C depicts the latch assembly 100 in locked position.

As shown in FIG. 11A, and as indicated by arrow 196, in one embodiment a user may return the latching assembly 100 to the locked position by pressing on latch body 102. As shown in FIG. 11B, as the latch body 102 is pressed inward, the locking member 130 may contact the latch keeper 70 which may cause the locking member 130 to raise upward as indicated by arrow 198. In other examples, in addition to pushing the latch body 102 inward, a user must also pull activating member 170 outward to move the latch assembly 100 to the locked position. In such an embodiment, the latch assembly 100 may advantageously only be moved from the unlocked position to the locked position when the locking member 130 is moved in the upward position by the activating member 170. This may reduce the possibility of accidently locking the container 2.

As shown in FIG. 11C, once the hook portion 142 has moved behind the raised portion of the latch keeper 70, the biasing members 150 may push the locking member 130 in a downward direction. As shown in FIG. 11C, the latch assembly 100 is in the locked position and the lower surface 144 of hook portion 142 is engaged with the upper surface 72 of the latch keeper 70; the inward facing surface 146 of the hook portion 142 is engaged with the inner surface 74 of the latch keeper 70; and the engagement lugs 112 are engaged with the lower surface 76 of the latch keeper 70. When in a closed position, the latching assembly 100 is positioned such that the lid 5 abuts the base 4 of the container 2, thus closing, securing, and/or sealing the container 2. Additionally, as the latch assembly moves from the unlocked position (FIG. 11A) to the locked position (FIG. 11C) the gasket 30 is compressed between the lid 5 and the base 4 of the container 2. Thus, when the latch assembly 100 is in a locked position the gasket 30 is more compressed than when the latch assembly 100 is in an unlocked position.

Figure 12C:
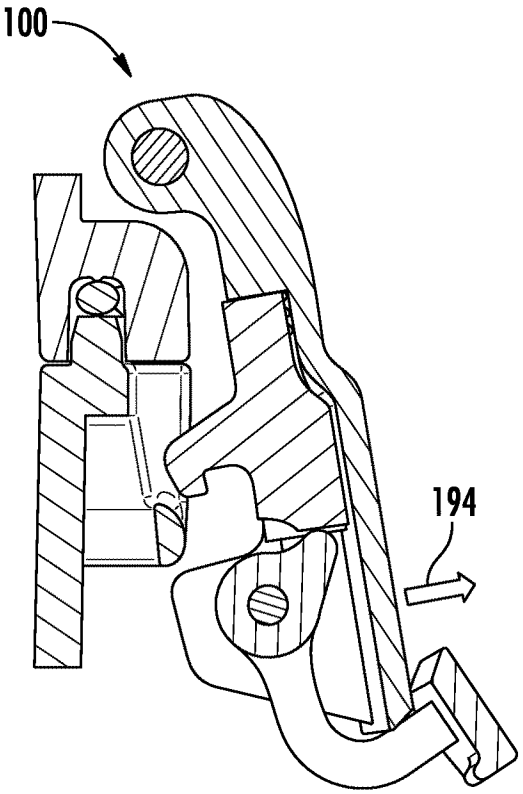
FIGS. 12A-12C illustrate side cross-sectional views of movement of a latch assembly from a locked position to an unlocked position according to one or more aspects described herein.
Figure 12B:
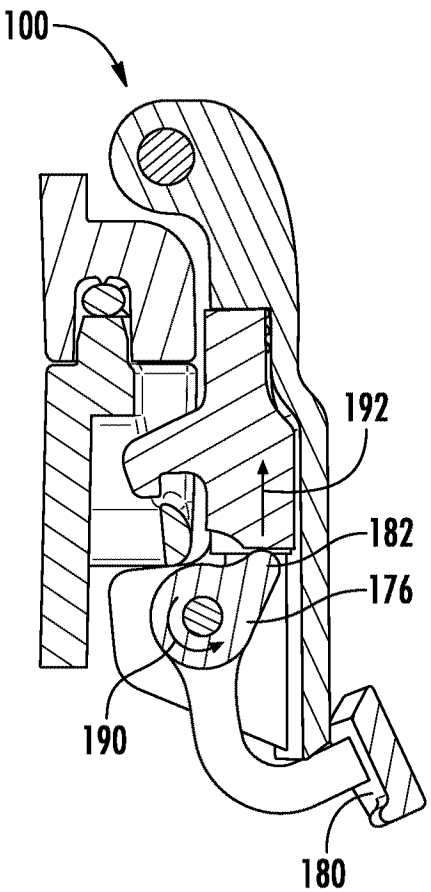
Figure 12A:
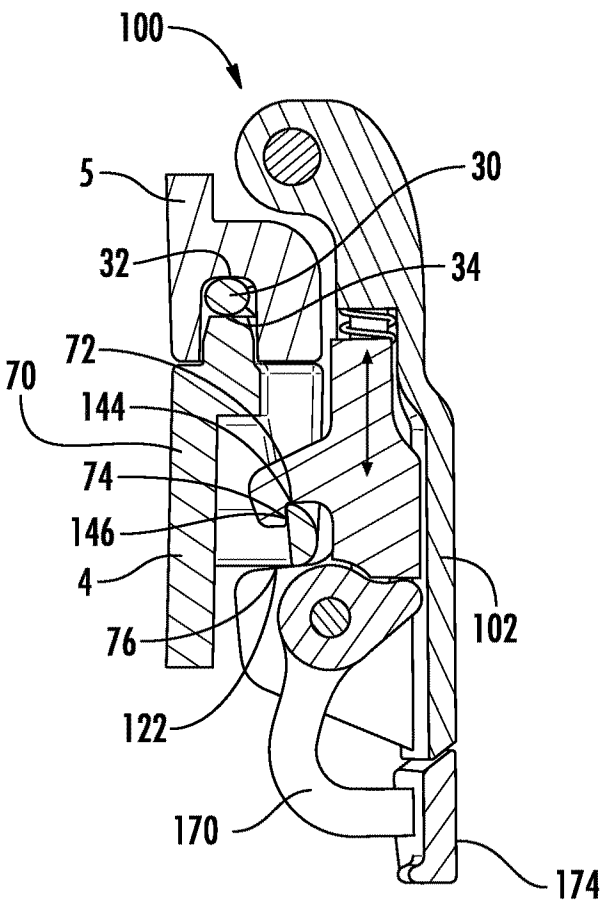
Figure 13C:
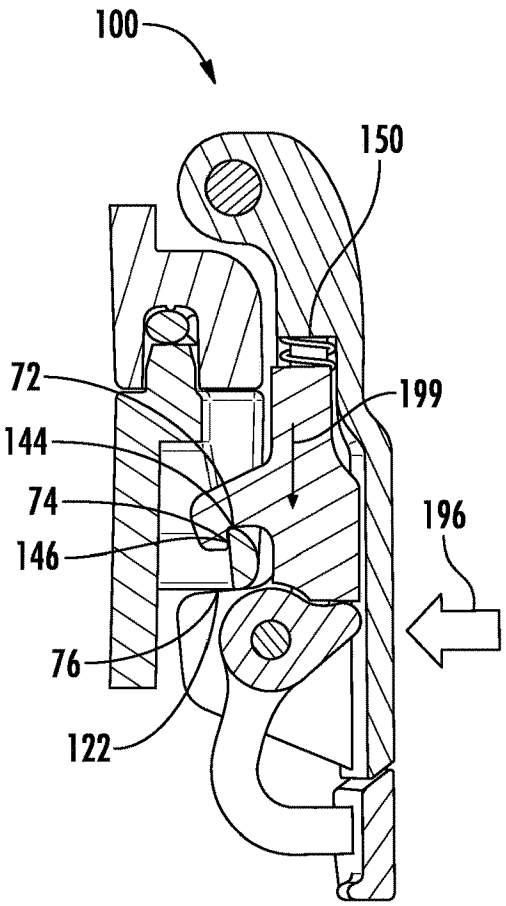
FIGS. 13A-13C illustrate side cross-sectional views of movement of the latch assembly of FIGS. 13A-13C from an unlocked position to a locked position according to one or more aspects described herein.
Figure 13B:
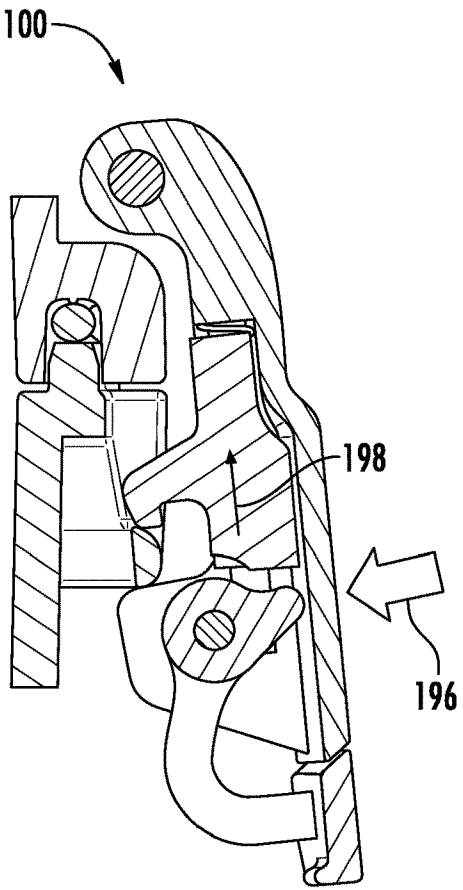
Figure 13A:
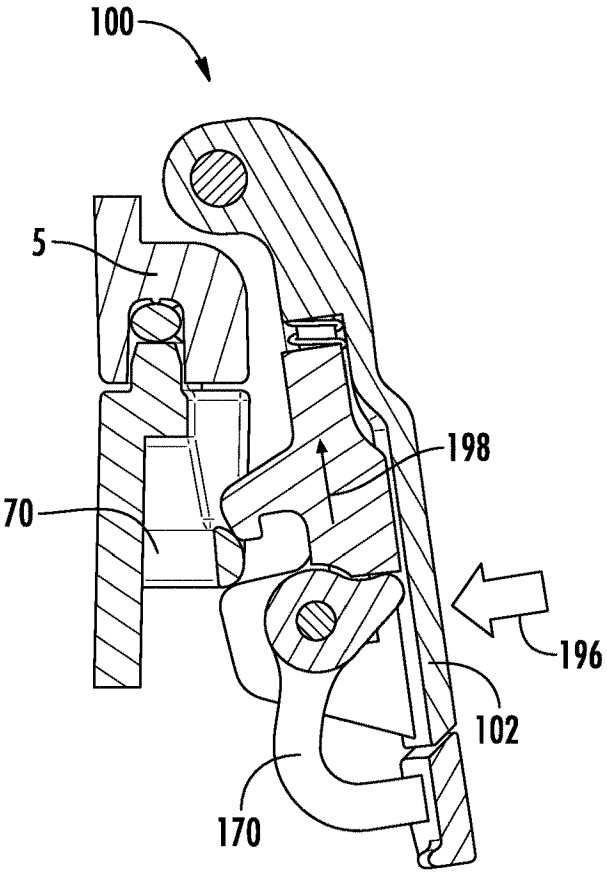
Figure 14:
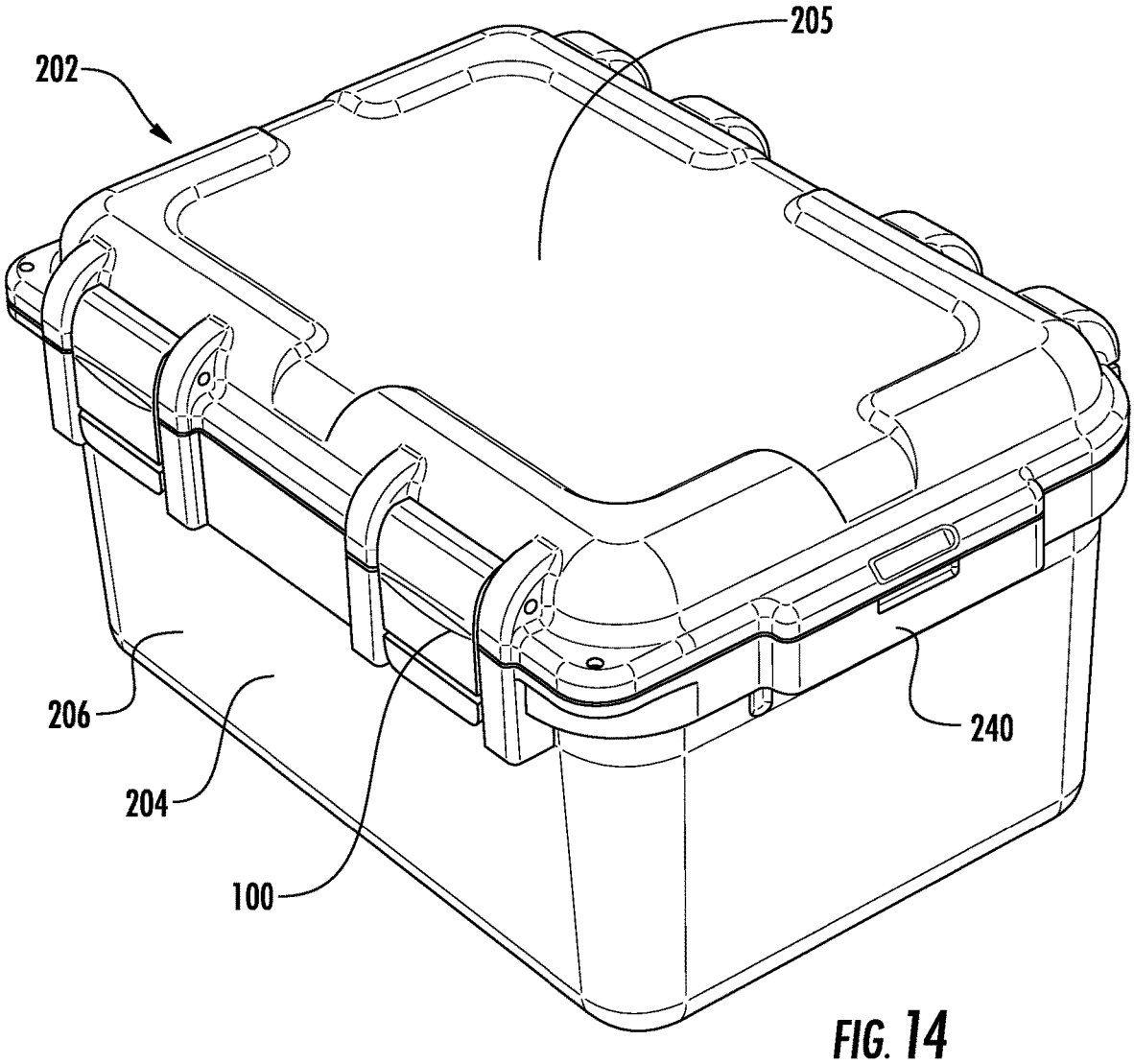
FIG. 14 is a top perspective view of a container according to one or more aspects described herein.
Figure 15:
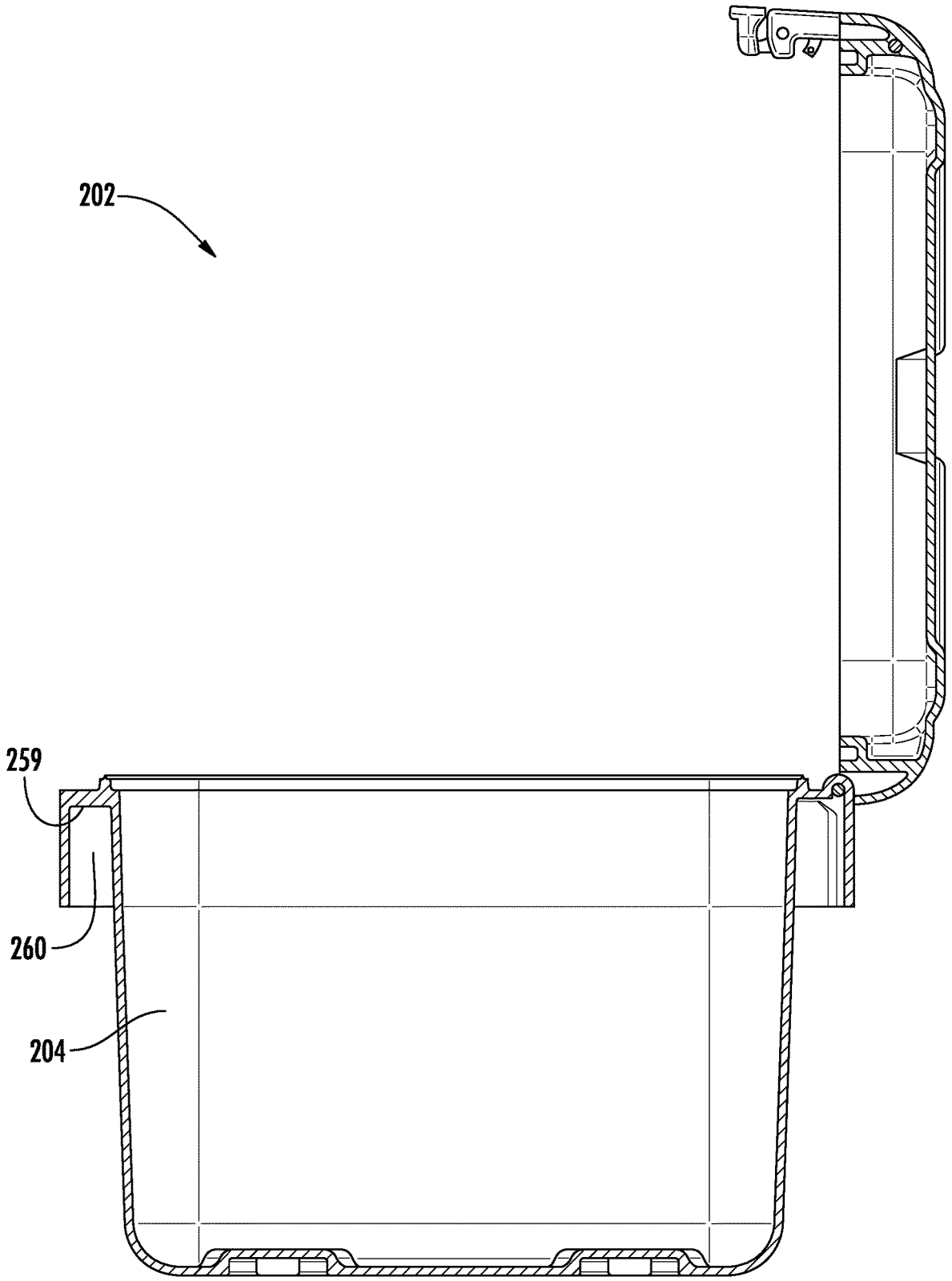
FIG. 15 is a side cross-sectional view of the container of FIG. 14 according to one or more aspects described herein.
Figure 16A:
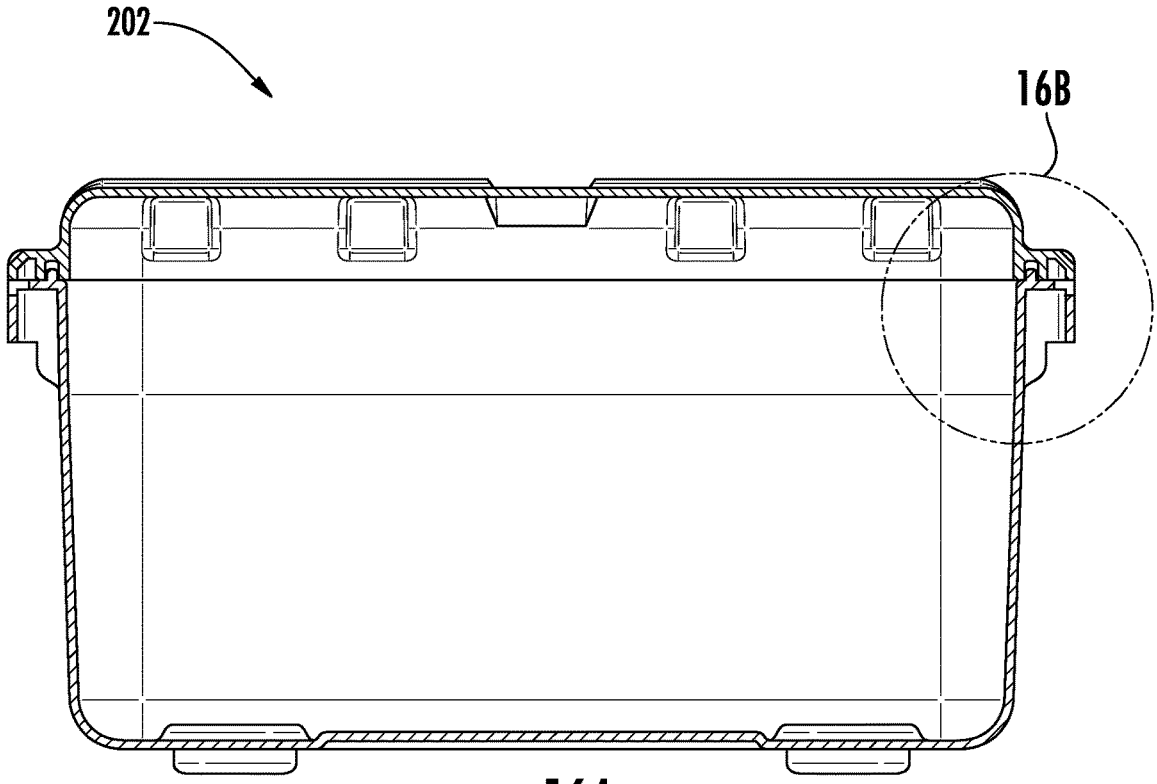
FIG. 16A is a side cross-sectional view of the container of FIG. 14 according to one or more aspects described herein.
Figure 16B:
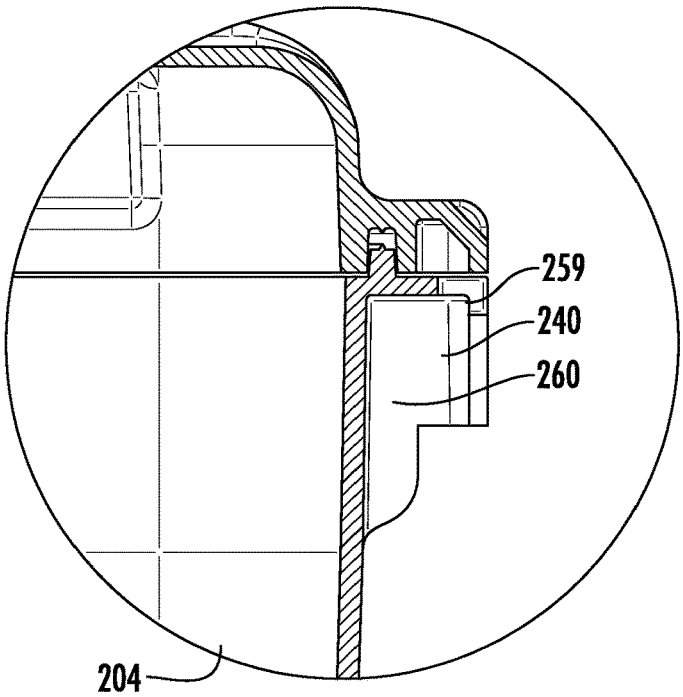
FIG. 16B is an enlarged view of a portion of the container shown in FIG. 16A according to one or more aspects described herein.

FIGS. 12A-12C depict a similar procedure to that shown in FIGS. 10A-10C for moving an embodiment of the latch assembly 100 from the locked position to an unlocked position and FIGS. 13A-13C depict a similar procedure to that shown in FIGS. 11A-11C for moving an embodiment of the latch assembly 100 from the locked position to an unlocked position. In some embodiments, as shown for example in FIGS. 10A-11C, the activating member 170 may automatically return to a downward position as shown in FIG. 10A after it has been rotated outward by a user. However, in other embodiments, the activating member 170 may only move to the downward position if it is manually pushed inward by a user. Additionally, in some embodiments, the activating member may extend further outward than the latch body 102 when the activating member is in the downward position.

The latch assembly 100, including the latch body 102, locking member 130, and activating member 170, may each be separately formed and may be formed of materials such as plastic materials or another suitable material which can be formed or molded into the desired shape. The latch assembly 100 may be made of sufficient size, thickness and materials of construction to withstand repeated cycles of stress as the latch is engage/disengaged with the latch keeper 70 over time. The containers described herein include various features that ensure easy and efficient manufacture of the containers, while providing durability and wear resistance.

FIGS. 14-16B depict another example container 202 having a latch assembly 100, wherein like reference numerals refer to the same or similar elements in container 2 but include 200 series reference numerals. Container 202 is substantially similar to container 2 and therefore similar aspects of container 202 are not discussed again herein. Container 202, however, may include some differences from container 2. Container 202, for example, includes handles 240 which may be integrally molded with the base portion 204 in the sidewall structure of the base 4. As shown in FIGS. 14-16B the integrally molded handles 240 may be formed of the J-shaped wall 259 and/or may comprise a portion of the J-shaped wall 259. Thus the integrally molded handles 240 may comprise a portion of the channel 260 extending around a perimeter of the container 202.

FIGS. 17A-26D depict another example container 302 having a latch assembly 400 discussed below, wherein like reference numerals refer to the same or similar elements in containers 2 and 202 but include 300 series reference numerals. Container 302 is substantially similar to containers 2 and 202 and therefore similar aspects of container 302 are not discussed again herein. Container 302, however, may include some differences from containers 2 and 202. Container 302, for example, includes handles 340 which may be integrally molded with the base portion 304 on each side 308, 310, 312, 314 of the sidewall structure 306 of base 304. In addition, container 302 may comprise a plurality of attachment points for locating and supporting various accessories that may connect to container 302. These attachment points will be described in more detail below.

Figure 17A:
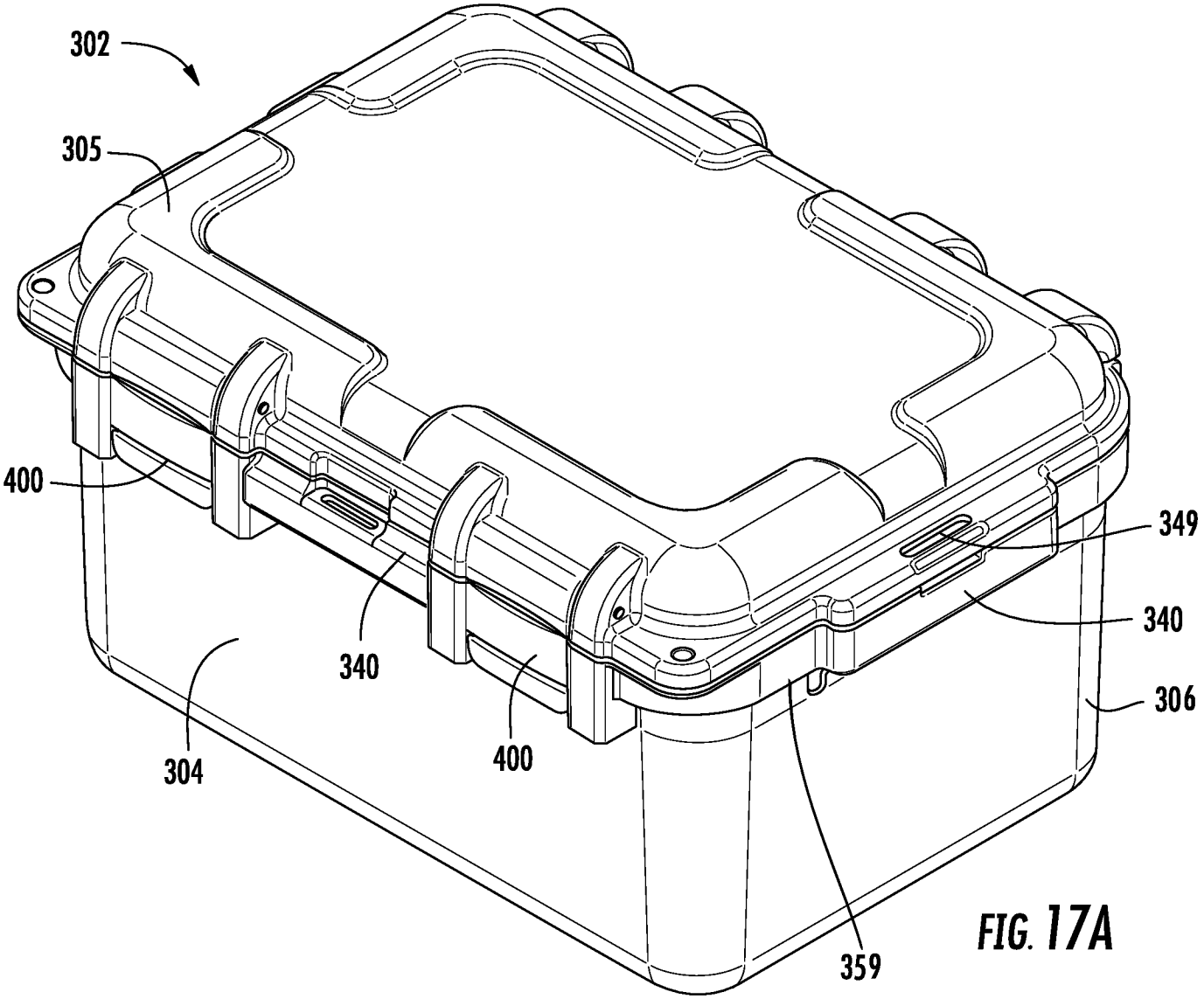
FIG. 17A illustrates a top perspective view of an alternate embodiment of the container of FIG. 1 with the lid in a closed position according to one or more aspects described herein.
Figure 17B:
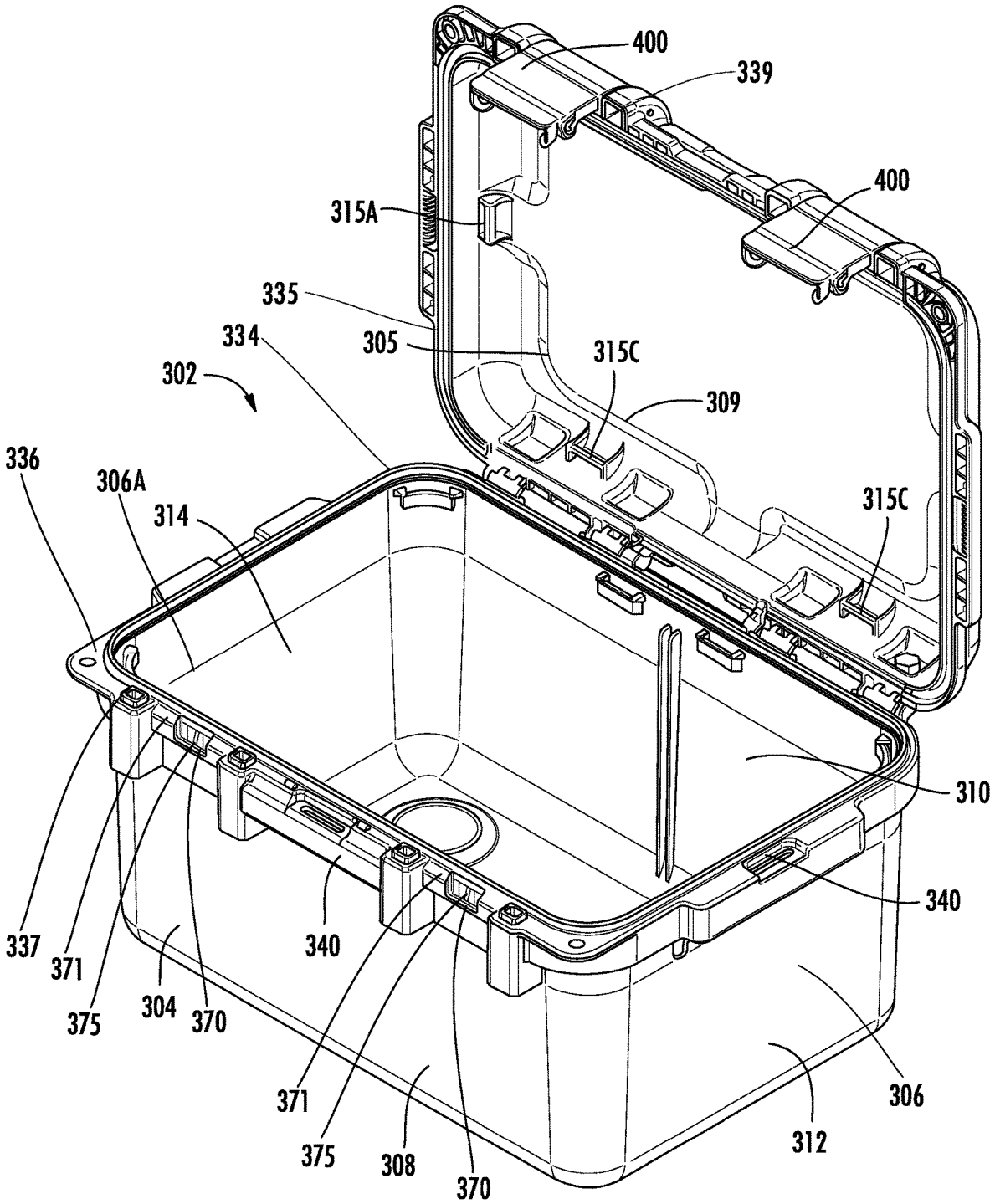
FIG. 17B illustrates a top perspective view of the container of FIG. 17A with the lid in an open position according to one or more aspects described herein.
Figure 18A:
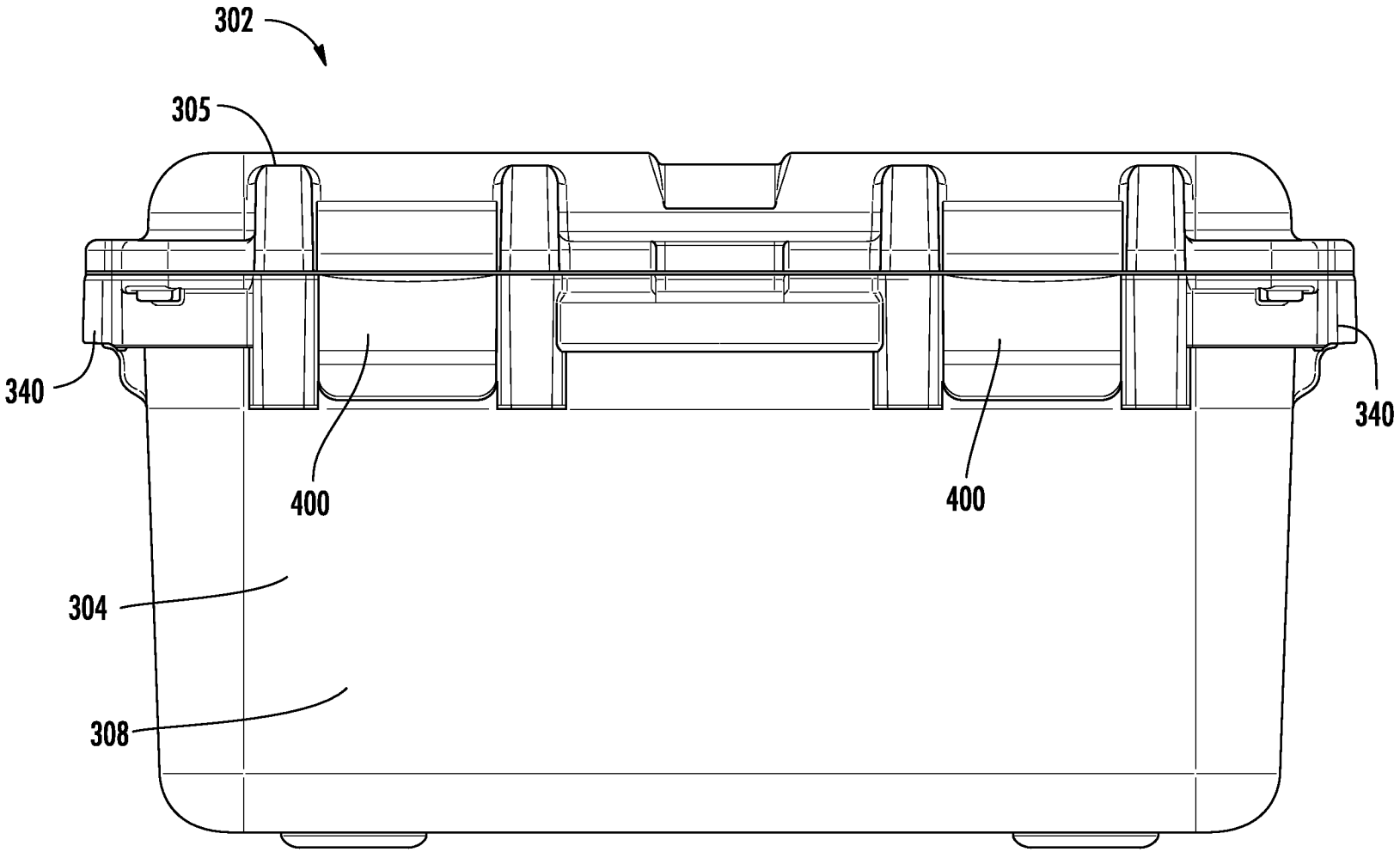
FIG. 18A illustrates a front view of the container of FIG. 17A with the lid in a closed position according to one or more aspects described herein.
Figure 18B:
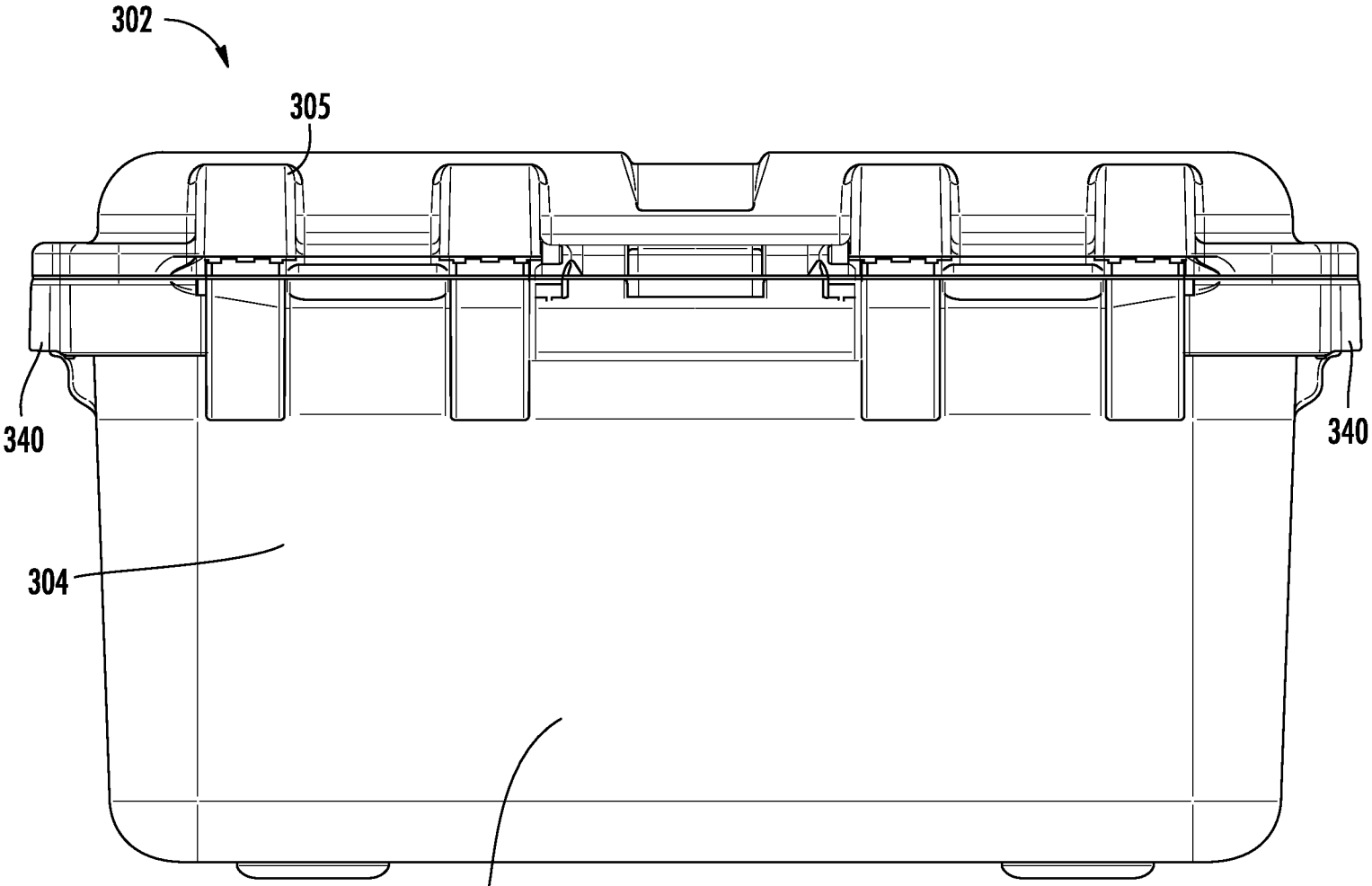
FIG. 18B illustrates a rear view of the container of FIG. 17A with the lid in a closed position according to one or more aspects described herein.
Figure 18C:
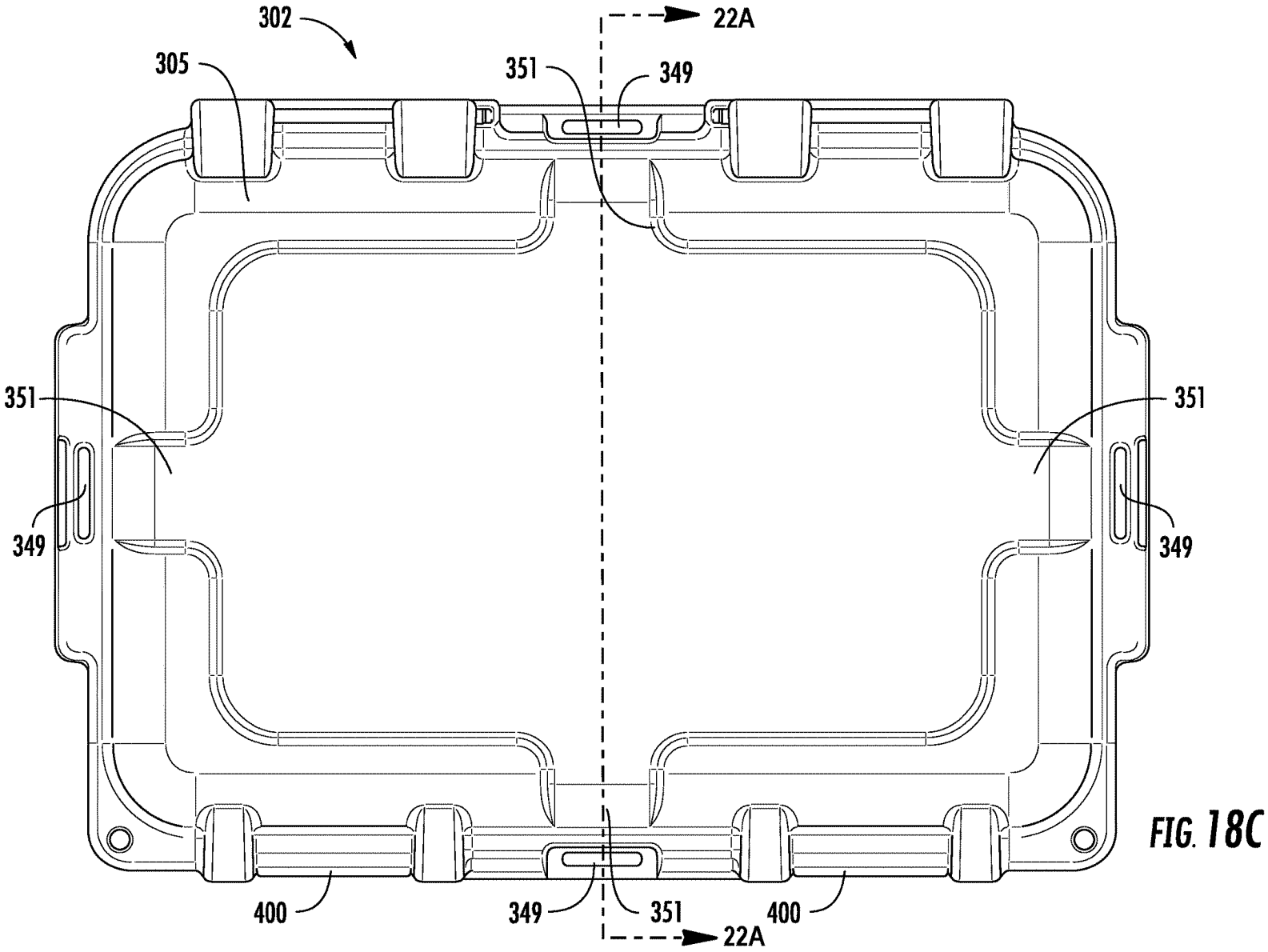
FIG. 18C illustrates a top view of the container of FIG. 17A with the lid in a closed position according to one or more aspects described herein.
Figure 18D:
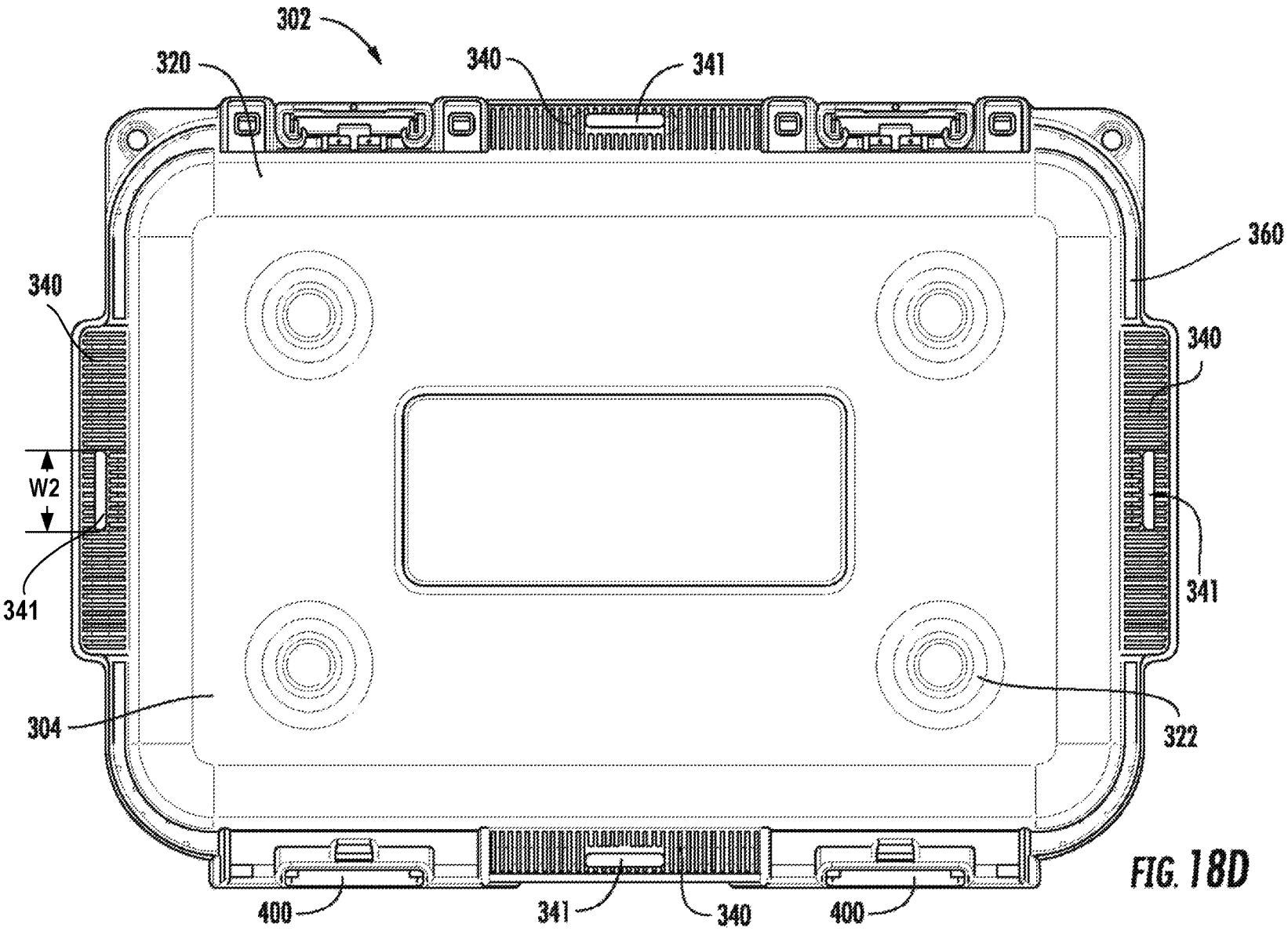
FIG. 18D illustrates a bottom view of the container of FIG. 17A with the lid in a closed position according to one or more aspects described herein.
Figure 18E:
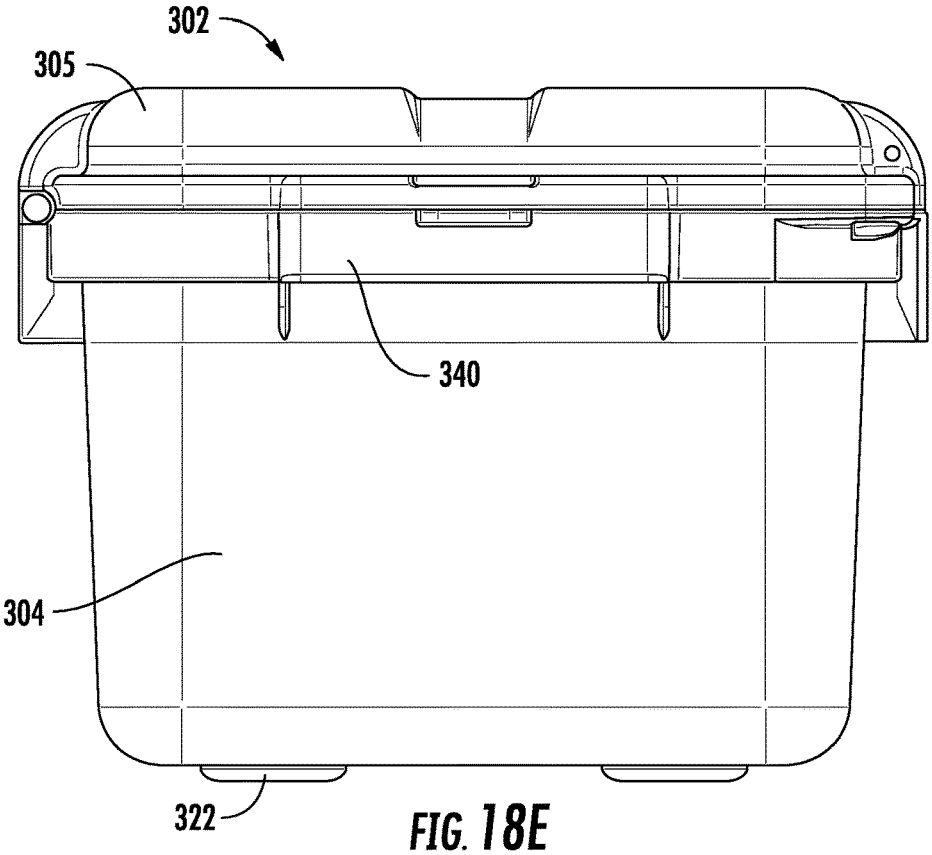
FIG. 18E illustrates a left side view of the container of FIG. 17A a closed position according to one or more aspects described herein.
Figure 18F:
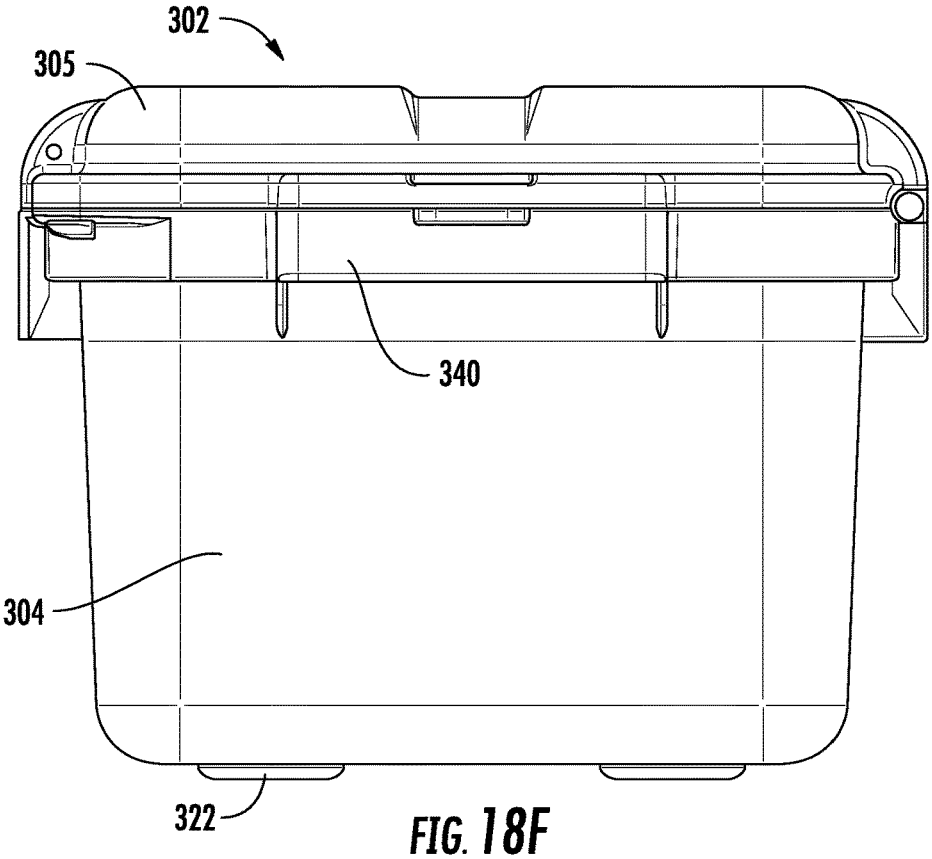
FIG. 18F illustrates a right side view of the container of FIG. 17A a closed position according to one or more aspects described herein.

As shown in FIGS. 17B, along with 19A and 19B, the base 304 may include a latch keeper 370. The latch keeper 370 may extend from the sidewall structure 306 and may form a pocket within the base 304. The latch keeper 370 may have a shape configured to receive a portion of the locking member 430 as will be discussed in more detail below. The latch keeper 370 may have an upper surface 372, an inner surface 374, a rib 375, and a lower surface 376. The rib 375 may extend from the sidewall structure 306 to the lower surface 376 of the latch keeper 370. Optionally, the rib 375 may also connect to the upper surface 372 and the lower surface 376 or the inner surface 374 of the latch keeper 370. The rib 375 may be substantially centrally located along the latch keeper 370. The rib 375 may add structural support to the latch keeper 370 to improve the durability. As another option, the latch keeper 370 may include multiple ribs 375 that may be positioned one either side of the pocket formed by the latch keeper 370 to provide additional support to the latch keeper 370. As will be discussed in greater detail below, the latch assembly 400 may engage the latch keeper 370 to lock the lid 305 to the base 304 when the container 302 is in a closed configuration.

Figure 21:
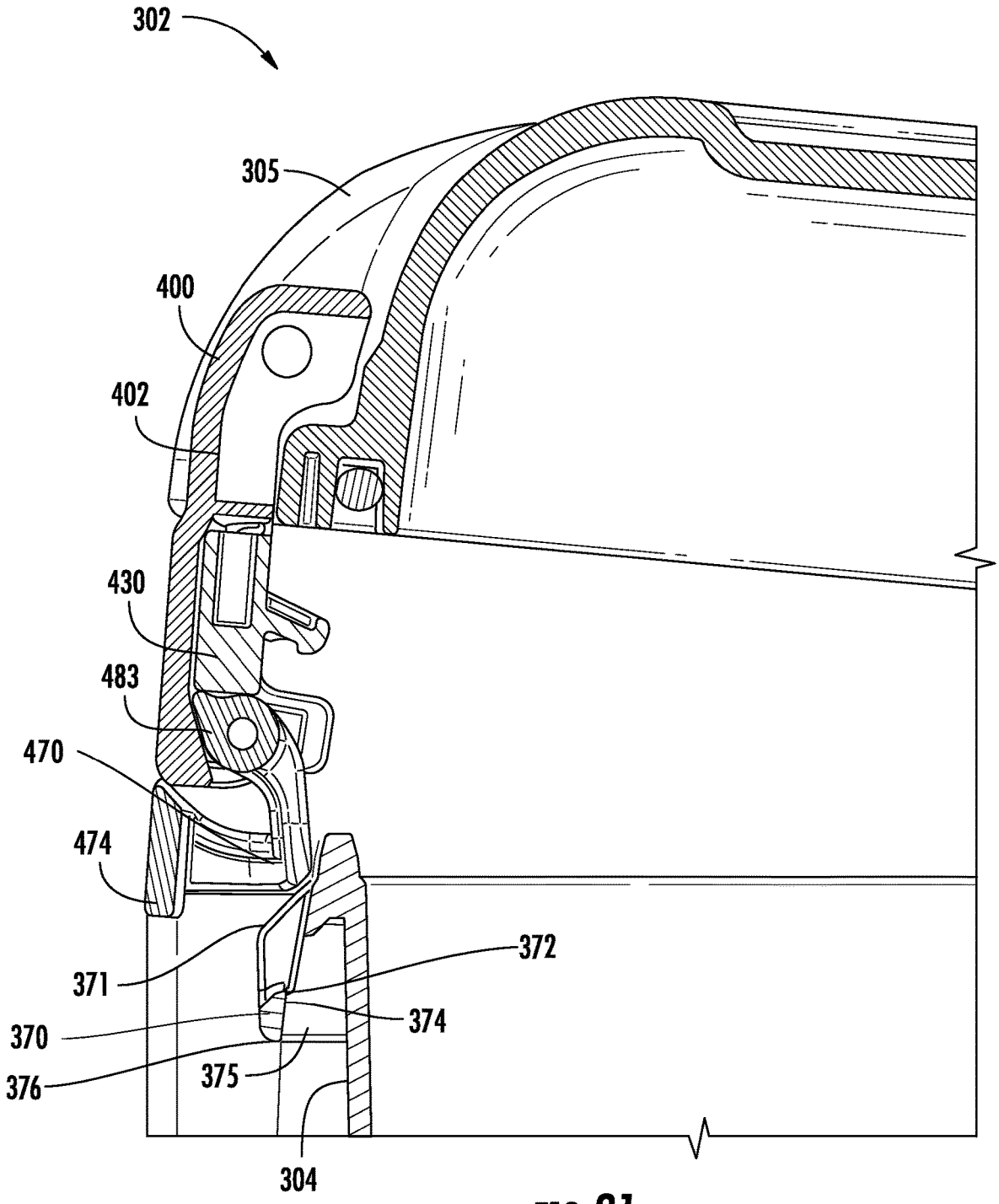
FIG. 21 illustrates a partial cross-sectional view of the latch assembly of FIG. 20A in an unlocked position according to one or more aspects described herein.

In addition, the base 304 may include a plurality of ramped or tapered surfaces 371 positioned on either side of the latch keeper 370. The ramped surfaces 371 may angle downward from the interface surface 336 of the base 304, where the interface surface 336 may be substantially flat and extend around on at least three sides of the perimeter of the base 304. The interface surface 336 of the base 304 may contact the interface surface 335 of the lid 305 when the container 302 is in the closed position. The ramped surface 371 may angle downward from the interface surface 336 approximately 45 degrees or within a range of 30 and 60 degrees, or within a range of 20 to 80 degrees. The ramped surface 371 may prevent the latch assembly 400 from getting stuck on the base 304 when closing the container 302 and may also contact the lower portion of the latch assembly 400 as the lid 305 is closed to push the latch assembly 400 out of the way of the base when the lid 305 is closed as shown in FIG. 21.

The base 304 may further include a plurality of engaging members 337 that extend from the interface surface 336 of the base 304. The engaging members 337 may be positioned outward of the ridge 334. The engaging members 337 may extend into recesses or cavities 339 on the lid 305. The interaction between the engaging members 337 and the recesses 339 may provide additional structural support to strengthen the joint between the lid 305 and the base 304 when the container 302 is in a closed position and when multiple containers are stacked or additional items are placed on top of the container 302. The base 304 may have any number of engaging members 337. For example, the exemplary embodiment illustrates four engaging members 337, but the base 304 may comprise two engaging members, three engaging members, five engaging members or greater. The number of recesses 339 on the lid 305 may be equal to the number of engaging members 337 and located on the lid 305 at a location that corresponds with each engaging member 337 of the base 304. The engaging members 337 in the exemplary embodiment have a substantially square cross-sectional shape, but may have any cross-sectional shape, like a circle, triangle, or other polygon. Each engaging member 337 may have a height that is less than or equal to the width of the engaging member 337. Additionally, while the engaging members 337 and the recesses 339 of the exemplary embodiment are located on the first side 308 of the container 302, the engaging members 337 and the recesses 339 may be on any side and may have embodiments where they are positioned on multiple sides.

Figure 19A:
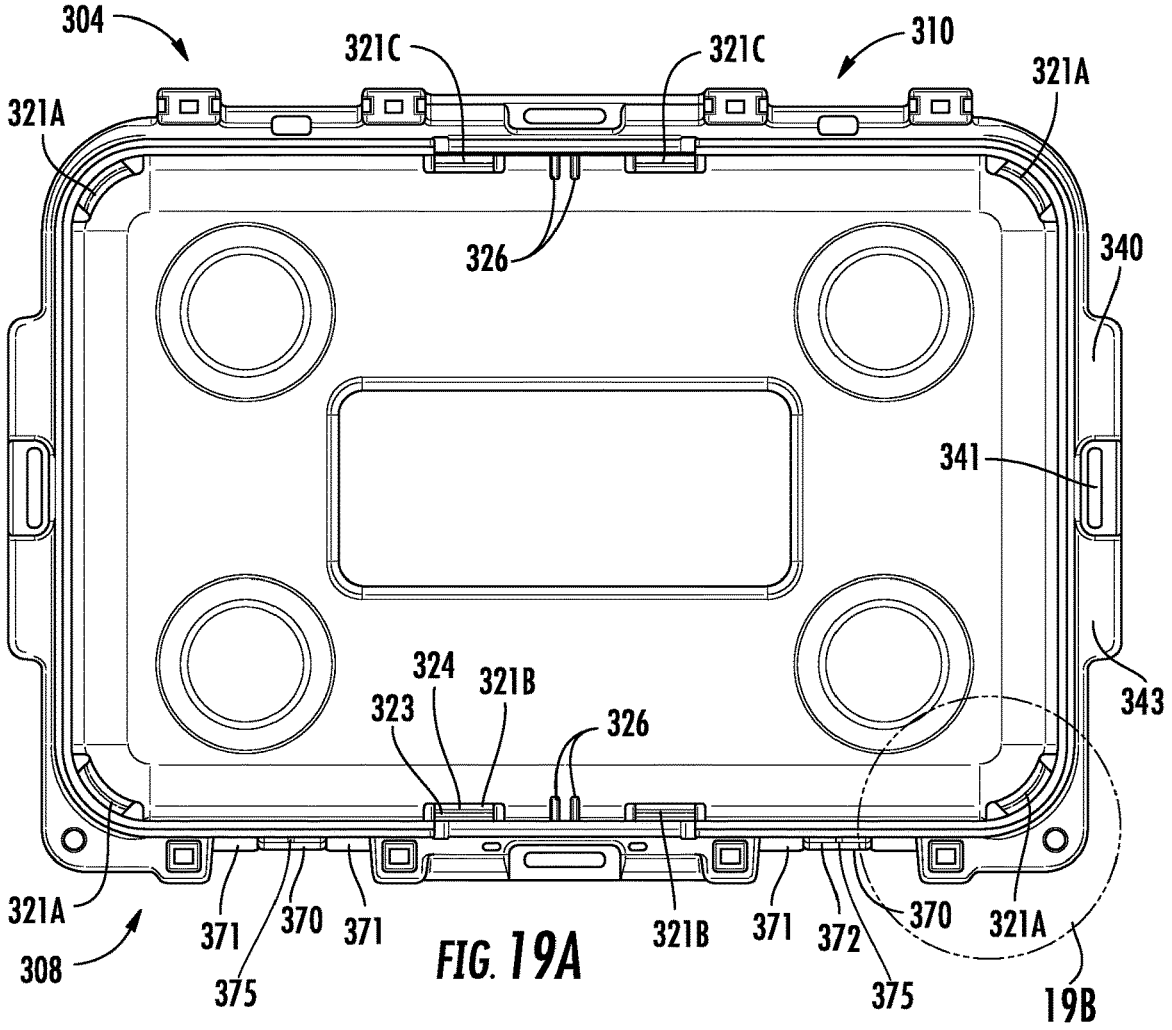
FIG. 19A illustrates a top view of the base portion of the container of FIG. 17A with the lid removed according to one or more aspects described herein.
Figure 19B:
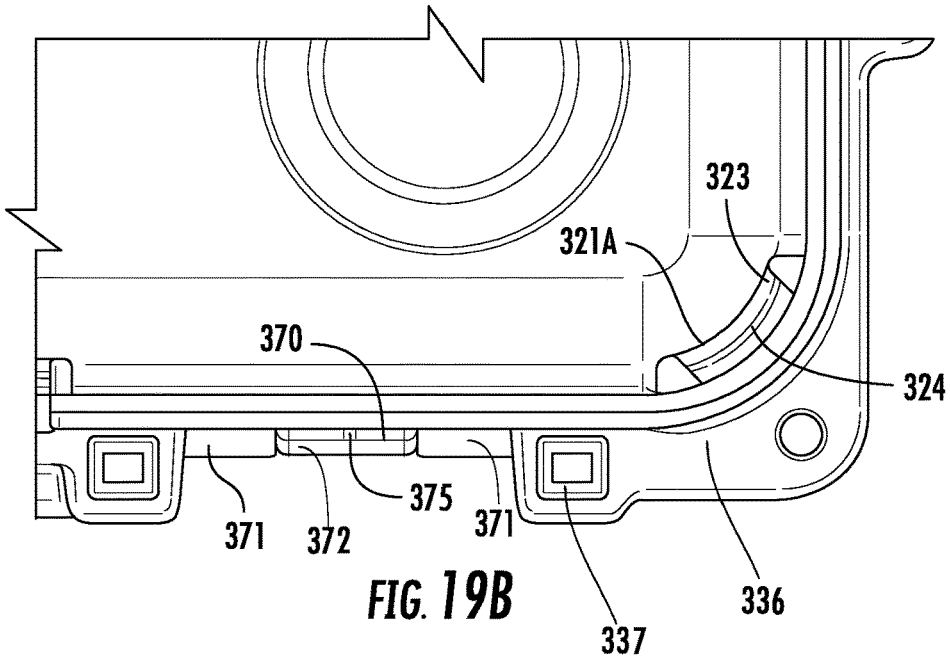
FIG. 19B illustrates an enlarged view of the base portion of the container shown in FIG. 19A according to one or more aspects described herein.

As another feature, base 304 may have a plurality of tabs 321 positioned along the interior surfaces 306A of the sidewall structure 306 of the base 304. For example, as shown in FIGS. 17B and 19A, the tabs 321A may be positioned in each of the corners of the sidewall structure 306. In addition, tabs 321B and 321C may be positioned along the interior surface of first side 308 and second side 310. Tabs 321B and 321C may be located opposite one another as illustrated in FIG. 19A such that they are aligned along a length of the first side 308. As shown in the exemplary embodiment of FIG. 19A, the interior portion may comprise eight tabs 321, with tabs 321A being located in each of the corners and tabs 321B and 321C being located along the interior surface of the sidewalls 308, 310. Tabs 321B and 321C may be generally centrally located such that at least one tab 321B, 321C may be placed on near a centerline of the container 302, but preferably located on either side of the centerline. As another option, the plurality of tabs 321 may not be aligned with a tab 321 on the opposite interior surface, but have a staggered arrangement. The tabs 321 may provide attachment locations for various accessories as discussed further below.

Each tab 321 may extend from the interior surfaces 306A of the sidewall structure 306 and include an upper support surface 323, an opening 324 extending through the upper support surface 323, and a pair of side surfaces on either end of the tab 321. The upper support surface 323 of each tab may provide an engaging surface to support various accessories within the interior of the container 302, like a tray 500 as discussed further below. The upper support surfaces 323 of the plurality of tabs 321 may be substantially coplanar with each other to allow the support surfaces 323 to hold an accessory that may extend across the base 304 and be supported by multiple tabs 321. The upper support surfaces 323 of the tabs 321 may be positioned in an upper region of the interior surfaces 306A at a height that is greater than fifty percent of the height of the interior portion of the base portion. As another option, the upper support surfaces 323 of the tabs 321 may be positioned at a height that is greater than sixty percent of the height of the interior portion of the base portion, or even greater than seventy percent of the height of the interior portion of the base portion. In order to minimize the impact to the interior space, each tab 321 may have a low profile such that each tab 321 may extend a distance of less than one inch from the interior surface, or less than 0.5 inches, or even less than 0.25 inches. Additionally, the openings 324 may have any shape, but may be preferably elongated in shape. The openings 324 may provide attachment points for straps or other attachment means to further support different accessories.

As another option a pair of tracks 326 may be positioned along at least two of the interior surfaces 306A of the sidewall structure 306. As shown in the exemplary embodiment, a pair of tracks may be positioned on each of the interior surfaces of first and second sides 308, 310. Each of the pair of tracks 326 may be centrally located such that they are aligned with the pair of tracks 326 on the opposing interior surface. Each of the tracks 326 may extend from the interior surfaces of the base 304 and have a height that extends along a majority of the height of the interior portion. In order to minimize the impact to the interior space, each track 326 may have a low profile such that each track 326 may extend a distance of less than one inch from the interior surface 306A, or less than 0.5 inches, or even less than 0.25 inches. The pairs of tracks 326 may support a removable divider wall 510, which may also serve as a cutting board, to separate the interior of the container into two portions to better organize the items being stored. Each of the tracks 326 may have a plurality of détentes or protrusions to securely hold the divider wall 510 to prevent it from moving and limit any vibration.

Similar to the example container 302 discussed above, the embodiment of FIGS. 17-26D may have integrally molded handles 340 that are positioned along each of the sidewalls 308, 310, 312, 314. Each of the integrally molded handles 340 may be formed of the J-shaped wall 359 and/or may comprise a portion of the J-shaped wall 359. Thus the integrally molded handles 340 may comprise a portion of the channel 360 extending around a perimeter of the container 302. Thus, the example container 302 may comprise four handles 340. The handles 340 may be integrally molded with the base portion 304. In some examples, each handle 340 may be formed with an undercut and include a recess extending along substantially all or a majority of the sidewall structure 306. This integrally molded handle 340 may simplify the manufacturing process for the base 304. In some examples, the integrally molded handles may be flush with an exterior surface of the base 304 in order to reduce the risk of breakage.

Figure 22A:
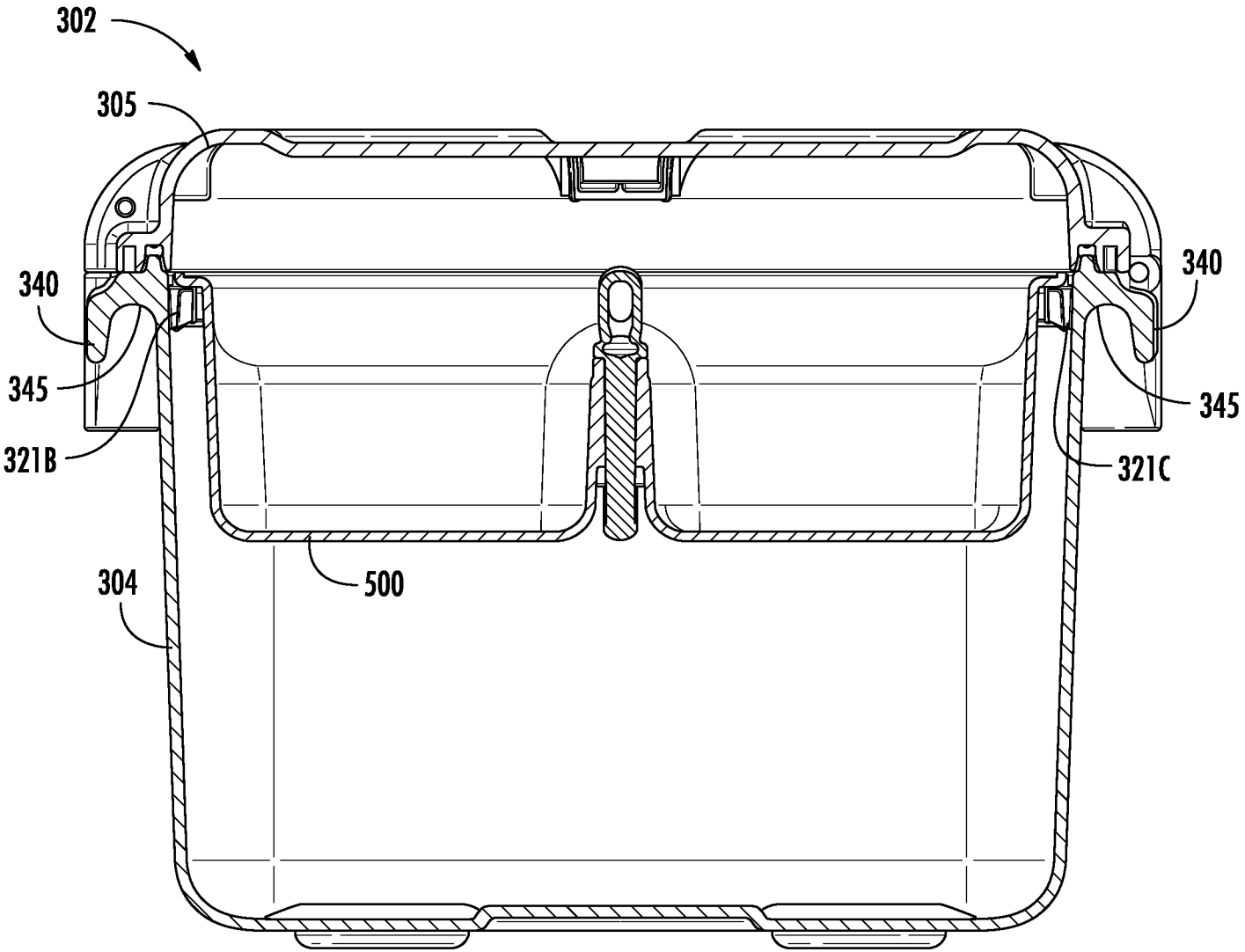
FIG. 22A illustrates a side cross-sectional view of the container of FIG. 17A according to one or more aspects described herein.
Figure 22C:
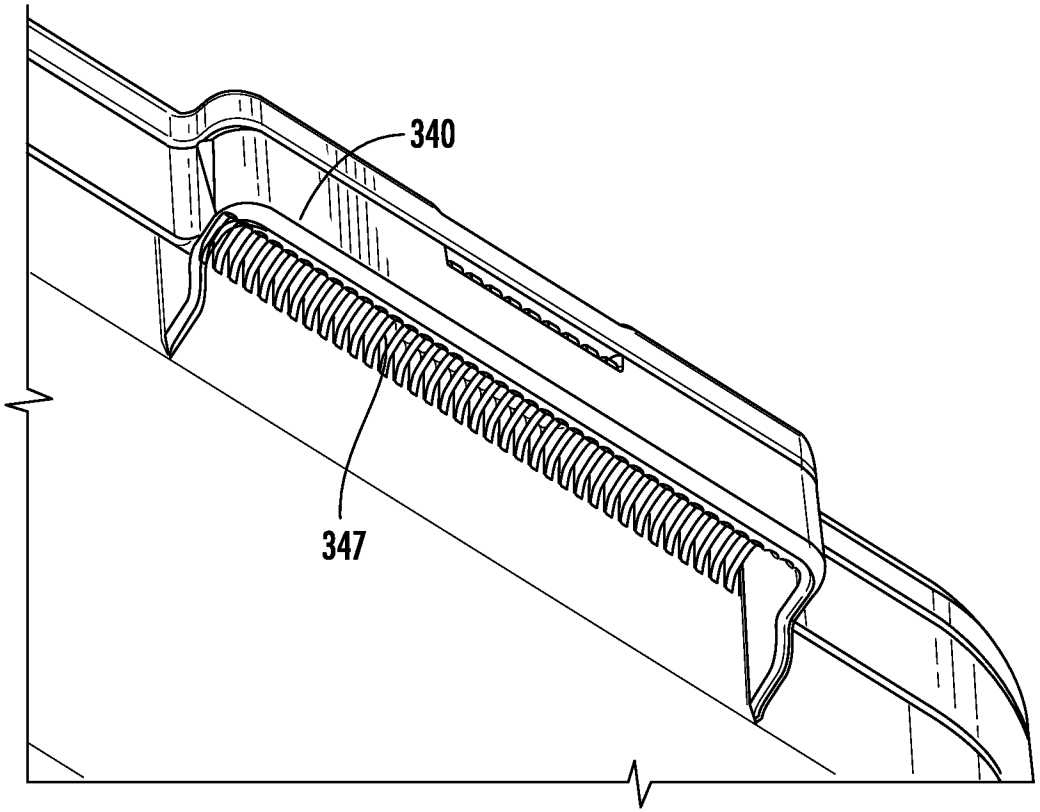
FIG. 22C illustrates a partial view of a bottom perspective view of the handle of the container of FIG. 17A according to one or more aspects described herein.
Figure 22B:
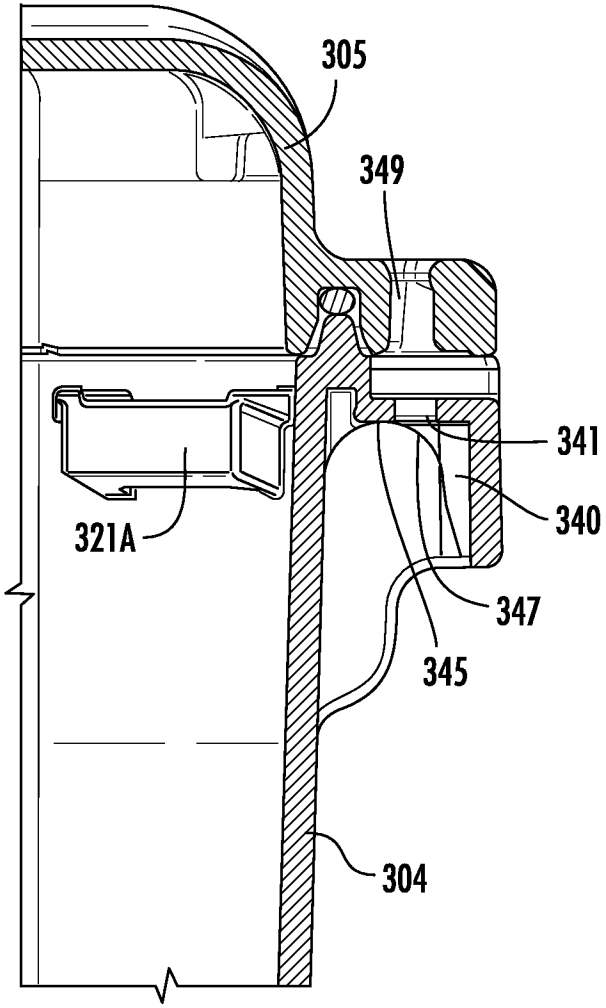
FIG. 22B illustrates enlarged side cross-sectional view through a handle of the container of FIG. 17A according to one or more aspects described herein.

As shown in FIGS. 22A through 22C, each handle 340 may have a curved interior profile 345 to provide an ergonomic and comfortable gripping surface for the user. The interior profile 345 of the handle may comprise a plurality of handle ribs 347 that extend from the sidewall to an interior surface of the handle 340, where each handle rib 347 may have a curved profile such that the plurality of ribs 347 that are spaced apart from each other form the curved interior profile 345 of the handle 340. Each rib 347 may have a spacing between the ribs 347 that is less than the width of each rib 347. Alternatively, each rib 347 may have a spacing between the ribs 347 that is equal to or greater than the width of each 347.

Figure 23A:
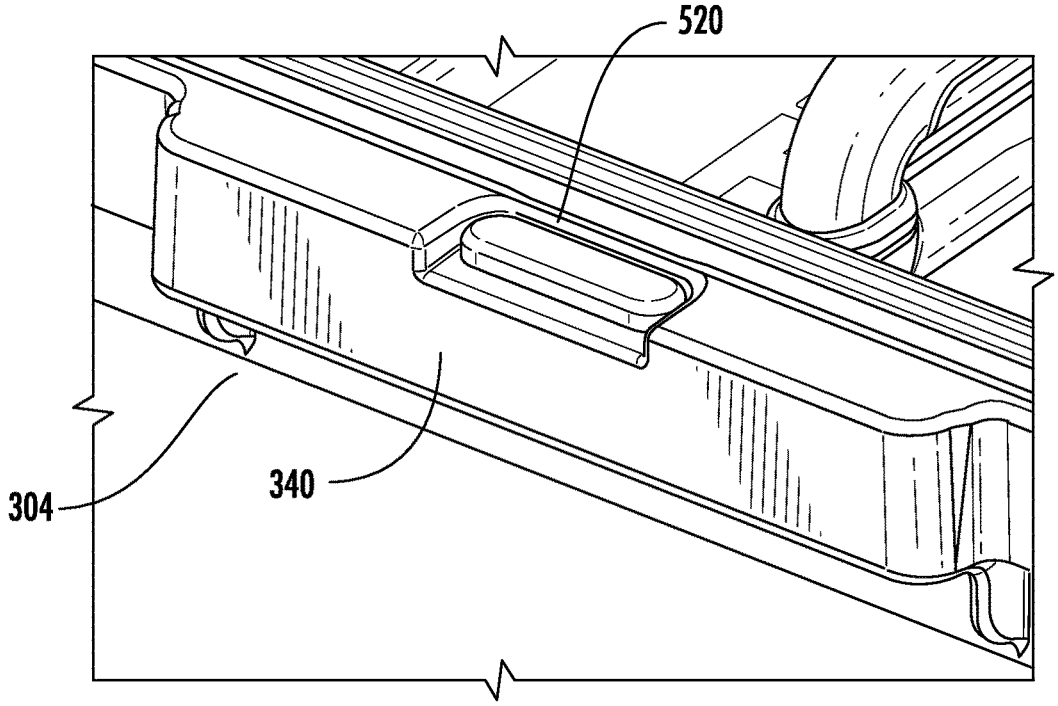
FIG. 23A illustrates a partial top perspective view of the base portion of the container of FIG. 17A according to one or more aspects described herein.
Figure 23B:
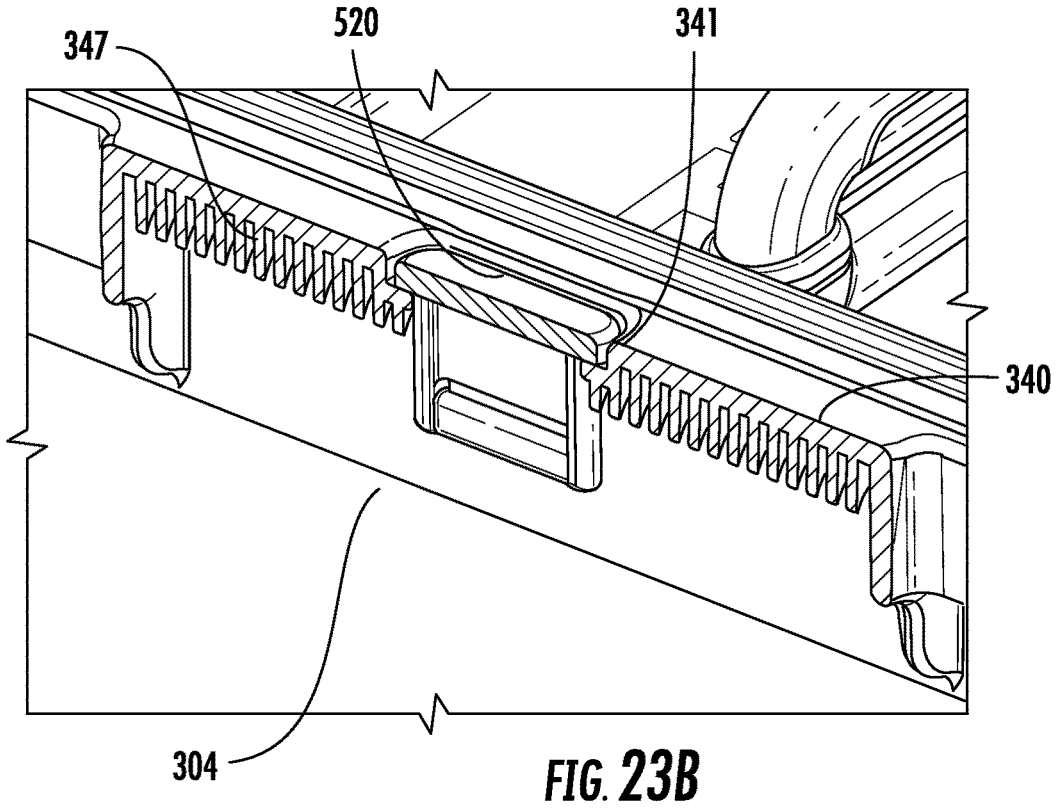
FIG. 23B illustrates a partial cross-sectional view of partial top perspective view of FIG. 23A illustrating the base portion of the container of FIG. 17A according to one or more aspects described herein.

Each handle 340 may have an opening 341 extending through the handle top surface 343 of the handle 340 where each opening 341 may align with an opening 349 of the lid 305. Thus, with the aligned openings 341 of the handle and openings 349 of the lid 305 allow locations for a strap or similar device to pass through the openings 341, 349 to anchor or tie down the container 302. Each opening 341, 349 may have an elongated shape and may all have substantially the same length and width. Thus, these openings 341, 349 may provide versatility to the user for other operations beyond just anchoring the container 302. To further assist with anchoring or securing the container 302, the lid 305 may have recesses or channels 351 that align with the openings 349 to provide guide surfaces for a strap to tie down the container 302. As another option, clips 520 may be inserted through the openings 341 to provide an additional location to use a hook and loop type connection to add further versatility of options to hold additional accessories as shown in FIGS. 23A and 23B.

Figure 24A:
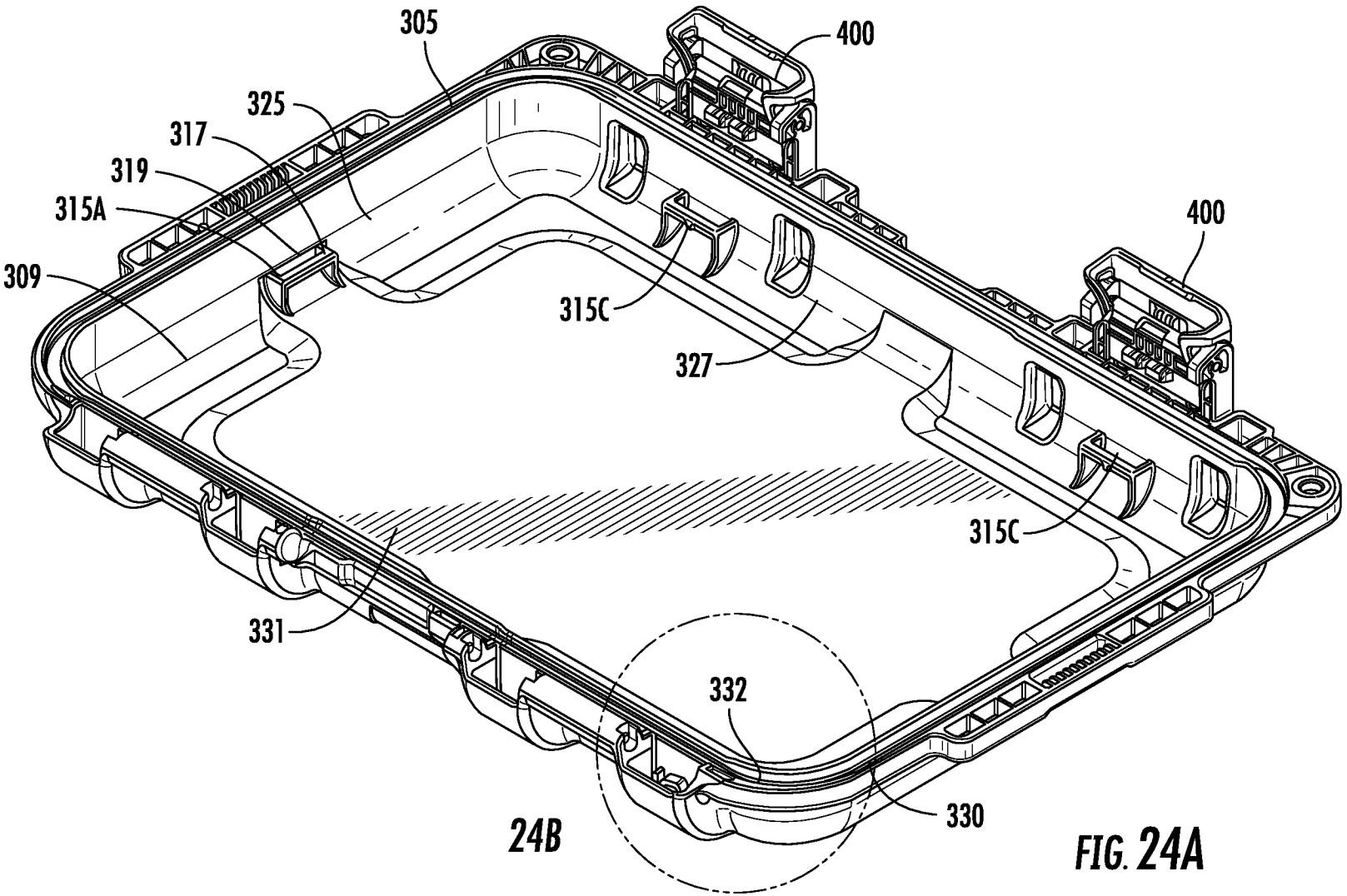
FIG. 24A illustrates a top perspective view of the interior of the lid of the container of FIG. 17A according to one or more aspects described herein.

The lid 305 of the container 302 may further comprise a plurality of clips 315 positioned along an interior surface 309 of the lid 305. For example, as shown in FIG. 24A, a clip 315A may centrally located on each of the interior surfaces 325 and while a pair of clips 315B and 315C may be evenly spaced along each of the interior surfaces 327, 329. Each of the clips 315 may also extend onto or contact the lower interior surface 331 of the lid 305. The clips 315B and 315C may be aligned to be located opposite one another. As shown in the exemplary embodiment of FIGS. 17B and 24A, the lid 305 may comprise six clips 315, although the lid 305 may comprise any number of clips 315. As another option, the plurality of clips 315 may not be located opposite one another on the interior surface of the sidewalls and have a staggered arrangement. The clips 315 may provide attachment locations for various accessories as such as a cargo net or bungie cord net 515, or straps 516 that include additional hitch points for securing any further items desired by the user.

Each clip 315 may extend from interior surfaces of the lid 305 and may include an engaging member 317 and an opening 319 extending through the engaging member 317. The openings 319 may be elongated in shape or alternatively may have any shape. In addition, the openings 319 of the clips 315 may have a similar width as the openings 324 of the tabs 321. These openings 319 may provide attachment points for straps or other attachment means to further support different accessories as shown in FIGS. 26B-26D.

Figure 24B:
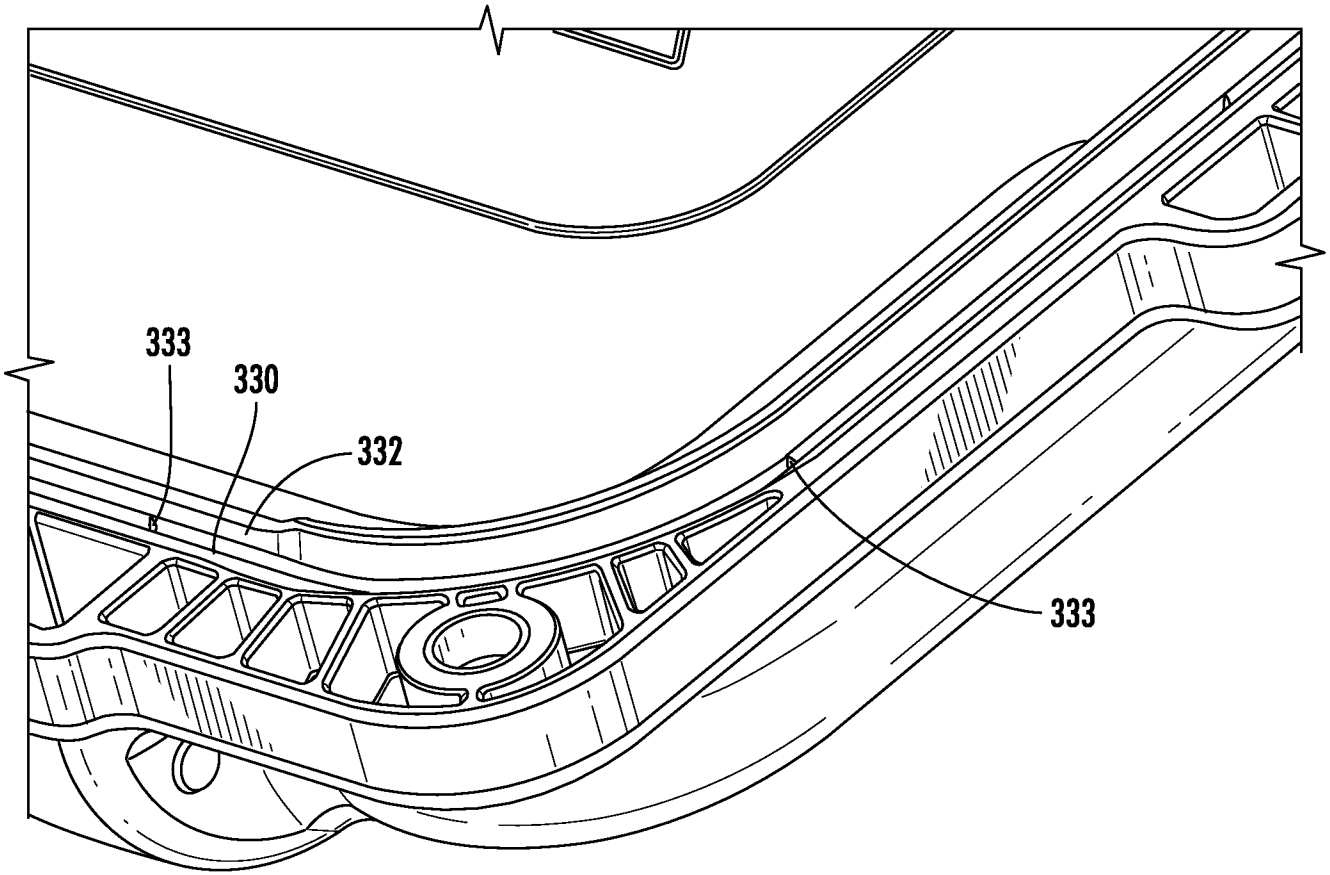
FIG. 24B illustrates an enlarged view of the top perspective view of FIG. 24A illustrating a portion of the lid of the container of FIG. 17A according to one or more aspects described herein.

As discussed above with respect to lid 5, lid 305 may include a recess 332 that may seat a gasket 330 where the recess 332 extends around a perimeter of the lid 305. The recess 332 may be positioned within the interface surface 335 of the lid 305. The recess 332 may include a plurality of retaining members 333 extending from the sides of the recess 332 as shown in FIG. 24B. The retaining members 333 may engage the gasket 330 in multiple locations around the perimeter of the recess 332 to secure the gasket 330 in the recess 332. Each retaining member 333 may include at least one tapered surface such that the retaining member 333 has a thickness near the top of the retaining member which is closer to the open end of the recess 332 than the thickness in a central portion of the retaining member 333. Additionally, in some example embodiments, the container 302 may include a ridge 334 in the base 304 opposite the recess 332 of the lid 305 extending around a perimeter of the base 304. The ridge 334 may be positioned on the interface surface 336 of the base 304. The gasket 330 may be placed between the recess 332 and the ridge 334 when the lid 305 engages the base 304.

Figure 25:
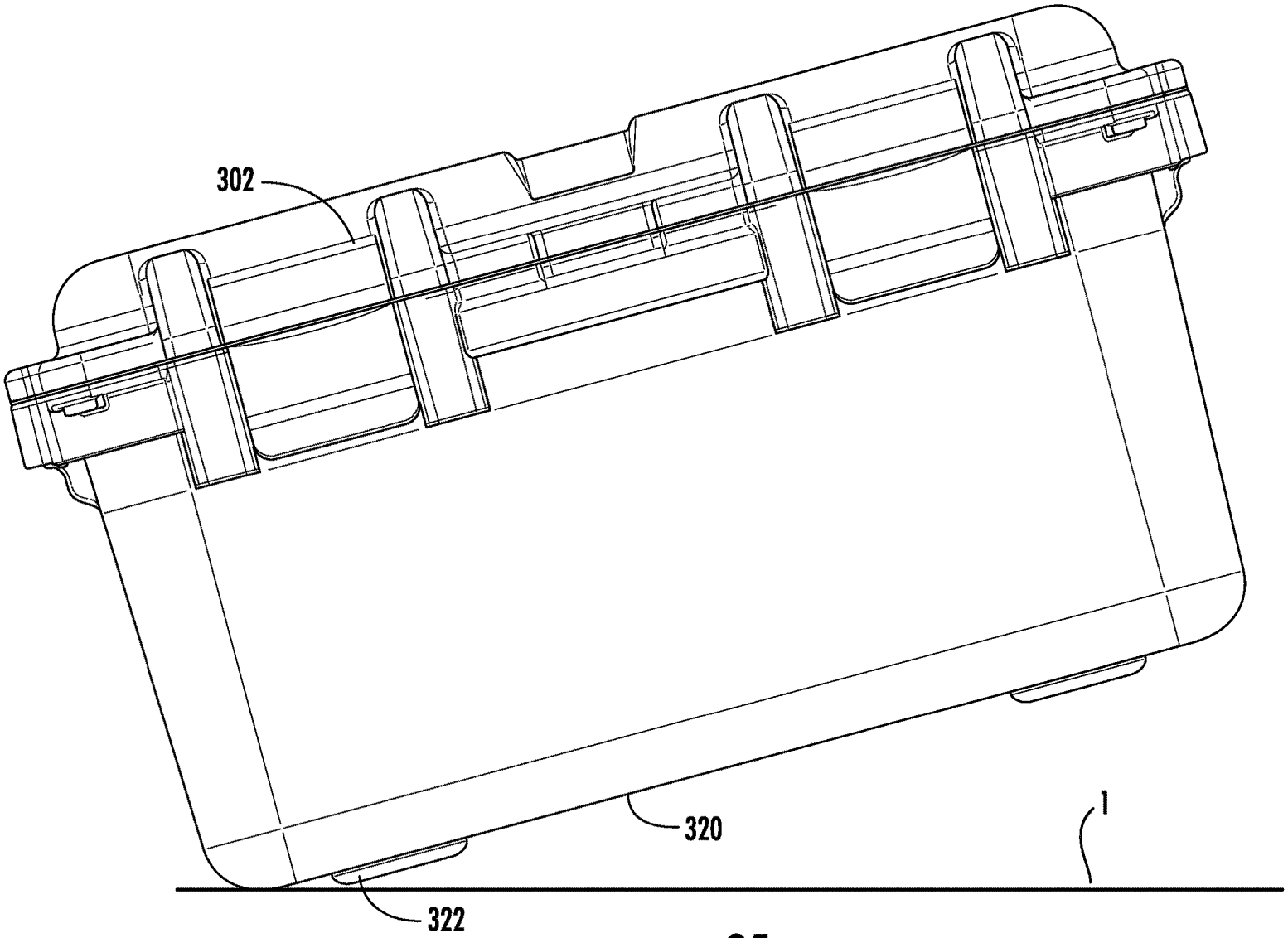
FIG. 25 illustrates a side view of the container of FIG. 17A according to one or more aspects described herein.

In some embodiments, the bottom portion 320 may also and/or alternatively include one or more feet 322, which may support the container 302 on a surface 1 such as a table, the ground, a vehicle bed, or the like. The feet 322 may be formed separately from a non-skid material like a rubber or elastomer and attached to the base 304 after being formed. The feet 322 may have a height that is considered "low profile" that allows the container 304 to be slid along one of its edges when the container 302 is tilted at an angle greater than 15 degrees relative to the surface 1 supporting the container 302 as shown in FIG. 25. Alternatively, the feet 322 may be integrally formed with the base 304.

Figure 20B:
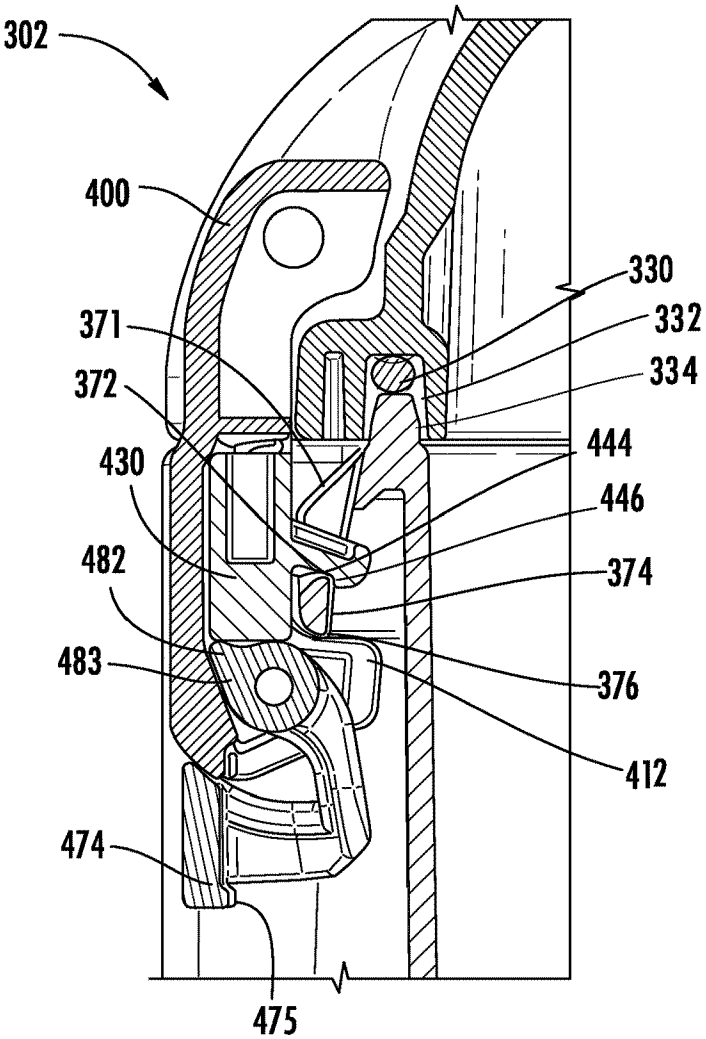
FIG. 20B illustrates a partial cross-sectional view of an alternate embodiment of the latch assembly of FIG. 20A in a locked position according to one or more aspects described herein.
Figure 20A:
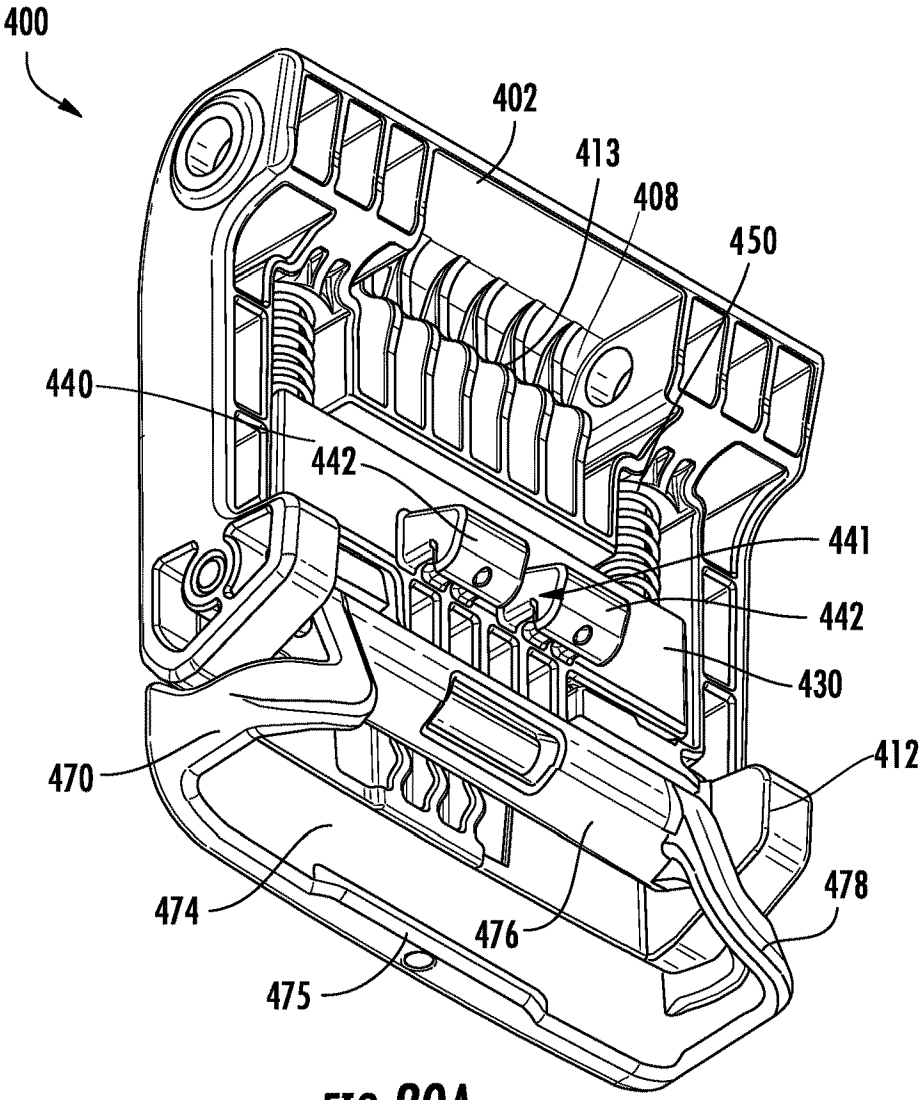
FIG. 20A illustrates a bottom rear perspective view of an alternate embodiment of a latch assembly according to one or more aspects described herein.

FIGS. 20A through FIG. 21 depict an example latch assembly 400 where like reference numerals refer to the same or similar elements in latch assembly 100 but include 400 series reference numerals. Latch assembly 400 is substantially similar to latch assembly 100 and therefore similar aspects of latch assembly 100 are not discussed again herein. Latch assembly 400, as shown in FIG. 20A, may include multiple components including a latch body 402, a locking member 430, a biasing member 450, and an activating member 470. Similar to latch assembly 100 discussed above, the latch assembly 400 may include a locked position and an unlocked position.

Figure 20C:
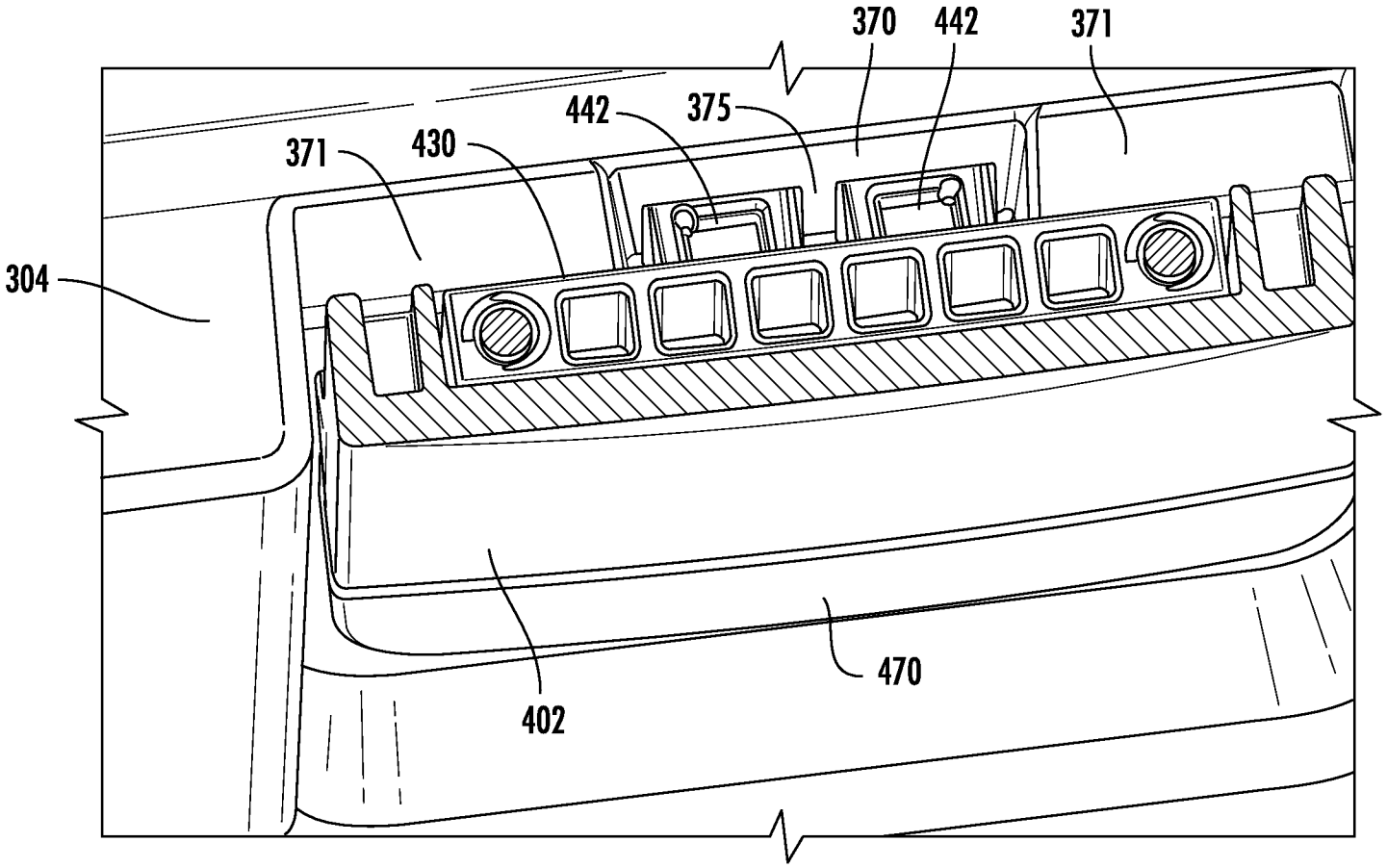
FIG. 20C illustrates a partial cross-sectional view of an alternate embodiment of a latch assembly of FIG. 20A in a locked position according to one or more aspects described herein.

The locking member 430 may include a base portion 440 and a plurality of hook portions 442 extending inward from the base portion 440. The plurality of hook portions 442 may be spaced apart from each other by a gap 441. Each hook portions 442 may each include a lower surface 444 and an inward facing surface 446. As shown in FIG. 20B, when the latch assembly 400 is in the locked position, the lower surface 444 of each hook portion 442 may engage the upper surface 372 of the latch keeper 370 and the inward facing surface 446 of each hook portion 442 may engage the inner surface 374 of the latch keeper 370. Further, the rib 375 of the latch keeper 370 may fit within the gap 441 between each of the hook portions 442 as shown in FIG. 20C. Additionally, when the latch assembly 400 is in the locked position the upper surface of the engagement lugs 412 may engage the lower surface 376 of the latch keeper 370.

The latch body 402 may include a plurality of ribs 413 along the inner surface 408 from the upper portion of the inner surface 408 towards the locking member 430. The ribs 413 may each have a contoured height such that each rib 413 has a lower height in an upper region than in the lower region as the rib extends toward the locking member 430. The ribs 413 help to strengthen the latch body 402 while reducing the overall weight of the latch assembly 400.

Similar to the latch assembly 100, the latch body 402 may also be pivotally engaged with an activating member 470. The activating member 470 may also be engaged with the locking member 430 and may be configured to move the locking member 430 from the downward position to the upward position. The activating member 470 may be pivotally engaged to the latch body 402 by a hinge 472 extending through the latch body 402 and the activating member 470. The activating member 470 may include a grip portion 474, an activating barrel 476, and one or more arms 478 connecting the grip portion 474 and the activating barrel 476 where the activating barrel 476 may include a raised portion 482. The raised portion 482 and activating barrel 476 may be joined together along a substantially flat contact surface 483. In order to adequately support the activating barrel 476, the interior surface 408 of the latch body 402 in that region may be substantially parallel to the contact surface 483 to support the contact surface 483 and thus assist in supporting the activating barrel 476 and keep the activating member 470 from rotating backward beyond the outer surface 410 of the latch body 402. As another option, the grip portion 474 may include a ridge 475 extending at least a portion of the length of the grip portion 474 to further assist a user in gripping the grip portion 474 without slipping.

As discussed above, the ramped surface 371 acts to both protect the latch assembly from getting stuck on the base 304 as well as acting to help position the latch assembly to properly engage the latch keeper 370.

Figure 26A:
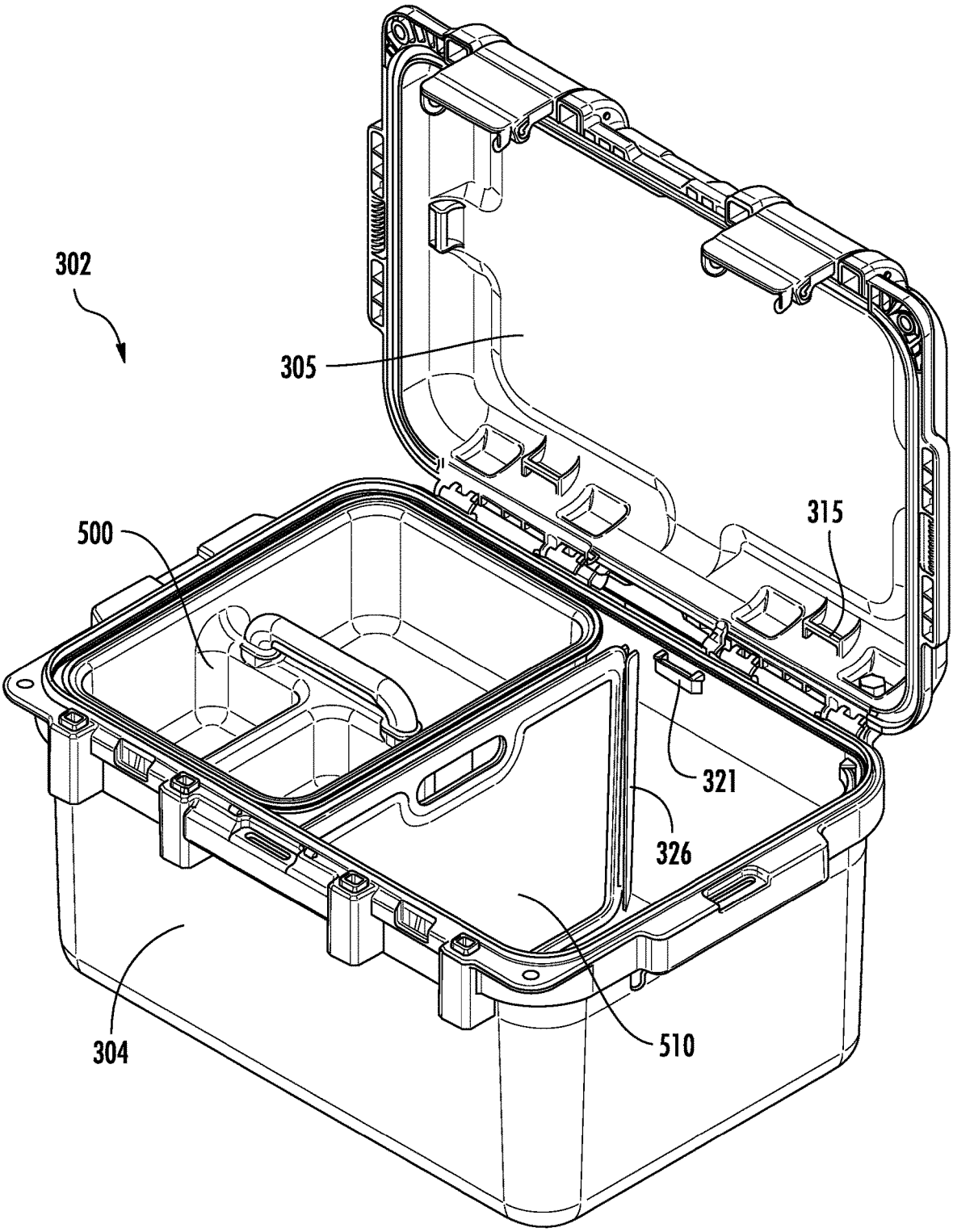
FIGS. 26A-26D illustrate a top perspective view of the container of FIG. 17A in an open position with various accessories installed according to one or more aspects described herein.
Figure 26B:
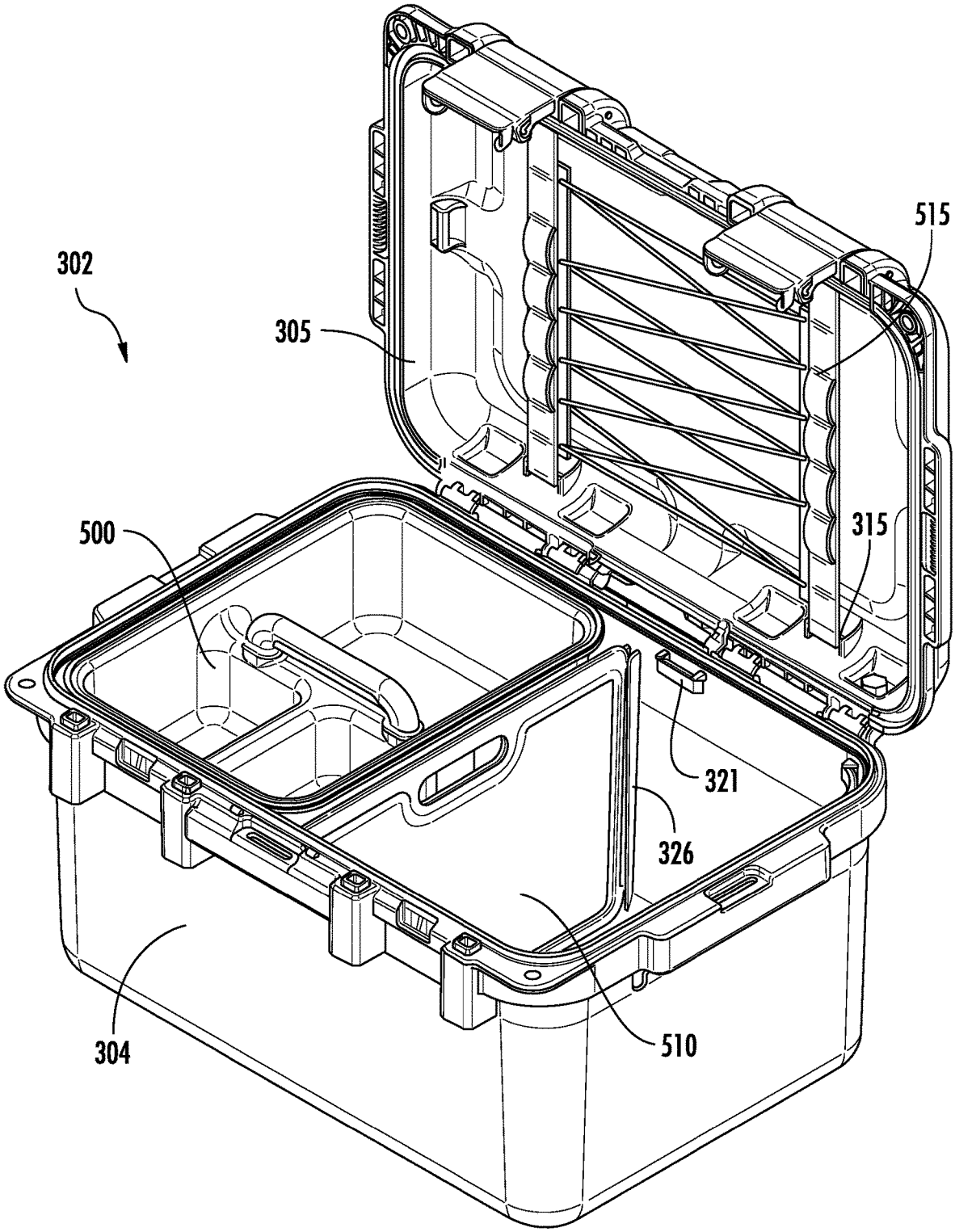
Figure 26C:
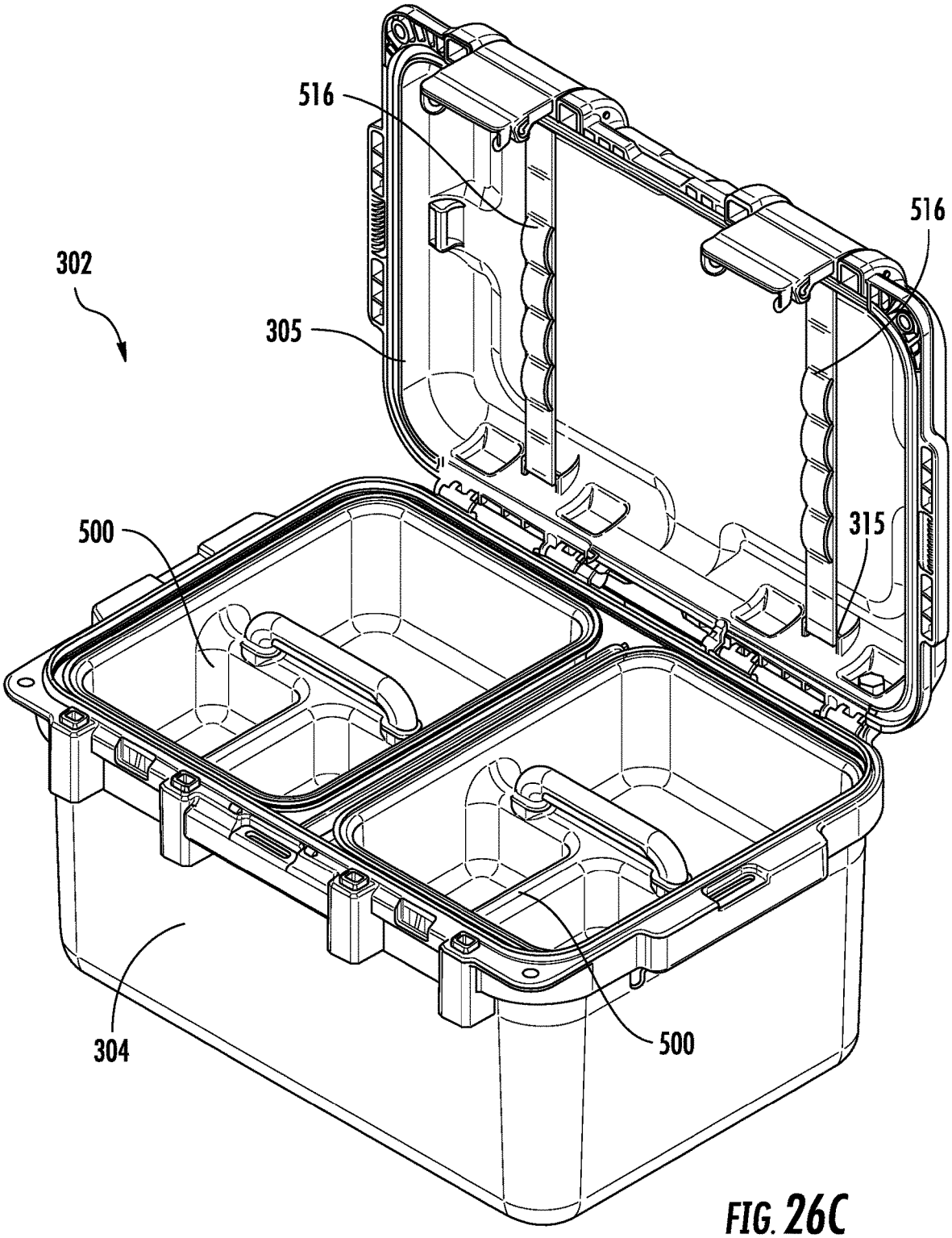
Figure 26D:
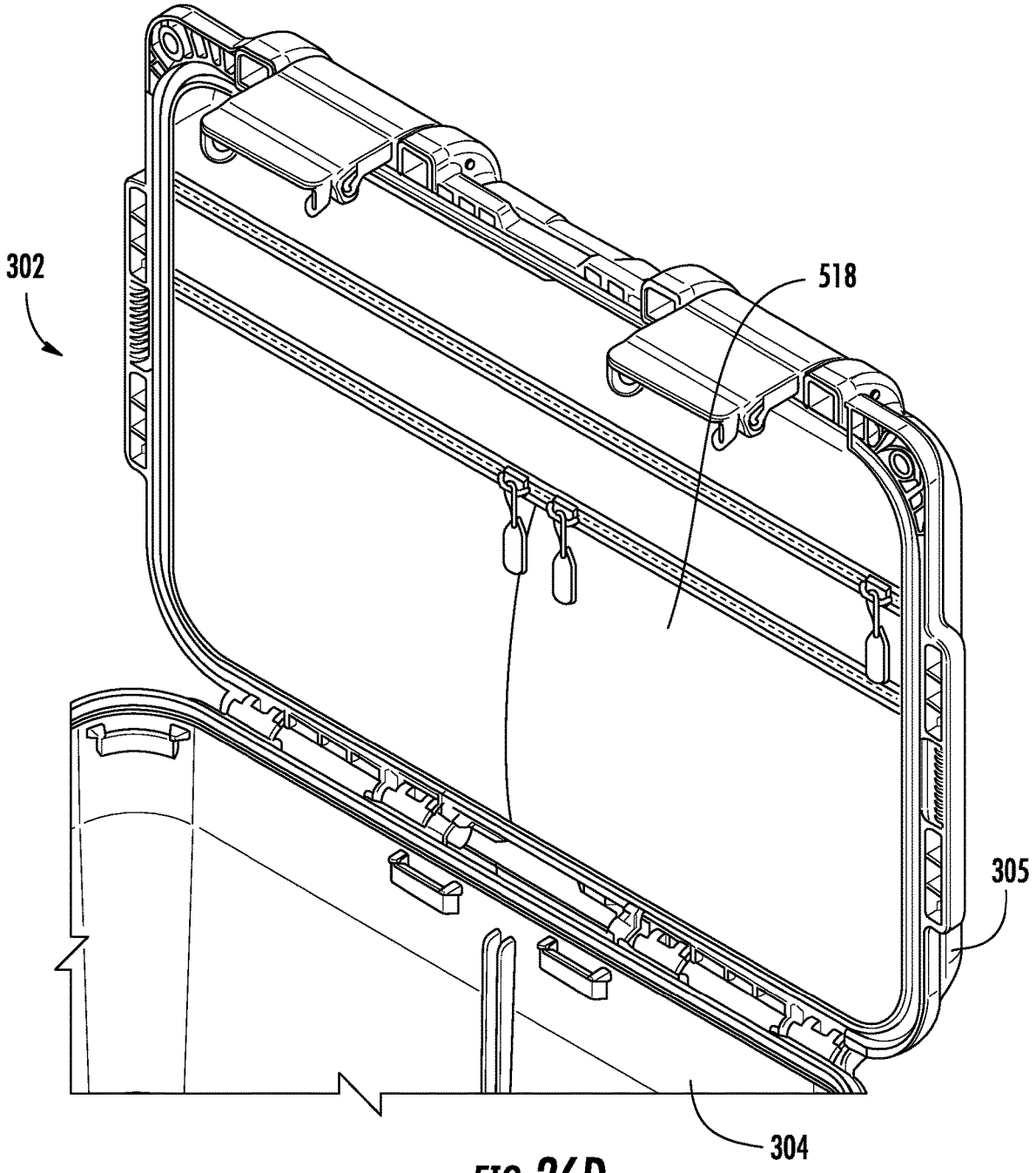

FIGS. 26A-26D illustrate the container 302 as described above that is configured with various accessories. For instance, FIG. 26A illustrates an embodiment of a storage system that includes the container 302 and a tray 500 installed where the tray 500 is supported by the plurality of tabs 321 as well as the divider wall 510 installed between the pair of tracks 326. FIG. 26B illustrates the system shown in FIG. 26A with a cargo net 515 attached to the clips 315 of the lid 305. As still another embodiment of the storage system is illustrated in FIG. 26C where the container 302 includes two trays 500 supported by the tabs 321 along with a pair of utility straps 516 connected to the clips 315 of the lid 305 to provide multiple locations for a user to attach and organize any desired items in the container 302. FIG. 26D illustrates another option where a soft sided storage bag 518 that includes a plurality of zippered storage compartments. As discussed above, by providing the multiple attachment points within the base and the lid, the container 302 may be equipped with a variety of options of accessories to provide a storage system to provide an organized storage solution for a user.

Figure 27B:
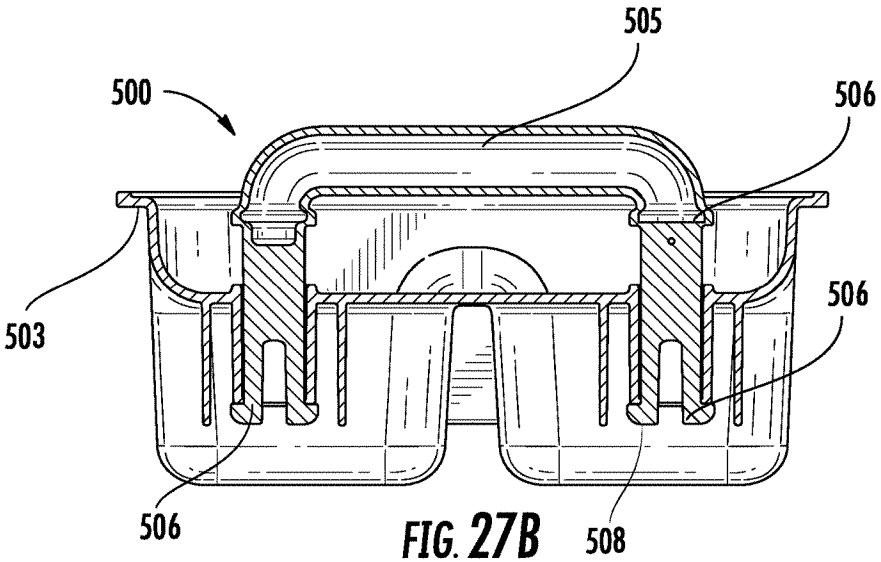
FIGS. 27B and 27C illustrate side cross-sectional views of the accessory of FIG. 27A according to one or more aspects described herein.
Figure 27C:
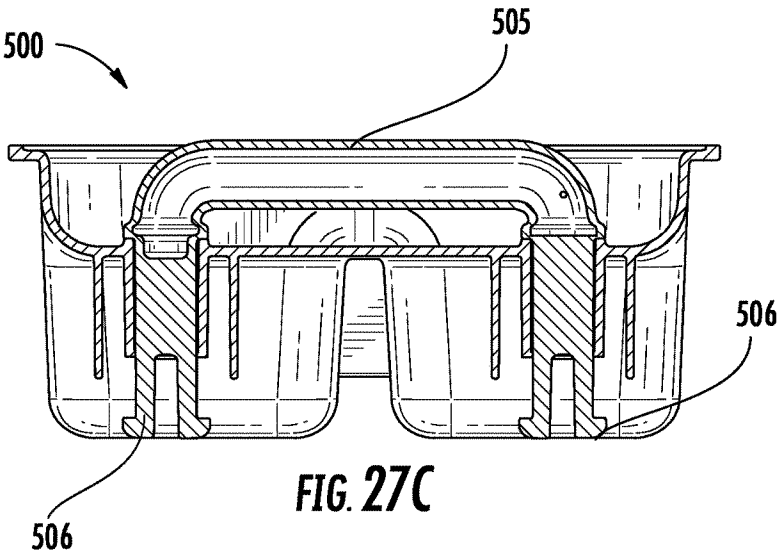
Figure 27A:
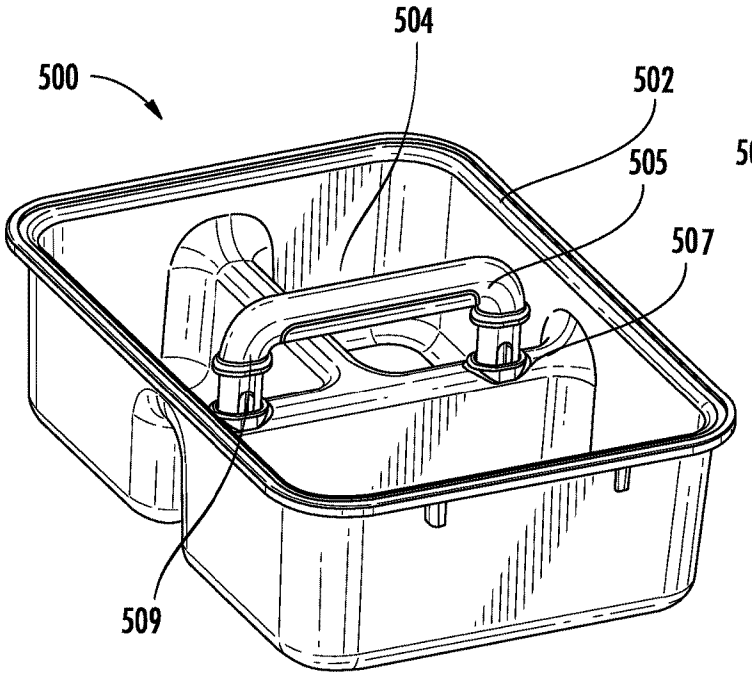
FIG. 27A illustrates a top perspective view of an accessory for the container of FIG. 17A according to one or more aspects described herein.

FIG. 27A-27C illustrate further details of the tray 500. The tray 500 may have a body 502 with a mounting surface 503 along with a plurality of storage cavities 504. The storage cavities 504 may have any size and may be configured to have any number of cavities 504. For instance, the exemplary embodiment shown in FIGS. 27A-27C comprises three cavities, where two of the cavities are smaller than the third cavity. As another feature of the tray 500, the tray 500 may include a movable handle 505. The handle 505 may move vertically from an extended position shown in FIG. 27B to a contracted or storage position shown in FIG. 27C. In the extended position, a user can easily lift the tray 500 out of the container 302 while in the contracted position, the tray 500 has a lower height profile or storage. The handle 505 may have a U-shaped tube-like structure with two ends 506 that engage into openings 507 in the body 502 of the tray. Each end 506 of the tube-like structure may have a tapered surface 508 that allows for installation into the openings 507 and a retaining surface 509 to keep the handle from being removed and also providing a positive stop to limit the vertical movement of the handle 505.

As another option, as illustrated in FIGS. 28-36-H, a carry strap 600 may attach to container 302 to allow a user to easily lift and carry the container 302. As shown, in FIGS. 28 and 29, carry strap 600 may be installed by inserting an end portion 616 of each end 604, 606 into openings 341 on opposing side handles 340 of base 304 of container 302. The carry strap 600 may include a base member 602 having a first end 604, a second end 606 opposite the first end 604, an elongated member 608 extending between the first end 604 and the second end 606, and a carry handle 610. The first end 604 and the second end 606 may each have an end portion 616 that includes an engaging member 618, which helps to secure the strap 600 to the handles 340 of the container 302 using a friction fit. As defined herein, the term "friction fit" may relate to a means that two components are secured to each other using only the mechanical interference or mechanical contact created by the two components when assembled together. The carry handle 610 may include openings 612 at each end 614 such that the elongated member 608 may extend through each opening 612.

Figure 28:
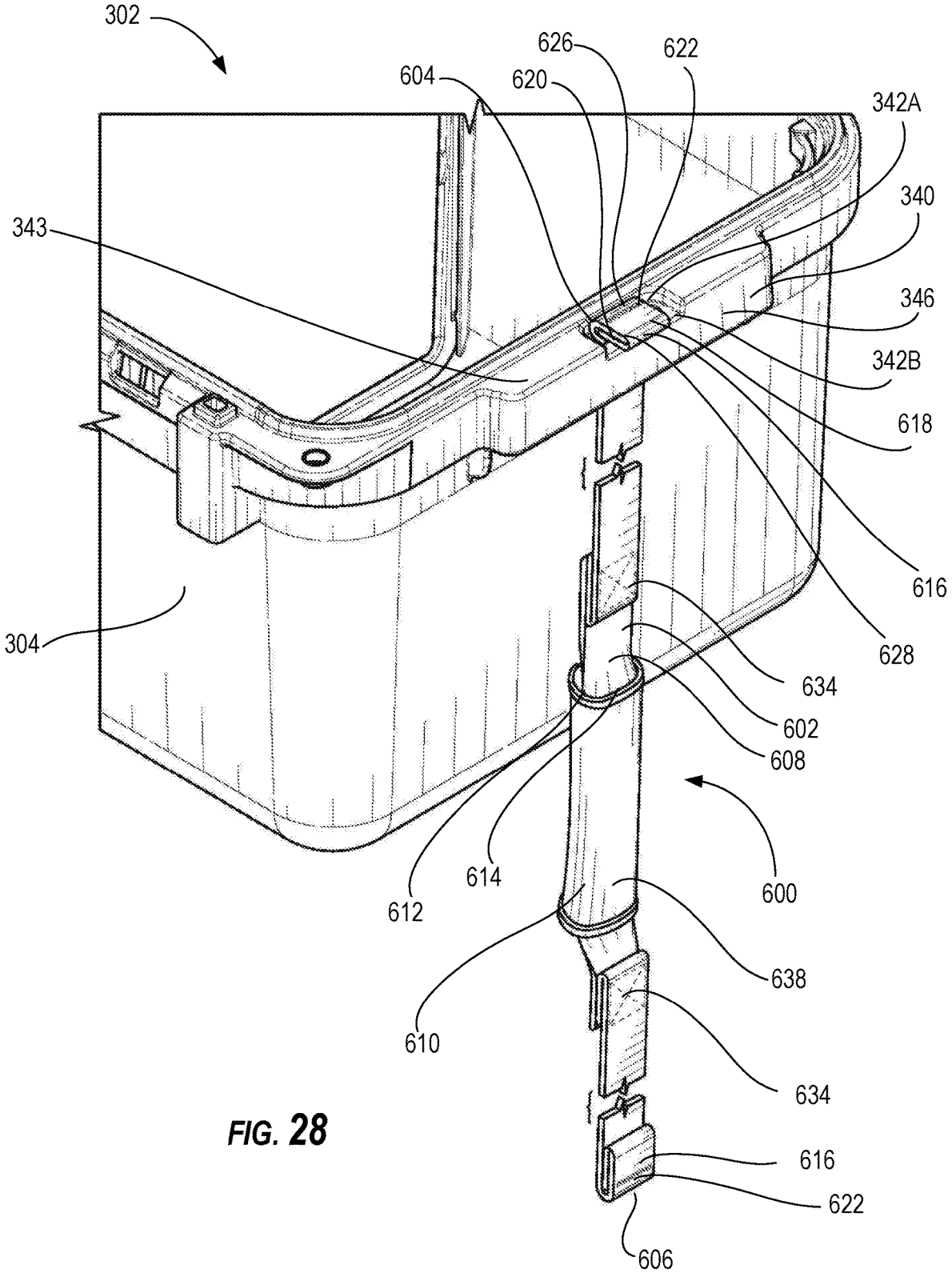
FIG. 28 illustrates a partial top front perspective view of a carry strap installed onto the container according to one or more aspects described herein.
Figure 29:
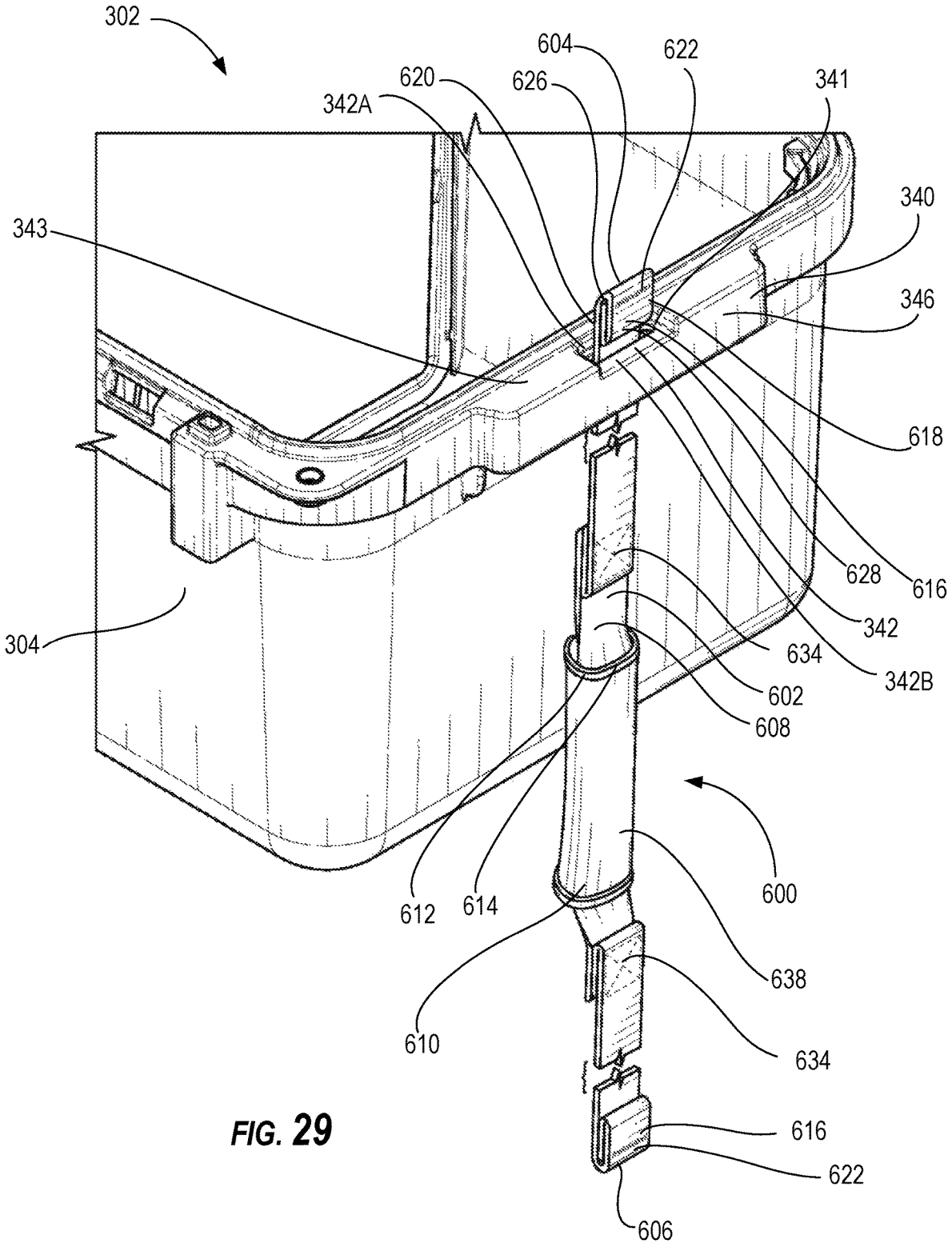
FIG. 29 illustrates a partial top front perspective view of a carry strap partially installed onto the container according to one or more aspects described herein.

As shown in FIGS. 28 and 29, the carry strap 600 may be installed onto the container 302 by inserting one of the end portions 616 through the opening 341 of the handle 340 from below the handle 340, where the end portion 616 may be rotated relative to the elongated member 608 onto the top surface 343 of the handle 340. As shown in the illustrated example, side handle 340 may include a recess 342 that is offset below the top surface 343 that receives the engaging member 618. The engaging member 618 of each end portion 616 may include a layered or folded portion 620. The elongated member 608 may be folded onto itself and joined together creating an inboard portion 626 and an outboard portion 628 of the engaging member 618. The folded portion 620 may include at least two layers of the elongated member 608 and have at least one fold. As shown in the illustrated examples, the folded portion 620 may include three layers of the elongated member 608 and three folds. In other examples, the folded portion 620 may have more than three layers and three folds. The folded portion 620 may be joined using a mechanical element 622 such as stitching, a grommet, or other means known to one skilled in the art to join the layers together. In the illustrated examples, the stitching 622 may be a bartack stitch, a lockstitch, or other stitching known to one skilled in the art. The stitching 622 may have a width of approximately 2 mm, or within a range of 1 mm and 3 mm to provide adequate strength to the joint. The stitching 622 may be located a fixed distance 624 from the respective end 604, 606 to a centerline 625 of the stitching 622 creating an inboard portion 626 and an outboard portion 628. The engaging member 618 may then be rotated relative to the elongated member 608 on either side of the stitching 622 to secure the strap 600 to the container 302. The bartack stitching 622 may also help to increase the strength of the joint. Alternatively, the folded portion 620 may be joined using an adhesive, tape, or other means known to one skilled in the art. The adhesive or tape may be used alone or in conjunction with the stitching 622. As shown in FIG. 28, once the end portion 616 of the strap 600 is extended through the top surface 343 of the handle 340, the engaging member 618 may be rotated along the stitching 622 such that the inboard portion 626 may be received in an inboard recess portion 342A of recess 342 and the outboard portion 628 may be received in an outboard recess portion 342B of recess 342. As discussed above, the stitching 622 may be located a fixed distance from the respective end 604, 606 such that the inboard portion 626 of the engaging member 618 has a smaller length than the length of the outboard portion 628. For example, the length of the inboard portion 626 may be within a range of 60 percent and 66 percent of the length of the outboard portion 628, or within a range of 55 percent and 70 percent of the length of the outboard portion 628. The length of the inboard portion 626 may be measured as the length of the engaging member 618 from a centerline of the stitching 622 of the engaging member 618 to its respective end. Similarly, the length of the outboard portion 628 may be measured as the length of the engaging member 618 from a centerline of the stitching 622 to an end 629 of the outboard portion 628 located at the fold on folded portion 620. For example, the length of the inboard portion 626 may be approximately 7 mm, or within a range of 5 mm to 10, and the length of the outboard portion 628 may be approximately 11 mm, or within a range of 9 mm and 16 mm.

Figure 30:
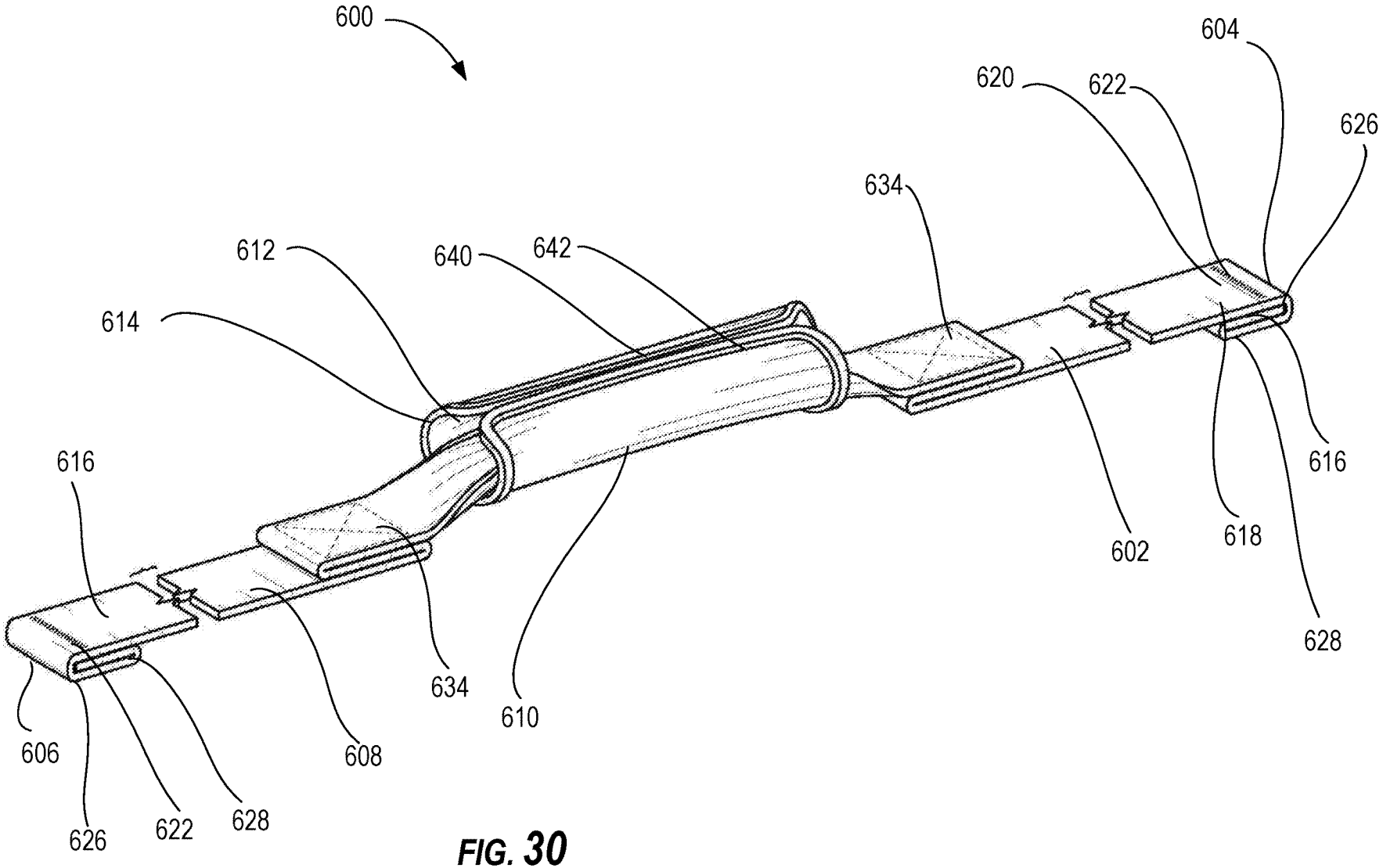
FIG. 30 illustrates a top front perspective view of the carry strap of FIG. 28 according to one or more aspects described herein.
Figure 31:
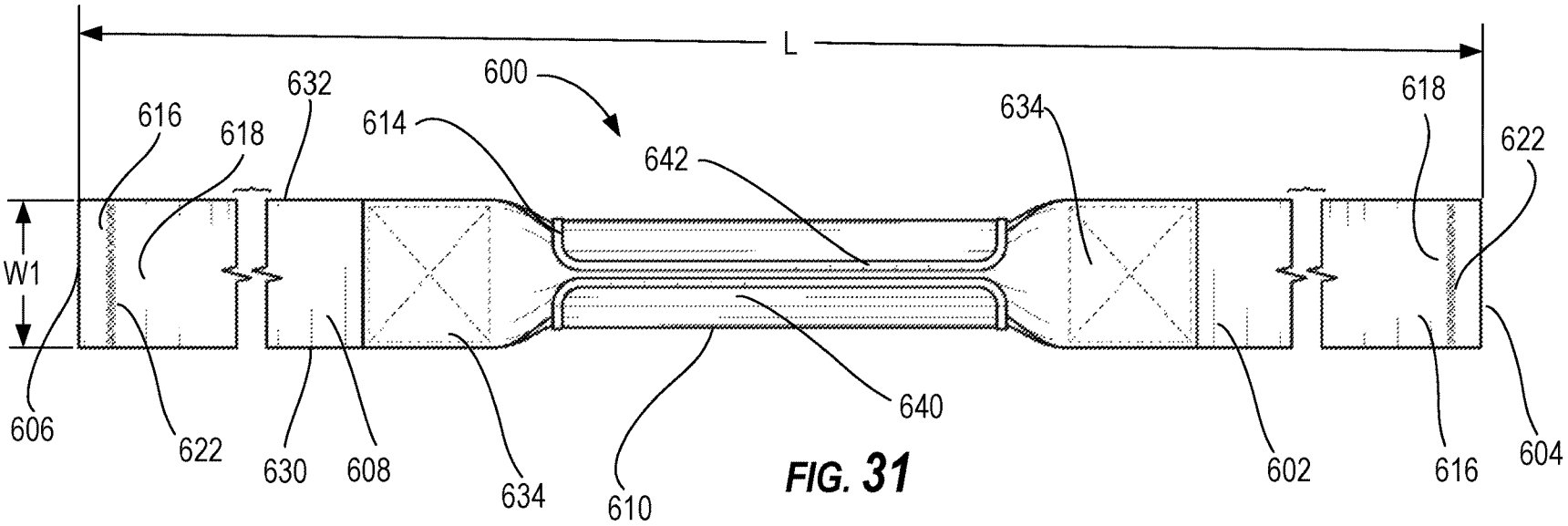
FIG. 31 illustrates a top view of the carry strap of FIG. 28 according to one or more aspects described herein.
Figure 32:
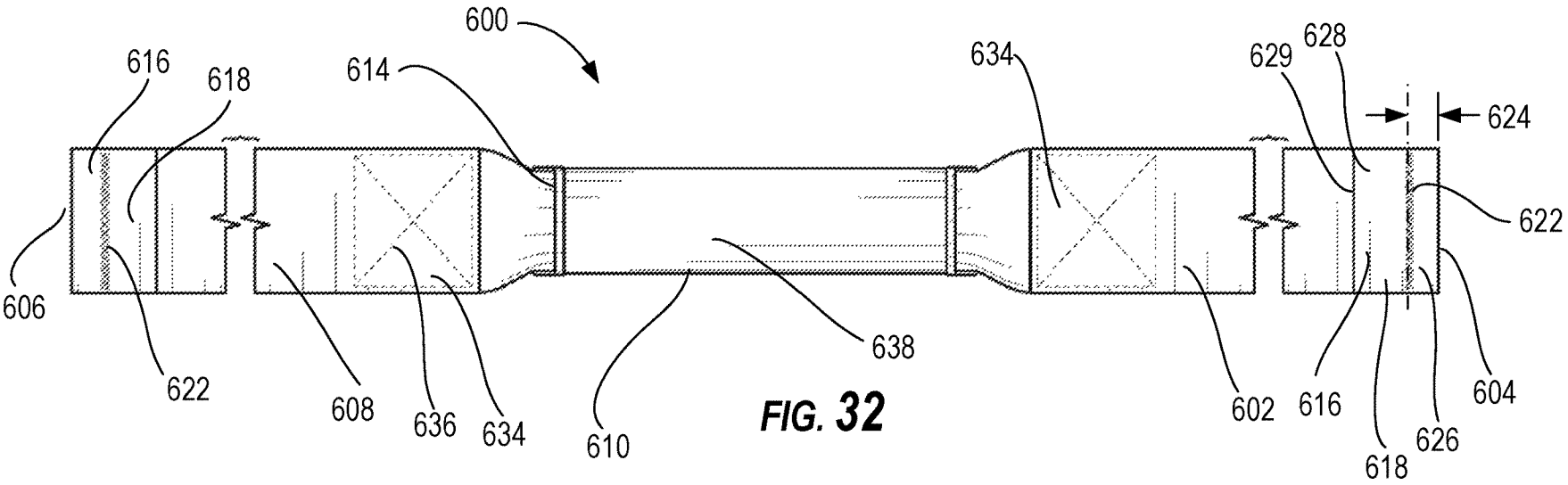
FIG. 32 illustrates a bottom view of the carry strap of FIG. 28 according to one or more aspects described herein.
Figure 35:
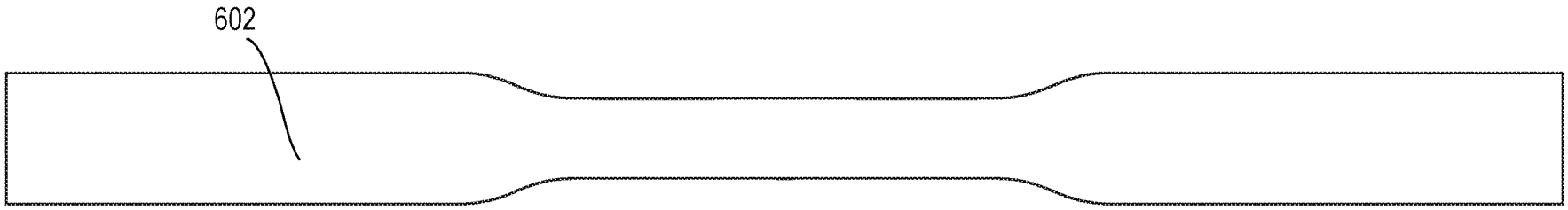
FIG. 35 illustrates a top view of an alternate base member of the carry strap of FIG. 28 according to one or more aspects described herein.

To enhance the friction fit between the strap 600 and the openings 341, the elongated member 608 of strap 600 may have a width at each end portion 616 that is greater than the width of the opening 341 on the handle 340. The width, W1, of the elongated member 608 may be the distance from a first side 630 to a second side 632 of the elongated member 608, while the width, W2, of the opening 341 may be measured as the distance across the span between the smaller ends of the elongated opening 341. In some examples, the width, W1, of the base member 602 may be approximately 5 percent greater than the width, W2, of the opening 341, or may be within a range of 3 percent to 7 percent greater than the width, W2, of the opening 341. The width, W1, of the base member 602 may be a constant width, where the width, W1, may be approximately 38 mm or within a range of 35 mm to 41 mm, or alternatively, base member 602 may have a variable width where the width of the base member 602 may have a width that is less in a central region that extends through the carry handle 610 than the width of the base member 602 at the end portions 616 as shown in FIG. 35. In the illustrated examples, carry strap 600 has a base member 602 with a constant width, the elongated member 608 may curl or wrap along an interior surface of the carry handle 610 as shown in FIG. 30. This may cause the carry handle 610 to have a width that is less than the width of the base member 602 at the end portions 616. In some examples, the width of the handle 610 may be within a range of 60 to 75 percent of the width of the base member 602 at the end portions 616.

As shown in FIGS. 28 and 29, to install strap 600 to the container 302, the first end 604 of strap 600 may be inserted through an elongated opening 341 on the handle 340 that is located on a first side of the base 304 of the container 302. The end portion 616 may extend through the opening 341 above top surface 343 with the majority of the elongated member 608 still below handle 340. In some examples, the end portion 616 may be inserted at an angle through the opening 341 where the end portion 616 forms an acute angle with the top surface 343 of the handle 340 as it is being inserted into the opening 341. This acute angle may be within a range of 1 degree and 55 degrees. Next, the engaging member 618 may be rotated relative to the elongated member 608 such that the inboard portion 626 of the engaging member 618 lays flat within the inboard recess portion 342A of the recess 342 and the outboard recess portion 342B of the recess 342. The inboard recess portion 342A may be the portion of recess 342 that extends from the elongated opening 341 toward an interior void of the container 302, and an outboard recess portion 342B may be the portion of recess 342 that extends from the elongated opening 341 away from the interior void of the container 302. The depth of the recess 342 may be greater than the thickness of both the inboard portion 626 and the outboard portion 328. Once a first end 604 of the strap 600 is engaged with the handle 340 on a first side of the base 304, the process is repeated by attaching a second end 606 of the strap 600 to the handle 340 on the second side of the base 304 opposite the handle 340 with the first end 604 attached. For example, the second end 606 is inserted through an elongated opening 341 on the handle 340 that is located on a second side of the base 304 of the container 302 where the end portion 616 extends up above a top surface 343 and the majority of the elongated member 608 is below handle 340. Like installing the first end 604, the second end portion 616 at end 606 may be inserted where the end portion 616 forms an acute angle with the top surface 343 of the handle 340 as it is being inserted into the opening 341. This acute angle may be within a range of 1 degree and 55 degrees. Lastly, the second engaging member 618 may be rotated relative to the elongated member 608 such that the inboard portion 626 of the engaging member 618 lays flat within the inboard portion 342A of the recess 342 and the outboard portion 342B of the recess 342. The strap 600 is then secured at both ends 604, 606 to their respective handles 340 of the base 304. The lid 302 may be closed, and the strap 600 may be grasped by a user by the strap handle 610 to lift the container 302. When the strap 600 is lifted, the elongated member 608 may wrap around an outer portion of the bottom of the handle 340 and contact the outer surface 346 of the handle 340.

As discussed above, the carry strap 600 may include a base member 602 having a first end 604, a second end, 606 and an elongated member 608 extending between the first end 604 and the second end 606, and a carry handle 610. The carry handle 610 may be located in a substantially centered position along the overall length, L, of the carry strap 600. In addition, the strap 600 may include a pair of overlap regions 634 arranged a fixed distance from ends 614 of the carry handle 610. The overlap regions 634 may include three layers of the elongated member 608 folded upon itself and then joined together. In some examples, the overlap regions 634 may include more than three layers. The overlap regions 634 may be permanently joined using stitching 636 such as a box-x stitch that extends near the perimeter of the overlap region 634 with a diagonal stitching region extending between the corners of the stitching. The stitching 636 may have a rectangular shape such that the box-x stitch may be approximately 30 mm in length or within a range of 28 to 32 mm and may have a width of approximately 34 mm, or within a range of 32 to 38 mm.

Figures 36A, 36B, 36C, 36D, 36E, 36F, 36G, 36H:
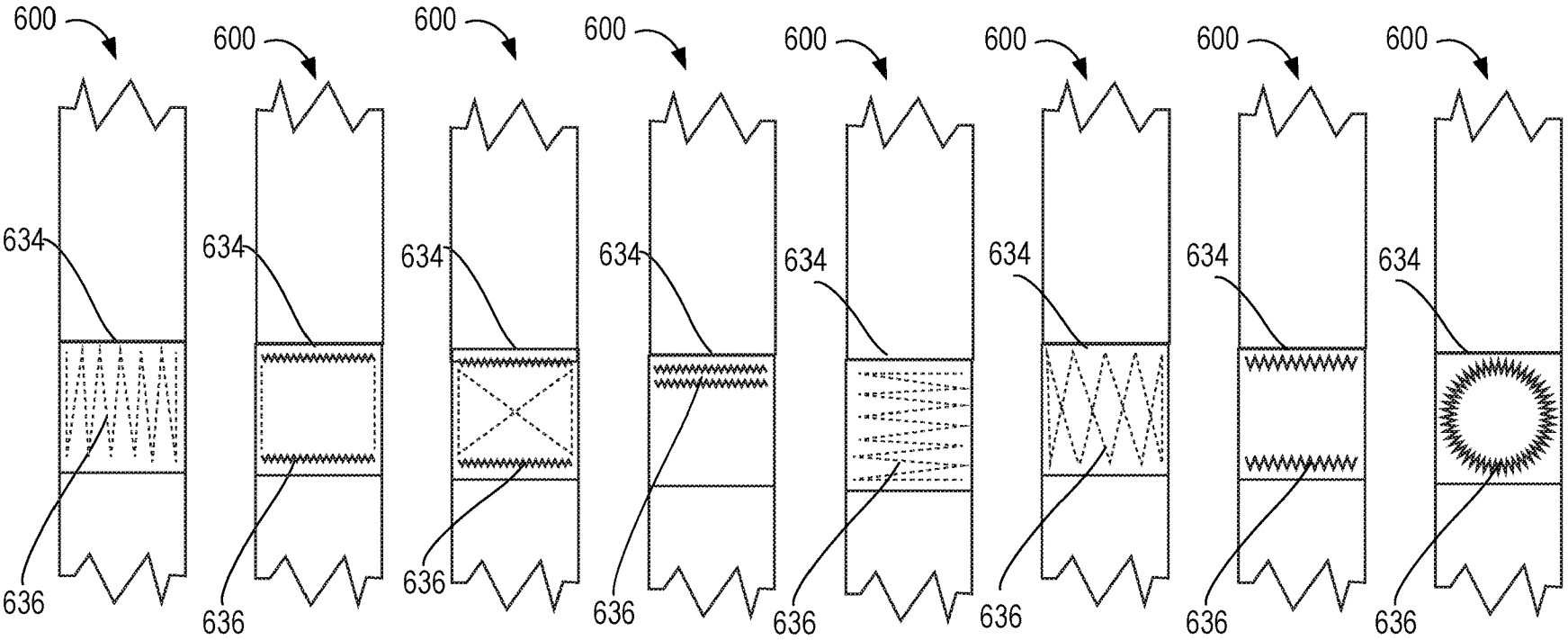
FIGS. 36A-H illustrate top views of alternate stitching options for the carry strap of FIG. 28 according to one or more aspects described herein.

As an alternative to the stitching 636 shown in FIGS. 28-34, the stitching 636 may have a variety of shapes. For instance, the stitching 636 may be in several forms such as: (a) regular or irregular backstitching that is substantially parallel to the webbing such as in FIG. 36A; (b) a box stitch with bartack reinforcement on the ends closest to the fold as shown in FIG. 36B; (c) a box-s stitch with bartack reinforcement on the ends closest to the fold as shown in FIG. 36C; (d) a single bartack or a series of bartacks arranged substantially parallel to the fold as shown in FIG. 36D; (e) regular or irregular backstitching that is substantially perpendicular to the webbing such as in FIG. 36E; (f) a double W stitching pattern as shown in FIG. 36F; (g) a zig-zag stitching pattern as shown in FIG. 36G; and (h) a circular or pattern bartack as shown in FIG. 36H, where the patterned bartack may be any geometric shape, such as triangular, a quadrilateral, or shape containing more than 4 sides. In addition, the bartack pattern of FIG. 36H may include different geometric shapes, such as having rectangular and triangular bartacks together in a pattern.

In some examples, the overlap regions 634 may be joined using stitching alone, or may be joined using an adhesive, or may be joined using stitching in conjunction with an adhesive. These overlap regions 634 may provide additional strength for the carry strap 600 while also keeping the carry handle 610 in a substantially centered location along the length, L, of the carry strap 600. The overall length, L, of the carry strap 600 may have a length to enable the carry strap to clear either the front side 308 or rear side 310 of the container 302 to not inhibit a second container 302 being stacked on top of a first container 302.

Figure 33:
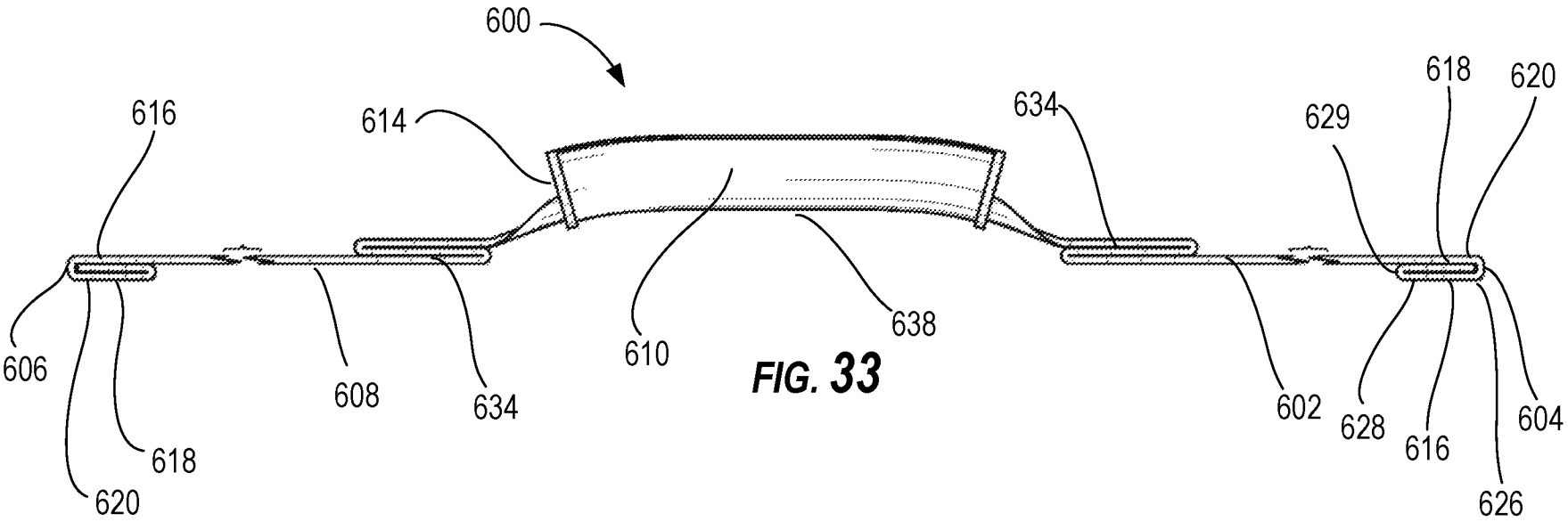
FIG. 33 illustrates a front view of the carry strap of FIG. 28 according to one or more aspects described herein.
Figure 34:
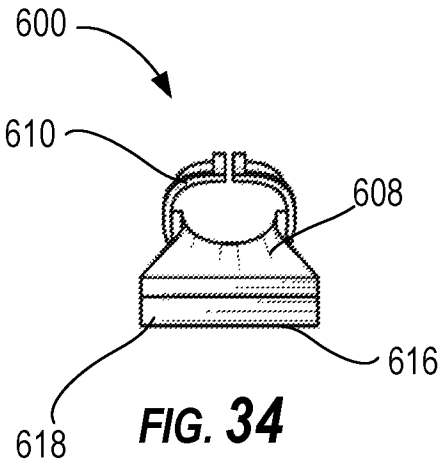
FIG. 34 illustrates a side view of the carry strap of FIG. 28 according to one or more aspects described herein.

The carry handle 610 may be formed from a polymer wrap around the elongated member 608 forming a smooth surface along the bottom side 638 and also have a slot 640 extending an entire length of the handle 610 along the top side 642. The carry handle 610 may have a concave curvature on the bottom side 638 as shown in FIG. 33. The base member 602 may be formed from a woven fiber material or webbing. The woven fiber material or webbing may be a single unitary member that forms the base member 602 of the carry strap 600. In other example, the base member 602 may be formed by a plurality of webbing or fabric strips. The strap material may be formed from nylon, polypropylene, polyester, or other polymer based material. The woven fiber material or webbing may be solution dyed, piece dyed, greige, on undyed.

Additionally, the carry strap 600 as described above may mount similar to container 202 or may in an alternative example, the carry strap 600 may include a mechanical clip or similar mechanical structure to secure the carry strap 600 to any of containers described herein 2, 202, and 302.

According to one aspect, a container is disclosed. The container may include a molded base including: a sidewall structure having a first side, a second side opposite the first side, a third side extending between an edge of the first side and an edge of the second side, and a fourth side opposite the third side, the sidewall structure having a first end and a second end; a bottom portion connected to a first end of the sidewall structure and configured to support the container on a surface; and an opening formed at a second end of the sidewall structure, opposite the first end, the opening being configured to allow access to an interior void of the container formed by the sidewall structure and the bottom portion. The container may also include a latch keeper extending from the sidewall structure, the latch keeper having an upper surface, an inner surface and a lower surface; a lid, the lid pivotal between an open configuration and a closed configuration, the lid having a shape corresponding to a shape of the base and configured to cover the opening formed at the second end of the sidewall structure when the container is in the closed configuration; a hinge configured to connect the lid to the base and about which the lid is rotatable from the closed configuration to the open configuration. The container may also include a latch assembly, the latch assembly having a locked position and an unlocked position, the latch assembly comprising; a latch body pivotally engaged with the lid, the latch body having at least one engagement lug; a locking member slidably engaged with the latch body, the locking member being slidable between at least a downward position and an upward position, the locking member configured to lock the lid in the closed configuration when the locking member is in the downward position and configured to unlock the lid when the locking member is in the upward position; a biasing member engaged with the latch body and the locking member, the biasing member biasing the locking member in a downward position; and an activating member pivotally engaged with the latch body and engaged with the locking member, the activating member configured to move the locking member from the downward position to the upward position. The latch assembly may only be moved from the unlocked position to the locked position when the locking member is in the upward position. The at least one engagement lug of the latch body may engage the lower surface of latch keeper when the latch assembly is in the locked position. The lower surface of the locking member engages the upper surface of the latch keeper when the latch assembly is in the locked position.

Rotating the lid from the closed configuration to the open configuration may include rotating the lid 90° from the closed configuration. The container may contain insulation within the sidewall structure. The container may include a second latch assembly. The container may include a gasket arranged in a recess formed in at least one of the base and the lid. The container may include a channel integrally molded with an exterior surface of the base. The channel may extend around an entire exterior perimeter of the base. The container may also include at least one handle. The handle may include a first arm and a second arm, and each of the first arm and second arm may include a raised portion at a distal end of the arm.

According to another aspect, a container is disclosed. The container may include a base including: a sidewall structure having at least a first side and a second side opposite the first side, the sidewall structure having a first end and a second end; a bottom portion connected to a first end of the sidewall structure and configured to support the container on a surface; an opening formed at a second end of the sidewall structure, opposite the first end, the opening being configured to allow access to an interior void of the container formed by the sidewall structure and the bottom portion; and a latch keeper extending from the sidewall structure, the latch keeper having an upper surface, an inner surface and a lower surface. The container may also include a lid, the lid pivotal between an open configuration and a closed configuration, the lid having a shape corresponding to a shape of the base and configured to cover the opening formed at the second end of the sidewall structure when the container is in the closed configuration; a hinge configured to connect the lid to the base and about which the lid is rotatable from the closed configuration to the open configuration; and a latch assembly, the latch assembly having a locked position and an unlocked position. The latch assembly may include a latch body pivotally engaged with the lid, the latch body having at least one engagement lug; a locking member engaged with the latch body, the locking member being movable between at least a downward position and an upward position, the locking member configured to lock the lid in the closed configuration when the locking member is in the downward position and configured to unlock the lid when the locking member is in the upward position; a biasing member engaged with the latch body and the locking member, the biasing member biasing the locking member in a downward position; and an activating member pivotally engaged with the latch body and engaged with the locking member, the activating member configured to move the locking member from the downward position to the upward position.

The locking member may be slidably engaged with the latch body, the locking member being slidable between the downward position and the upward position. The latch assembly may only be moved from the unlocked position to the locked position when the locking member is in the upward position. The at least one engagement lug of the latch body engages the lower surface of latch keeper when the latch assembly is in the locked position. The lower surface of the locking member may engage the upper surface of the latch keeper when the latch assembly is in the locked position. The container may also include a gasket arranged in a recess formed in at least one of the base and the lid. The container may also include a channel integrally molded with an exterior surface of the base, wherein the channel extends around the entire exterior surface of the base. The container may also include at least one handle with the handle having a first arm and a second arm, and wherein each of the first arm and second arm include a raised portion at a distal end of the arm.

According to another aspect, a latch assembly for a structure is disclosed. The structure may have an open configuration and a closed configuration, the structure comprising; and a first portion movable relative to a second portion; a latch keeper engaged with the first portion. The latch assembly, the latch assembly having a locked position and an unlocked position, the latch assembly may include a latch body pivotally engaged with the second portion; a locking member engaged with the latch body, the locking member being movable between at least a downward position and an upward position, the locking member configured to lock the lid in the closed configuration when the locking member is in the downward position and configured to unlock the lid when the locking member is in the upward position; and an activating member pivotally engaged with the latch body and engaged with the locking member, the activating member configured to move the locking member from the downward position to the upward position.

The latch assembly may also include a biasing member engaged with the latch body and the locking member, the biasing member biasing the locking member in a downward position. The locking member may be slidably engaged with the latch body, the locking member being slidable between the downward position and the upward position. The latch assembly may only be moved from the unlocked position to the locked position when the locking member is in the upward position.

The latch body may include an inner surface and the latch keeper may include an upper surface, an inner surface and a lower surface. The at least one engagement lug of the latch body may engage the lower surface of latch keeper when the latch assembly is in the locked position; and the lower surface of the locking member may engage the upper surface of the latch keeper when the latch assembly is in the locked position.

The present disclosure is disclosed above and in the accompanying drawings with reference to a variety of examples. The purpose served by the disclosure, however, is to provide examples of the various features and concepts related to the disclosure, not to limit the scope of the invention. One skilled in the relevant art will recognize that numerous variations and modifications may be made to the examples described above without departing from the scope of the present disclosure.

We claim:

1. A system of a strap for lifting a container comprising:

the container including a first side handle having a first elongated opening on a first side of the container and a second side handle having a second elongated opening on a second side of the container opposite the first side, wherein the first elongated opening has a first opening width and the second elongated opening has a second opening width;

wherein the container has a first recess offset below a first top surface of the first side handle, wherein the first recess has an inboard recess portion that extends toward an interior void of the container from the first elongated opening and an outboard recess portion that extends away from the first elongated opening in a direction extending away from the interior void of the container;

the strap comprising:

a base member having a first end, a second end opposite the first end, and an elongated member extending between the first end and the second end, the base member having a strap width, a first end portion located at the first end having a first engaging member, wherein the first engaging member includes a first layered portion, wherein the first engaging member includes stitching located a fixed distance from the first end to a centerline of the stitching defining an inboard portion and an outboard portion of the first end portion, wherein the inboard portion has a first length defined as a distance from the centerline of the stitching to the first end of the strap and the outboard portion has a second length defined as a distance from the centerline of the stitching to an end of the outboard portion, wherein the first length is less than the second length;

a second end portion located at the second end, wherein the second end portion includes a second engaging member, the second engaging member including a second layered portion;

a carry handle including a first opening and a second opening opposite the first opening, wherein the elongated member extends through the first opening and the second opening; and wherein the first end portion extends through the first elongated opening and the second end extends through the second elongated opening and secures the strap to the container using a friction fit; and wherein the first engaging member is rotated such that the inboard portion of the first engaging member is received in the inboard recess portion, and the outboard portion of the first engaging member is received in the outboard recess portion.

2. The system of claim 1, wherein the strap width of the base member at the first end portion is greater than a width of the first elongated opening of the container.

3. The system of claim 2, wherein the strap width is within a range of 1 percent to 10 percent greater than the first opening width.

4. The system of claim 1, wherein a depth of the first recess is greater than a thickness of the first end portion.

5. The system of claim 1, wherein a majority of the strap extends below the first side handle.

6. The system of claim 1, wherein the inboard portion of the first engaging member lays flat within the inboard recess portion.

7. The system of claim 1, wherein when the strap is lifted, the elongated member of the strap wraps around an outer portion of a bottom of the first side handle of the container.

8. The system of claim 1, wherein the first engaging member is rotated around the centerline of the stitching.

* * * * *